US012752978B2

(12) United States Patent
Gillespie

(10) Patent No.: US 12,752,978 B2
(45) Date of Patent: Oct. 6, 2026

(54) DISPENSING LID

(71) Applicant: Zak Designs, Inc., Spokane, WA (US)

(72) Inventor: Andrew Gillespie, North Easton, MA (US)

(73) Assignee: Zak Designs, Inc., Airway Heights, WA (US)

( * ) Notice: Subject to any disclaimer, the term of this patent is extended or adjusted under 35 U.S.C. 154(b) by 152 days.

(21) Appl. No.: 18/736,374

(22) Filed: Jun. 6, 2024

(65) Prior Publication Data

US 2025/0376306 A1 Dec. 11, 2025

Related U.S. Application Data

(63) Continuation of application No. 18/735,089, filed on Jun. 5, 2024.

(51) Int. Cl.

| | |
|---|---|
| ***B65D 47/06*** | (2006.01) |
| ***B65D 47/08*** | (2006.01) |
| ***B65D 51/24*** | (2006.01) |

(52) U.S. Cl.

CPC ..... *B65D 47/066* (2013.01); *B65D 47/0885* (2013.01); *B65D 51/242* (2013.01)

(58) Field of Classification Search

CPC ..... B65D 47/066; B65D 47/0885; B65D 51/242; B65D 47/06; B65D 47/065;

(Continued)

(56) References Cited

U.S. PATENT DOCUMENTS

| | | | |
|---|---|---|---|
| 3,718,238 | A | 2/1973 | Hazard |
| 5,072,842 | A | 12/1991 | White |

(Continued)

FOREIGN PATENT DOCUMENTS

| | | |
|---|---|---|
| CN | 307366953 | 5/2022 |
| CN | 308897589 | 10/2024 |
| CN | 309000718 | 12/2024 |

OTHER PUBLICATIONS

Built Cascade and Straw Lid [online]; published date unknown , [retrieved on Feb. 14, 2025]. URL: https:www.builtny.com/products/20-oz-wide-mouth-cascade-with-straw-lid (9 pages) (Year: 2025).

(Continued)

*Primary Examiner* — Vishal Pancholi

(74) *Attorney, Agent, or Firm* — Randall Danskin P.S.

(57) ABSTRACT

A lid includes an integration unit formed of a continuous material in common amongst components, which include a spout and a fastener. Another lid includes a selectively extendable and retractable carrying mechanism including a handle having two parallel arms, a bridge, and two posts. A further lid includes an integration unit formed of a continuous material in common amongst components, which include a spout and a gasket with a concave profile. A still further lid includes a well recessed into and defining part of an outside surface of a lid body and a tube projecting outward from a bottom of the well. An integration unit is formed of a continuous material in common amongst components, which include a spout and a socket, the tube seating inside the integration unit socket. The features of the described lids may be combined.

21 Claims, 22 Drawing Sheets

(58) Field of Classification Search
CPC ..... B65D 47/0871; B65D 2251/1066; B65D 2251/1058; A47G 19/2266; A45F 3/18
See application file for complete search history.

(56) References Cited

U.S. PATENT DOCUMENTS

| | | | | |
|---|---|---|---|---|
| 5,203,468 | A * | 4/1993 | Hsu | B65D 47/2037 222/530 |
| 6,102,245 | A | 8/2000 | Haberman | |
| 6,109,487 | A * | 8/2000 | Hashimoto | G01F 19/00 222/189.06 |
| 6,279,773 | B1 * | 8/2001 | Kiyota | B65D 77/283 220/709 |
| 6,382,476 | B1 * | 5/2002 | Randall | B65D 47/0885 220/259.2 |
| 8,550,269 | B2 | 10/2013 | Lane | |
| 8,622,229 | B2 * | 1/2014 | Lane | B65D 43/26 215/388 |
| 8,668,106 | B1 | 3/2014 | Joy | |
| 8,672,174 | B1 | 3/2014 | McMullin | |
| 9,380,898 | B2 * | 7/2016 | Mason | B65D 77/283 |
| 10,124,937 | B2 * | 11/2018 | Wiesman | B65D 51/18 |
| 10,159,368 | B2 | 12/2018 | Lin | |
| D867,057 | S | 11/2019 | Spivey | |
| 10,512,347 | B1 * | 12/2019 | Shepard | B65D 47/066 |
| D889,199 | S | 7/2020 | Shepard | |
| D899,849 | S | 10/2020 | Zhang | |
| D905,499 | S | 12/2020 | Zhang | |
| 11,305,102 | B2 | 4/2022 | Blanchard | |
| 11,390,432 | B2 * | 7/2022 | Li | F16C 11/045 |
| 11,396,407 | B2 * | 7/2022 | Tsai | B65D 51/242 |
| D990,983 | S | 7/2023 | Wang | |
| 11,738,916 | B2 * | 8/2023 | Steinmann | B65D 43/22 222/153.1 |
| D1,006,538 | S | 12/2023 | Xu | |
| D1,012,605 | S | 1/2024 | Chen | |
| D1,019,271 | S | 3/2024 | Chen | |
| D1,028,624 | S | 5/2024 | Wang | |
| D1,041,245 | S | 9/2024 | Yao | |
| D1,044,391 | S | 10/2024 | Yao | |
| D1,047,580 | S | 10/2024 | Yao | |
| D1,049,768 | S | 11/2024 | Yao | |
| D1,050,806 | S | 11/2024 | Yao | |
| D1,051,662 | S | 11/2024 | Chen | |
| D1,051,663 | S | 11/2024 | Chen | |
| D1,055,630 | S | 12/2024 | Fang | |
| 12,365,520 | B2 | 7/2025 | Noveletsky | |
| D1,086,797 | S | 8/2025 | Noveletsky | |
| 2004/0217139 | A1 * | 11/2004 | Roth | B65D 47/0842 215/237 |
| 2011/0174993 | A1 | 7/2011 | Blain | |
| 2012/0031902 | A1 | 2/2012 | Gilbert | |
| 2012/0187075 | A1 * | 7/2012 | El-Saden | B65D 51/242 215/389 |
| 2012/0305559 | A1 * | 12/2012 | Steininger | B65D 51/1672 220/259.2 |
| 2012/0312832 | A1 * | 12/2012 | Lane | B65D 51/242 220/774 |
| 2014/0217128 | A1 | 8/2014 | Samartgis | |
| 2016/0114937 | A1 | 4/2016 | Hylton | |
| 2017/0238744 | A1 * | 8/2017 | Sweeney | G01F 13/006 |
| 2017/0267423 | A1 * | 9/2017 | Maruyama | A47G 19/2288 |
| 2018/0332987 | A1 | 11/2018 | Lin | |
| 2019/0092540 | A1 | 3/2019 | Spivey | |
| 2020/0071038 | A1 * | 3/2020 | Shepard | B65D 47/0876 |
| 2022/0041348 | A1 | 2/2022 | Liss | |
| 2022/0212843 | A1 * | 7/2022 | Egorov | A45F 3/18 |
| 2025/0376303 | A1 | 12/2025 | Gillespie | |
| 2025/0376304 | A1 | 12/2025 | Gillespie | |
| 2025/0376305 | A1 | 12/2025 | Gillespie | |
| 2025/0376307 | A1 | 12/2025 | Gillespie | |

OTHER PUBLICATIONS

Harmony Sip and Straw [online]; published date unknown, [retrieved on Feb. 18, 2025]. URL: https://www.zak.com/products/harmony-2-in-1-tumbler-30-oz-cream (13 pages) (Year: 2025).

Stanley IceFlow Flip Straw [online]; published to internet Apr. 11, 2024, [retrieved on Feb. 14, 2024]. URL: https://a.co/d/j1WIvgu (11 pages) (year: 2024).

NUK Fun Grips Straw Cup [online]; published date unknown, [retrieved on Mar. 11, 2025]. URL: https://www.nuk-usa.com/sippy-cups/straw-sippy-cups/nuk-fun-grips-straw-cup/SAP_2210162.html (5 pages) (Year: 2025).

* cited by examiner

DISPENSING LID

CROSS REFERENCE TO RELATED APPLICATIONS

This application claims the benefit under 35 U.S.C. § 120 of U.S. patent application Ser. No. 18/735,089, filed on Jun. 5, 2024 and entitled "Dispensing Lid", which is incorporated herein by reference.

BACKGROUND

Various personal, dispensing containers and related covers or lids have been fabricated and sold over many decades. In the present day, such devices designed to contain liquids are often referred to generically as "water bottles," though they frequently contain liquids other than water, or simply "bottles." For many years, these personal, liquid-dispensing containers and their associated covers or lids, or water bottles, have been designed to meet the particular needs of users during their various events and activities.

For example, many prior art dispensing containers include a complex arrangement of separate components individually assembled and serving separate functions. The separate components might include a spout to dispense liquid, a vent to exchange air, a cap or other mechanism to close the spout, and a fastener to retain the cap or other mechanism. Some dispensing containers may use multiple parts to provide the spout, to provide the vent, to provide the closing mechanism, or to provide the fastener, making the arrangement even more complex. Accordingly, dispensing containers with fewer components would be beneficial.

One dispensing container described in U.S. Pat. No. 8,550,269 includes a bottom-mounted drink spout closed by an outer cap, which is retained by a release button. The outer cap fastening mechanism alone includes at least four separate components: a release button that fits within a tunnel in an inner cap and is biased with a spring and held in place by pin.

Accordingly, designs that increase the simplicity of function and assembly would be beneficial.

BRIEF DESCRIPTION OF THE DRAWINGS

Some embodiments are described below with reference to the following accompanying drawings.

DETAILED DESCRIPTION

Figure 1A:
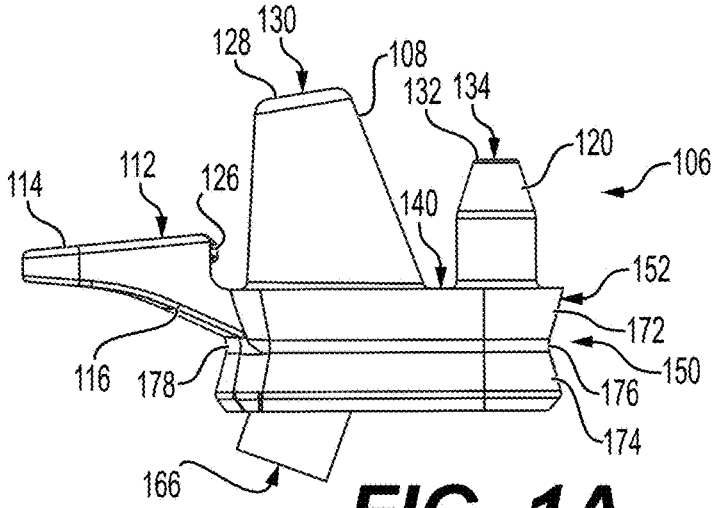
FIGS. 1A-1C are respective side, top, and sectional views of an integration unit for a first example dispensing lid shown in FIGS. 8A-8F and described herein.

The example implementations described herein refer to the accompanying drawings. The same reference numerals in the various drawings may identify the same or similar features.

In some instances, multitude components provide multitude features that may be attractive to dispensing container users. However, multitude components may also increase manufacturing complexity and yield difficulty in user cleaning and parts replacement. More components may also create more points of potential mechanical failure.

Some examples described herein provide an integration unit that combines and integrates multiple mechanical elements and functions into a unified and cohesive whole. The integration units herein may simplify complex systems, improve efficiency, enhance overall functionality, or accomplish more than one of these benefits. The integration units may incorporate two or more elements selected from among a fastener button, a fastener spring, a spout, a vent, and a cap spring into a single module made of a uniform material.

Therefore, some implementations described herein simplify by consolidating multiple components into a single integration unit. The overall design becomes simpler, reducing the number of parts and connections required. Some implementations increase space efficiency with an integration unit by optimizing the use of space within a dispensing container, allowing for more compact and streamlined designs. Some implementations improve performance with an integration unit by integrating mechanical elements within a single unit that can reduce friction and enhance overall mechanical efficiency and performance. Some implementations increase ease of assembly with an integration unit by simplifying the assembly process, making it easier and faster to build the dispensing container. Some implementations enhance reliability with an integration unit by using fewer components and connections, often resulting in higher reliability and reduced chances of mechanical failure. Some implementations reduce cost with an integration unit by integrating multiple functions into a single unit potentially yielding savings in manufacturing, materials, and/or assembly.

In some instances, known spouts (e.g., U.S. Pat. No. 8,550,269) do not provide a secure sealing surface between the spout and a body of a dispensing lid or require a large flange to adequately seal. Some examples described herein provide an integration unit including a spout and a gasket with a concave profile. A body of a dispensing lid has a gasket seat complementary to the concave profile of the gasket and circumscribing a body conduit in which the integration unit is inserted. Therefore, some implementations described herein include a gasket in tension when the integration unit is engaged with the body, thus pulling upper and lower surfaces of the concave profile of the gasket into contact with the gasket seat. As described herein, the concave profile then increases the sealing ability of the integrated unit.

In some instances, dispensing containers include a bottom-mounted drink spout (e.g., U.S. Pat. No. 8,550,269) that engages with the body of the dispensing lid by insertion through the body conduit that passes through the body. Insertion occurs from the bottom of the dispensing lid while removed from its associated container. Unfortunately, pressure applied to the drink spout from the top of the dispensing lid could push the drink spout back through the body conduit, disengaging it from the body. Since the user frequently contacts the dispensing lid when drinking, when closing the lid, or during other activities, some risk of unintentional disengagement exists. Also, the dispensing lid must be removed from the container in order to obtain the drink spout after or before intentional disengagement for cleaning.

Some examples described herein provide a top-mounted drink spout. In two of the examples, a tube projects outward from a bottom of a well recessed into an outside surface of the body. The integration unit includes a spout and a socket. The tube seats inside the integration unit socket when engaged with the body into the well. In other examples, the top-mounted drink spout is inserted through the body conduit that passes through the body, but insertion may only occur from the top of the dispensing lid. Therefore, some implementations described herein reduce the risk of a drink spout unintentionally disengaging from the body by top-mounting the drink spout. Also, the drink spout may be intentionally disengaged for cleaning without removing the dispensing lid from the container.

In some instances, dispensing containers provide a carrying handle attached to or integral with the lid. The handle may be fixed or may be in rotatable engagement with the lid. In either circumstance, the handle is readily apparent and an obtrusive feature of the dispensing container profile. Short of removing a rotatable handle, no option exists for stowing the handle in a concealed location. The handle may add bulk to the dispensing container profile or otherwise form a loop that may catch or snag on objects.

Some examples described herein provide a selectively extendable and retractable carrying mechanism. Therefore, for some implementations described herein, the handle may be stowed in the lid when not in use, providing a sleeker profile without an obtrusive loop.

In some instances, dispensing containers with a handle also include a cap that rotates into an open position to access the dispensing spout. Some dispensing containers are inverted to pour out the contents. Unfortunately, a user drinking from the spout may find that the cap rotates toward a closed position into contact with the user's face.

Some examples described herein provide a cap that engages the handle when extended, which restricts rotation of the cap when inverting the lid. Therefore, some implementations described herein retain the cap when pouring out contents.

As indicated above, the FIGURES are provided merely as examples of the described solutions. Other examples are possible and may differ from what is described with regard to the FIGURES, but nonetheless provide the solutions to the problems described above that yield the enumerated technical benefits.

First Example Dispensing Lid

Figure 1B:
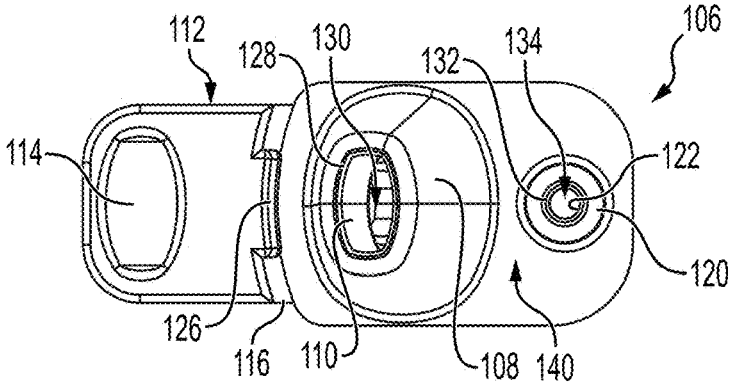
Figure 1C:
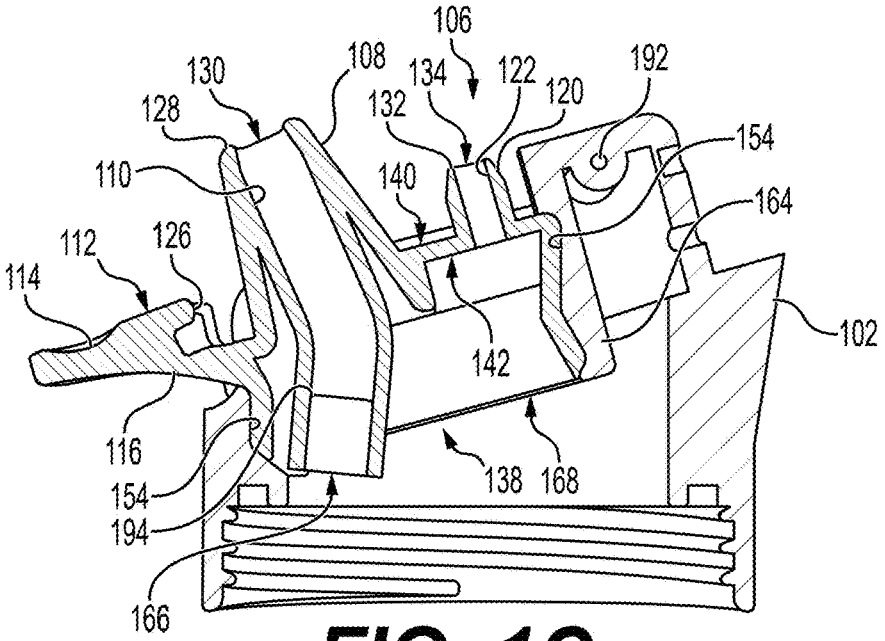

FIGS. 1A-1C are respective side, top, and sectional views of an integration unit 106. Integration unit 106 is included as part of a dispensing lid 100 shown in FIGS. 8A-8F. Dispensing lid 100 is designed for use with a container (not shown) that may contain liquids. Dispensing lid 100 may be selectively engageable with and disengageable from the container, such as by a threaded connection or other known type of connection. Alternatively, dispensing lid 100 may be permanently affixed to the container. As will be appreciated from the discussion herein, dispensing lid 100 increases the simplicity of function and assembly. Also, dispensing lid 100 provides a gasket in tension that increases the sealing ability. Further, dispensing lid 100 includes a handle that may be stowed in the lid and retains the cap when pouring out contents.

Lid 100 includes a body 102, a cap 104 in rotatable engagement with body 102, and integration unit 106 selectively engageable with and disengageable from body 102. Integration unit 106 is formed of a continuous material in common amongst integration unit 106 components, which include a spout 108 and a fastener 112. Spout 108 has a spout conduit 110 passing through the continuous material in common and allowing dispensing through lid 100 via spout conduit 110.

Fastener 112 is formed of the continuous material in common and has a fastener button 114, a fastener lever 116, and a fastener spring. Fastener lever 116 connects fastener button 114 to integration unit 106 and the fastener spring applies a force to fastener lever 116 when pressing fastener button 114.

In the example shown for integration unit 106, the continuous material is resilient and the resilience of the continuous material that forms fastener lever 116 provides the fastener spring integrally. Accordingly, the fastener spring is not labeled with a reference numeral separately from fastener lever 116. In other examples, the fastener spring conceivably could be provided separately, but a benefit exists with providing the fastener spring integrally, as described above in the discussion of benefits associated with integration units.

Figure 8A:
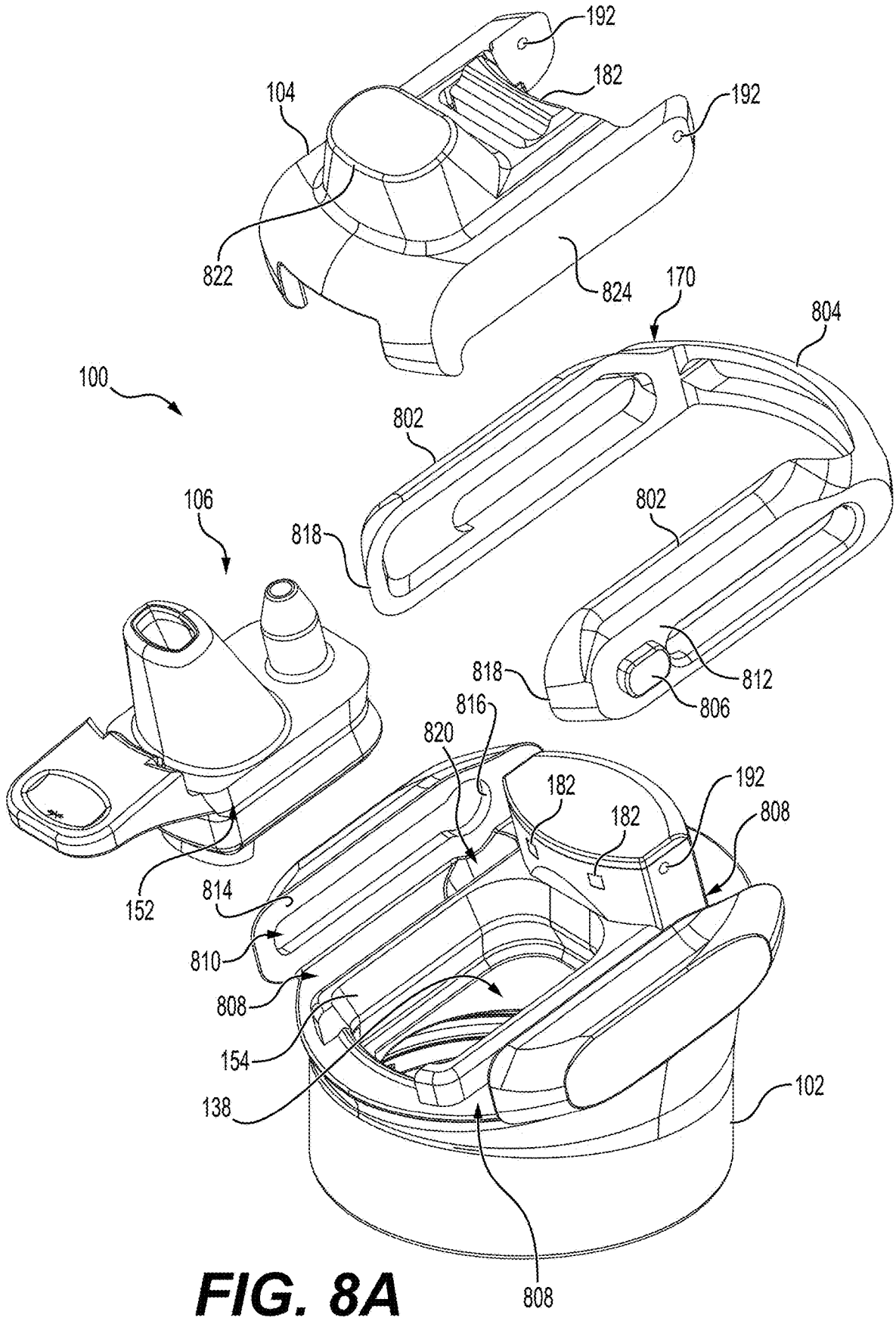
FIGS. 8A and 8B are exploded isometric views of the first example dispensing lid.
Figure 8B:
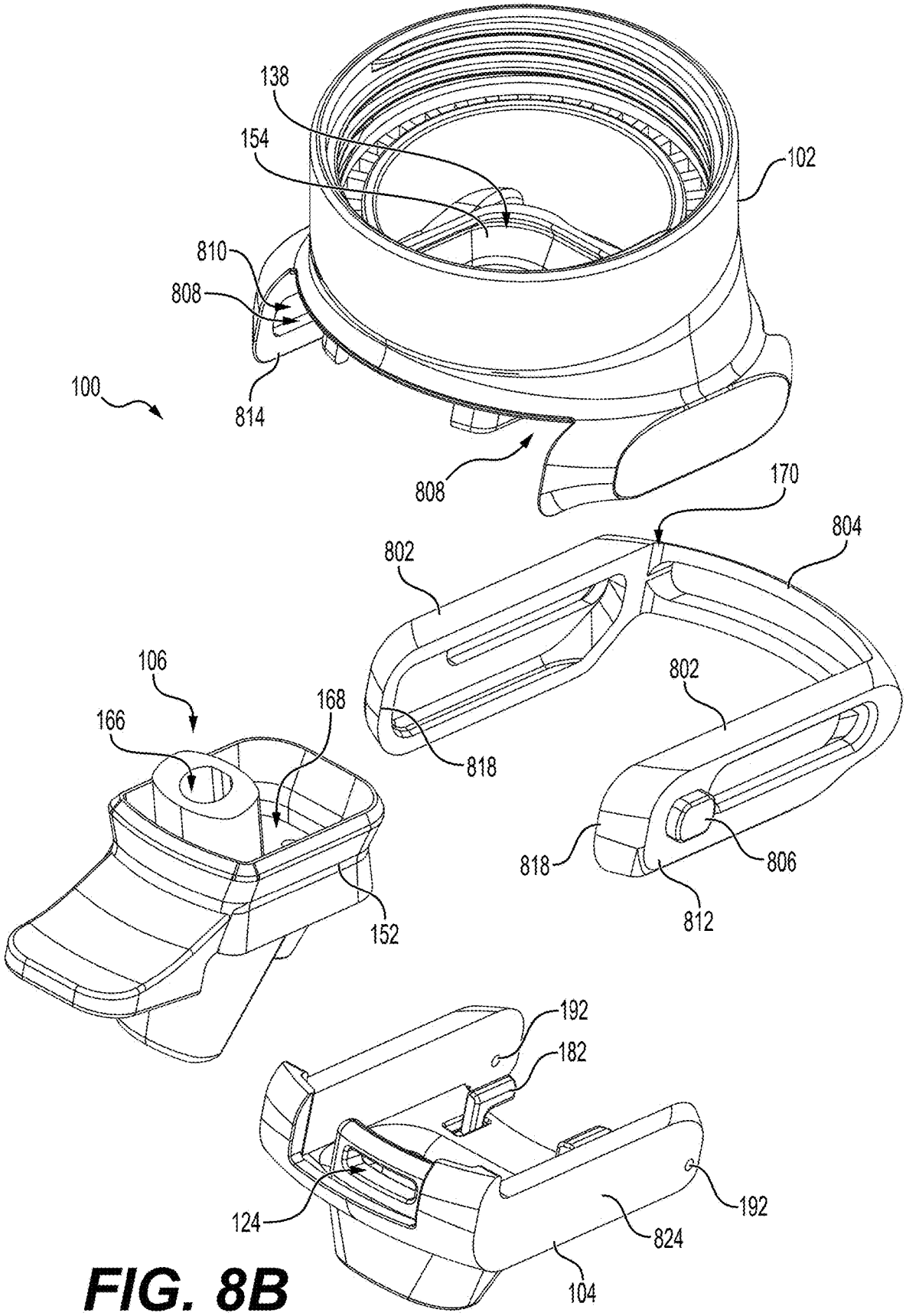
Figure 8C:
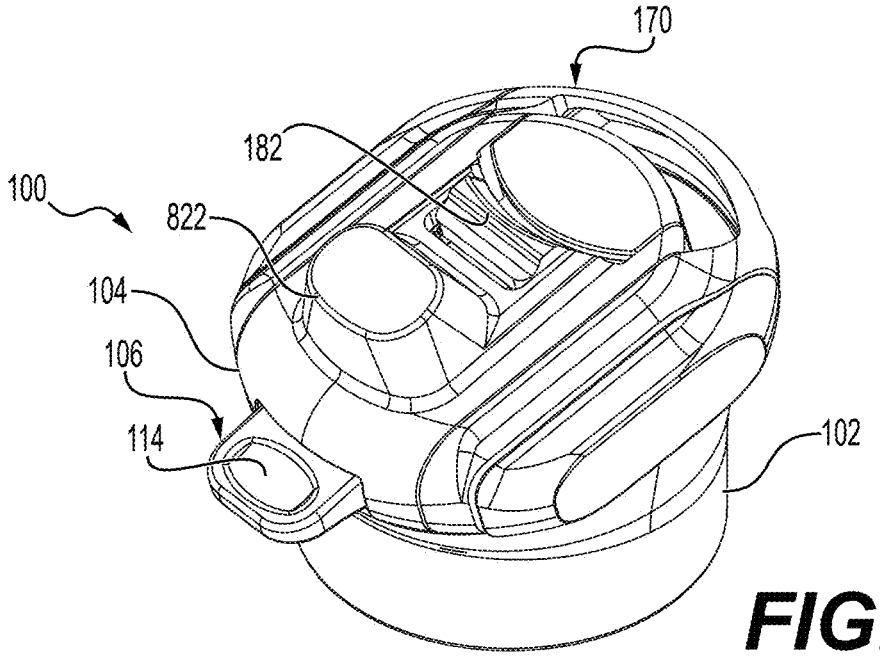
FIGS. 8C-8F are isometric views of the first example dispensing lid with the cap and handle in varied positions.
Figure 8D:
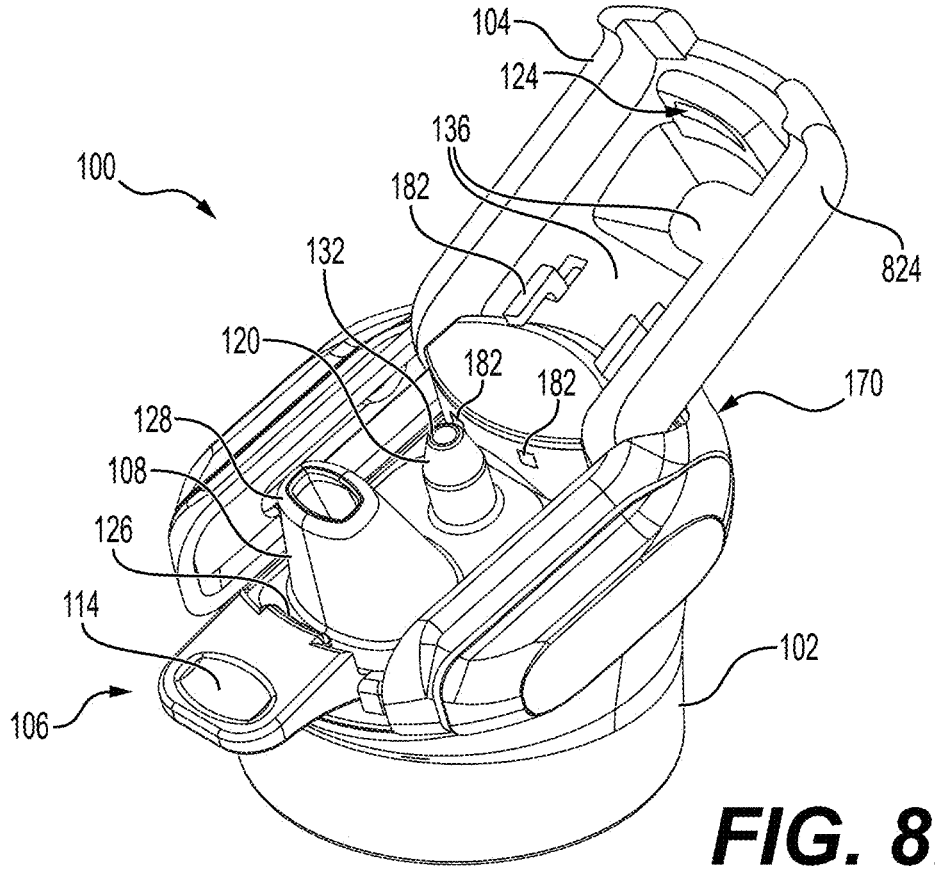
Figure 8E:
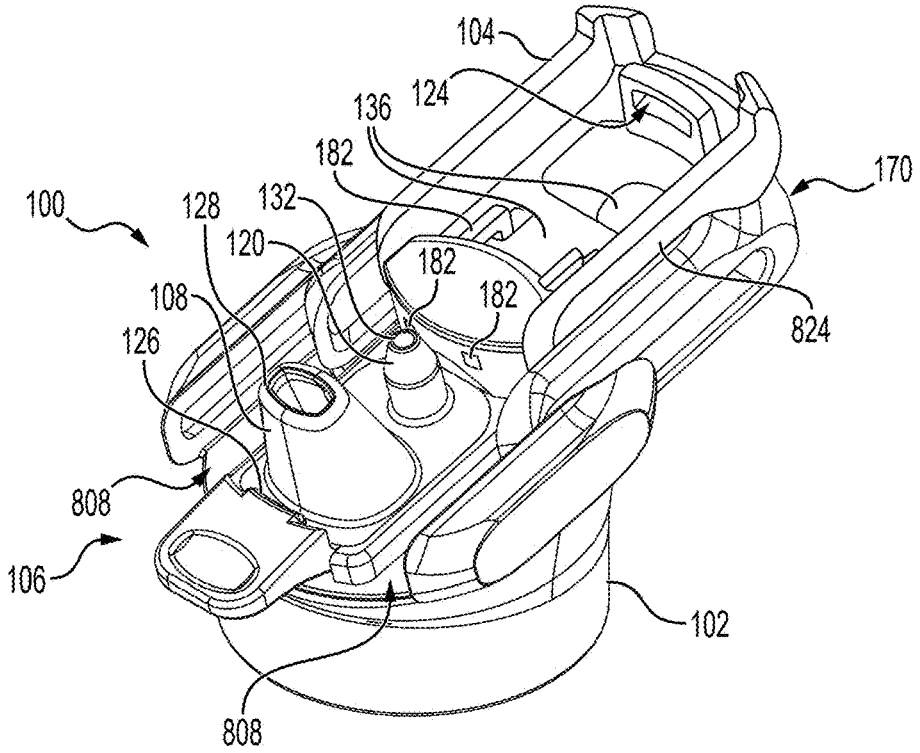
Figure 8F:
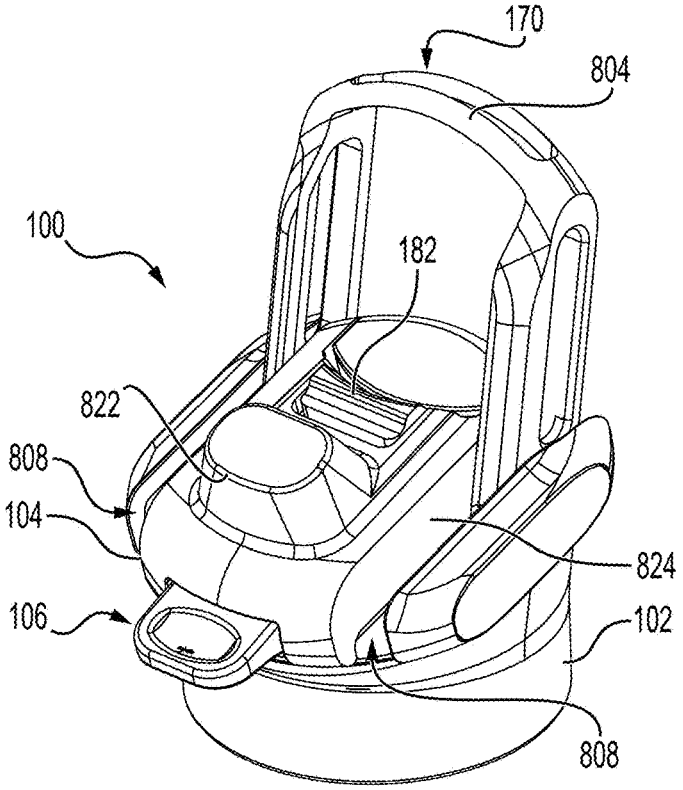

For lid 100, cap 104 closes spout 108 when retained in a closed position by fastener 112, as shown in FIGS. 8C and 8F. Also, cap 104 opens spout 108 when pressing fastener button 114 overcomes the applied force of the fastener spring and moves fastener lever 116, releasing cap 104 from the closed position, such as shown in FIGS. 8D and 8E.

Integration unit 106 further includes a vent 120 separate from spout 108 and including a vent duct 122 passing through the continuous material in common and allowing air exchange through lid 100 via vent duct 122. Cap 104 closes spout 108 and vent 120 when retained in the closed position by fastener 112. Also, cap 104 opens spout 108 and vent 120 when pressing fastener button 114 overcomes the applied force of the fastener spring and moves fastener lever 116, releasing cap 104 from the closed position.

Notably, respective portions of the continuous material that form spout 108 and fastener 112 lack material interfaces within the continuous material between spout 108, fastener 112, fastener button 114, fastener lever 116, and the fastener spring. As the term is used herein, in addition to the description given above, an integration unit is considered to be unitary, that is, not divided nor discontinuous. By way of example, integration unit 106 may be manufactured in a single molding process containing all of the continuous material in common sufficient to form the components included therewith. Other manufacturing processes are conceivable, such as subtractive manufacturing to remove portions from a block of the continuous material, etc. Silicone may be a suitable continuous material for many implementations with a hardness, such as a Shore A durometer value, sufficient to yield the physical and mechanical properties described herein. For example, the Shore A value may be from 40 to 60, but other values are conceivable.

In other implementations, integration unit 106 formed of a continuous material in common could conceivably have material interfaces between components. For example, if components are formed of the continuous material, though at different times, then material interfaces could exist. Also, in additive manufacturing, such as 3-D printing and other methods, some techniques may leave macroscopic interfaces between successively formed layers of a continuous material in common unless measures are taken to reduce or eliminate such interfaces. Likewise, if components containing the continuous material are welded together in some manner without adding different material, then material interfaces would likely exist. Components joined using a different interface material, such as adhesive, would not include a "continuous" material in common among components.

Integration unit 106 may be associated with an additional component (not shown) that is not formed of the continuous material in common amongst integration unit components. The additional component could impart additional mechanical properties to the integration unit. For example, integration unit 106 could be co-molded with an internal feature that stiffens the flexion of fastener button 114 at fastener tab 126 instead of using a stiffer continuous material. Despite the presence of the internal feature, integration unit 106 may nonetheless be formed of a continuous material in common amongst spout 108, fastener 112, fastener button 114, fastener lever 116, and the fastener spring.

In lid 100, the resilience of the continuous material that forms vent 120 provides a cap spring integrally. Accordingly, the cap spring is not labeled with a reference numeral separately from vent 120. In other examples, the cap spring conceivably could be provided separately, but a benefit exists with providing the cap spring integrally, as described above in the discussion of benefits associated with integration units. The cap spring applies a force to cap 104 when cap 104 is retained in the closed position of FIGS. 8C and 8F. The cap spring rotates cap 104 when cap 104 is released from the closed position, opening spout 108 and vent 120.

To facilitate the ease of opening and closing cap 104, fastener 112 includes a tab 126 and cap 104 includes a slot 124. Fastener tab 126 engages cap slot 124 when cap 104 is in the closed position. Fastener tab 126 retains cap 104 in the closed position by the force of the fastener spring applied to fastener lever 116.

Lid 100 provides a hinge mechanism that is not completely described herein. A few of its various components appear in the FIGURES, but are not individually numbered and are instead noted generically as hinge mechanism components 192. The hinge mechanism may use a known configuration and provides for the opening and closing of cap 104.

Similarly, lid 100 provides a lock mechanism that is not completely described herein. A few of its various components appear in the FIGURES, but are not individually numbered and are instead noted generically as lock mechanism components 182. The lock mechanism may use a known configuration and provides for retaining cap 104 in the closed position in a manner that reduces the likelihood of opening cap 104 by unintentionally pressing fastener button 114.

Integration unit 106 further includes a spout rim 128 and a vent rim 132. Spout rim 128 circumscribes a top inlet 130 into spout conduit 110 and is formed of the continuous material in common. Vent rim 132 circumscribes a top inlet 134 into vent duct 122 and is also formed of the continuous material in common. Spout rim 128 and/or vent rim 132 could conceivably be formed of a material different from the continuous material.

Additionally, cap 104 includes an interior seal surface 136 that contacts spout rim 128 and vent rim 132 when cap 104 approaches the closed position. Interior seal surface 136 closes spout 108 and vent 120 when cap 104 is retained in the closed position by fastener 112. Interior seal surface 136 may simply press on spout rim 128 and vent rim 132 to accomplish sealing. Alternatively, when vent 120 is taller, interior seal surface 136 may bend vent 120 over such that vent rim 132 compresses and folds, with opposing sides of vent rim 132 touching and accomplishing the seal.

Body 102 includes a body conduit 138 passing through body 102, as shown in FIGS. 1C, 8A, and 8B. Spout conduit 110 aligns with body conduit 138 when integration unit 106 is engaged with body 102, allowing dispensing through lid 100 via both body conduit 138 and spout conduit 110. Also, vent duct 122 aligns with body conduit 138 when integration unit 106 is engaged with body 102, allowing air exchange through lid 100 via both body conduit 138 and vent duct 122.

With vent duct 122 and spout conduit 110 sharing body conduit 138, the continuous material of integration unit 106 forms an outside surface of the lid 140 and an opposing inside surface of the lid 142. Lid inside surface 142 faces inside the container when lid 100 is attached to the container. Lid inside surface 142 is other than a surface of vent duct 122 and other than a surface of spout conduit 110.

Vent duct 122 is placed through lid inside surface 142. Such placement permits entry of air into the container through integration unit 106 when withdrawing contents from the container through a straw (not shown) engaged with spout conduit 110. As an alternative, contents of the container may be withdrawn through spout conduit 110 by tilting the container to drink instead of reliance on a straw (see FIGS. 2D-2F and corresponding discussion herein).

Integration unit 106 further includes a gasket 152 with a concave profile 150. Gasket 152 is formed of the continuous material in common. Integration unit 106 may lack material interfaces within the continuous material between gasket 152 and other components. Body conduit 138 has a gasket seat 154 complementary to concave profile 150 of gasket 152 and circumscribing body conduit 138. Gasket 152 seals with gasket seat 154 when integration unit 106 is engaged with body 102, thus aligning spout conduit 110 and vent duct 122 with body conduit 138. Although integration unit 106 includes gasket 152 with a concave profile 150, other sealing associations are conceivable between integration unit 106 and body 102, such as known sealing associations.

Lid 100 includes an integration of spout 108 and fastener 112. The integration is shown in FIGS. 8A-8F combined with gasket 152 with concave profile 150 and combined with a selectively extendable and retractable carrying mechanism (discussed below). Even so, such integration is contemplated for use independently with other dispensing lids instead of that appearing in FIGS. 8A-8F. More specifically, the integration of a spout and a fastener may be used in combination with other dispensing lids herein, as well as other dispensing lids not disclosed herein.

In the example of lid 100, integration unit 106 extends through body conduit 138 when engaged with body 102. As stated, the continuous material of integration unit 106 forms lid inside surface 142. Consequently, lid inside surface 142 faces inside the container as exposed through body conduit 138 when lid 100 is attached to the container.

Lid 100 includes the selectively extendable and retractable carrying mechanism. The carrying mechanism is shown in FIGS. 8A-8F combined with the integration of spout 108 and fastener 112 and combined with gasket 152 with concave profile 150. Even so, such carrying mechanism is contemplated for use independently with other dispensing lids instead of that appearing in FIGS. 8A-8F. More specifically, the selectively extendable and retractable carrying mechanism may be used in combination with other dispensing lids herein, as well as other dispensing lids not disclosed herein.

The carrying mechanism in FIGS. 8A-8F includes a handle 170, two arm tracks 808, and two post channels 810. Handle 170 includes two parallel arms 802, a bridge 804 connecting two arms 802 near a first end of each arm, and two posts 806, each projecting from a respective one of two arms 802 near a second end of its respective arm. Arm tracks 808 are formed into body 102 and two arms 802 slide through arm tracks 808 when extending and retracting handle 170. Post channels 810 are inside arm tracks 808 and posts 806 slide through post channels 810 when extending and retracting handle 170.

FIGS. 8A and 8B show posts 806 as laterally elongated columns with opposing flat sides and rounded ends. The width of posts 806 at the flat sides is complementary to the width of post channels 810. Posts 806 may be formed in other shapes, such as a circular column, etc., though the shape shown in FIGS. 8A and 8B provides unique benefits further described below.

While a variety of additional features are contemplated for the carrying mechanism, the example of dispensing lid 100 herein is shown to include the following additional features. Other features or different combinations of the features than shown are contemplated for the carrying mechanism. Two posts 806 each project from an outward facing surface 812 of its respective arm 802. Two post channels 810 are each formed in an inward facing surface 814 of a respective one of two arm tracks 808. Inward facing surfaces 814 oppose outward facing surfaces 812 with handle 170 retracted. As the term is used herein, "outward facing" refers to facing outward in a direction oriented from the center of body 102 toward the perimeter of body 102. As the term is used herein, "inward facing" refers to facing inward in a direction oriented from the perimeter of body 102 toward the center of body 102.

Handle 170 is selectively rotatable about posts 806, such as shown in FIG. 8F, upon fully extending handle 170 so that posts 806 reach two respective ends 816 of post channels 810. Handle 170 is not selective rotatable unless fully extended. This feature is enabled by the complementary size of post channels 810 and flat-sided posts 806. Since posts 806 are elongated and sized complementary to post channels 810, they cannot rotate within post channels 810 until extended to reach channel ends 816. Channel ends 816 are shaped and sized complementary to the rotational profile of posts 806. Accordingly, in dispensing lid 100, channel ends 816 are circular, receiving the rotational profile of posts 806.

Additionally, posts 806 near the second end of their respective arm 802 are offset from the second end such that a tip 818 of each arm 802 projects past its respective post 806. Two tip recesses 820 are formed in body 102 proximate the respective ends of post channels 810. Upon fully extending and then rotating handle 170, tip recesses 820 receive arm tips 818 as handle 170 rotates in the manner shown in FIG. 8F. Arm tips 818 additionally restrict handle 170 from rotating except when fully extended. This feature is enabled by the distance that arm tips 818 project that exceeds the distance between post channels 810 and a bottom of arm tracks 808.

With cap 104 in the closed position, as shown in FIGS. 8C and 8F, each of two opposing side walls 824 of cap 104 define part of a respective one of two arm tracks 808 shown in FIG. 8F. With handle 170 retracted, as shown in FIG. 8C, each of arms 802 is between a respective one of two side walls 824 of cap 104 and a respective one of two post channels 810.

With cap 104 in a fully open position and handle 170 fully extended, as shown in FIG. 8E, a top 822 of cap 104 rests between arms 802 and engages bridge 804 when inverting lid 100. Such engagement restricts rotation of cap 104. In such manner, a user may avoid cap 104 rotating toward the closed position into contact with the user's face when inverting the dispensing container to drink from the spout. Notably, pivot points for handle 170 and cap 104 are not aligned. Also, cap top 822 has a radius of motion when cap 104 rotates that differs from a radius of motion for bridge 804 when handle 170 rotates. Accordingly, with the offset pivot points and different radii of motion, cap top 822 engages bridge 804 and restricts rotation of cap 104.

The configuration shown also permits simple removal of handle 170 from lid 100. With handle 170 retracted and cap 104 in an open position, as shown in FIG. 8D, cap side walls 824 are moved away from arm tracks 808. Handle 170 may be removed from body 102 by flexing arm tips 818 toward each other and disengaging posts 806 from post channels 810. With posts 806 disengaged from post channels 810, arm tips 818 may be lifted from arm tracks 808 and separated from body 102.

Lid 100 includes gasket 152 with concave profile 150. The gasket is shown in FIGS. 8A-8F combined with the integration of spout 108 and fastener 112 and combined with the selectively extendable and retractable carrying mechanism. Even so, such gasket is contemplated for use independently with other dispensing lids instead of that appearing in FIGS. 8A-8F. More specifically, a gasket with a concave profile may be used in combination with other dispensing lids herein, as well as other dispensing lids not disclosed herein.

In further discussion of gasket 152, concave profile 150 includes an upper sloped surface 172, a lower sloped surface 174, and a neck 176 joining upper sloped surface 172 and lower sloped surface 174. Upper 172 and lower 174 sloped surfaces decrease in diameter toward neck 176 and spout conduit 110 passes within neck 176. Body 102 includes body conduit 138 passing through body 102 and body conduit 138 has gasket seat 154 complementary to concave profile 150 of gasket 152 and circumscribing body conduit 138. Gasket 152 seals with gasket seat 154 when integration unit 106 is engaged with body 102, thus aligning spout conduit 110 with body conduit 138. A variety of structures are possible for gasket seat 154. In the example of dispensing lid 100, gasket seat 154 is formed on an extension wall 164 of body 102.

Spout conduit 110 and vent duct 122 are aligned with body conduit 138. Gasket 152 seals with gasket seat 154 circumscribing body conduit 138. It follows that spout conduit 110 and vent duct 122 pass within neck 176 of gasket 152. FIGS. 1A-1C show that gasket 152 laterally surrounds at least a portion of spout conduit 110 and vent duct 122. Integration unit 106 includes a bottom inlet 166 into spout conduit 110 and a bottom inlet 168 into vent duct 122. Gasket 152, as defined by the portion of integration unit 106 that seals with body 102, laterally surrounds vent bottom inlet 168. Gasket 152 does not laterally surround spout bottom inlet 166 since it is positioned below gasket 152.

Spout conduit 110 includes a shoulder 194 therein to function as a stop for insertion of a straw (not shown) to engage with spout conduit 110. A straw would extend a pathway for withdrawal of liquid from the container (not shown) toward a bottom of the container. Gasket 152 laterally surrounds shoulder 194.

In the example of dispensing lid 100, neck 176 includes a first pair of parallel sides and a second pair of parallel sides and the first pair is rectangular to the second pair. The first and second pairs of parallel sides of the neck meet at four rounded corners. Upper 172 and lower 174 sloped surfaces are correspondingly shaped. A variety of shapes are conceivable for concave profile 150, including the general vee-shape formed on the parallel sides connected by rounded corners of gasket 152 of integration unit 106. Concave profile 150 may instead have various cross-sectional shapes, such as a "U" shape, semicircular shape, etc.

In dispensing lid 100, neck 176 of gasket 152 is in tension when integration unit 106 is engaged with body 102, thus pulling upper 172 and lower 174 sloped surfaces into contact with gasket seat 154. The smallest diameter of upper 172 and lower 174 sloped surfaces occurs at neck 176. Neck 176 includes a fillet 178 between upper 172 and lower 174 sloped surfaces. A "fillet" is a concavely curved section at the angle formed by the junction of two surfaces, that is, a rounded inside corner. An alternative to fillet 178 could be a vertex (not shown) wherein concave profile 150 comes to a point, as in the point of a triangle. However, by avoiding sharp corners, fillet 178 and the complementary shape of gasket seat 152 create a sealing surface that more readily engages and seals in comparison to a vertex. Also, a vertex could be more susceptible to tearing stresses in comparison to a fillet when removing and replacing integration unit 106.

Upper 172 and lower 174 sloped surfaces continuously decrease in diameter toward neck 176 across any portion thereof that contacts gasket seat 154 when integration unit 106 is engaged with body 102. In the example shown, the continuous decrease in diameter toward neck 176 is linear. As an alternative, the continuous decrease in diameter could be non-linear, such as being curved in some fashion or even stepped or undulating.

Figure 1D:
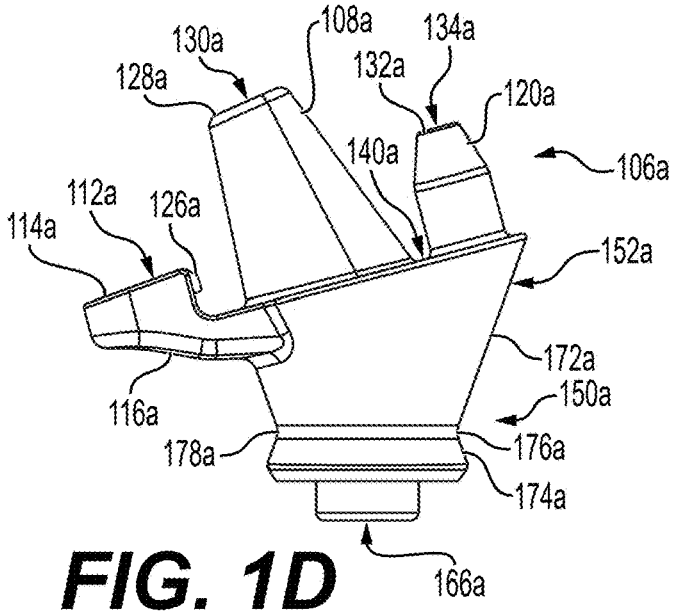
FIGS. 1D-1F are respective side, top, and sectional views of an integration unit alternative to the integration unit of FIGS. 1A-1C.
Figure 1E:
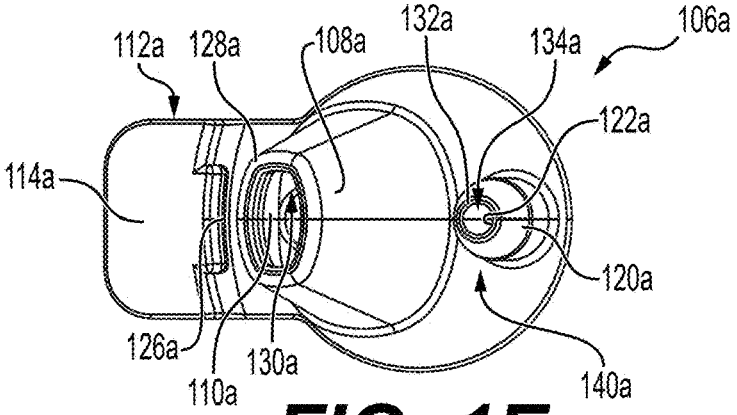
Figure 1F:
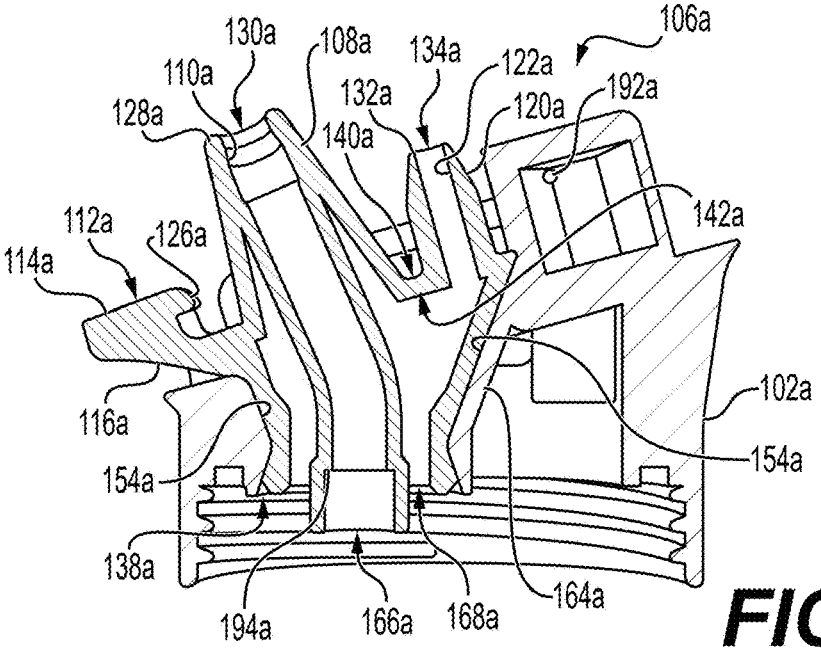

As another example shown in FIGS. 1D-1F, upper 172 and lower 174 sloped surfaces may be conical, meaning resembling a cone or having the shape of a cone. A cone is a three-dimensional geometric shape that tapers smoothly from a flat base to a point called the apex. The flat base is frequently, though not necessarily, circular. When the flat base is circular, the shape is called a "circular cone." When the axis of the cone passes through the center of the base at right angles to its plane, the shape is called a "right cone." A "right, circular cone" includes both specifications.

The reference numerals appearing in FIGS. 1D-1F align with the reference numerals appearing in FIGS. 1A-1C for corresponding structures in the two alternatives. However, reference numerals in FIGS. 1D-1F include an "a" suffix denoting the alternative example. Consequently, in the example of FIGS. 1D-1F, upper sloped surface 172*a* corresponds to a portion of the shape of a first right, circular cone and lower sloped surface 174*a* corresponds to a portion of the shape of a second right, circular cone. The first cone and the second cone may have the same apex angle. That is, for concave profiles where the continuous decrease in diameter toward neck 176*a* is linear, upper 172*a* and lower 174*a* sloped surfaces of concave profile 150*a* have the same absolute value of slope (rise over run). Alternatively, the first cone and the second cone may have different apex angles.

Among the alternatives for concave profile 150 or 150*a*, upper sloped surface 172 or 172*a* and lower sloped surface 174 or 174*a* may have the same height. Such is shown for gasket 152. Alternatively, upper sloped surface 172 or 172*a* may have a greater height than lower sloped surface 174 or 174*a*. Such is shown for gasket 152*a*. The smaller height of lower sloped surface 174*a* increases the ease of inserting gasket 152*a* into body conduit 138*a*, while the greater height of upper sloped surface 172*a* increases the sealing surfacing area and resistance to leakage. Accordingly, the combination of the two different heights may permit easier insertion while still sealing adequately. This benefit results because the smaller height of lower sloped surface 174*a* corresponds to less difference between the diameter of neck 176*a* and the diameter of body conduit 138*a* where aligned with neck 176*a*. Thus, less difference between the two diameters results in easier insertion.

Comparing integration unit 106 in FIGS. 1A-1C with integration unit 106*a* in FIGS. 1D-1F it will be appreciated that the two integration units include the same components arranged in a very similar manner with respect to one another. However, while gasket 152 has a generally rectangular profile shown in FIG. 1B, gasket 152*a* has a generally circular profile shown in FIG. 1E. FIG. 8A correspondingly shows a generally rectangular profile for gasket seat 154. As an alternative (not shown), gasket seat 154 may instead have a generally round profile complementary to the generally round profile of gasket 152*a*.

Second Example Dispensing Lid

Figure 2A:
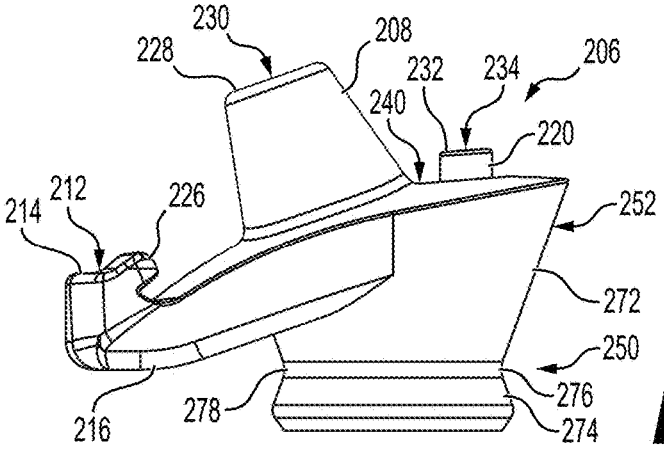
FIG. 2A-2C are respective side, top, and sectional views of an integration unit for a second example dispensing lid shown in FIGS. 9A-9D and described herein.
Figure 2B:
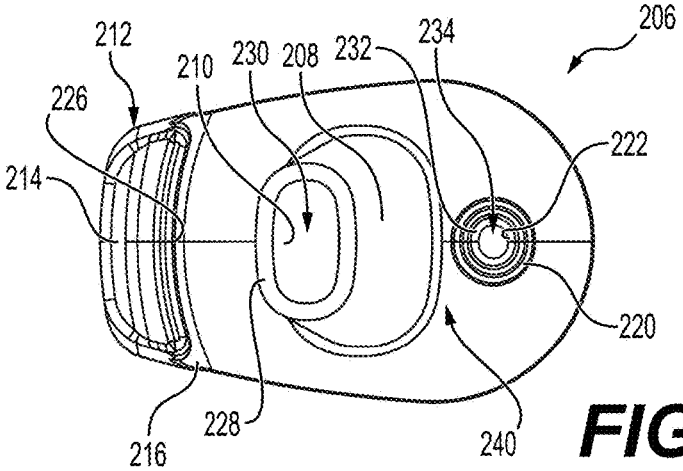
Figure 2C:
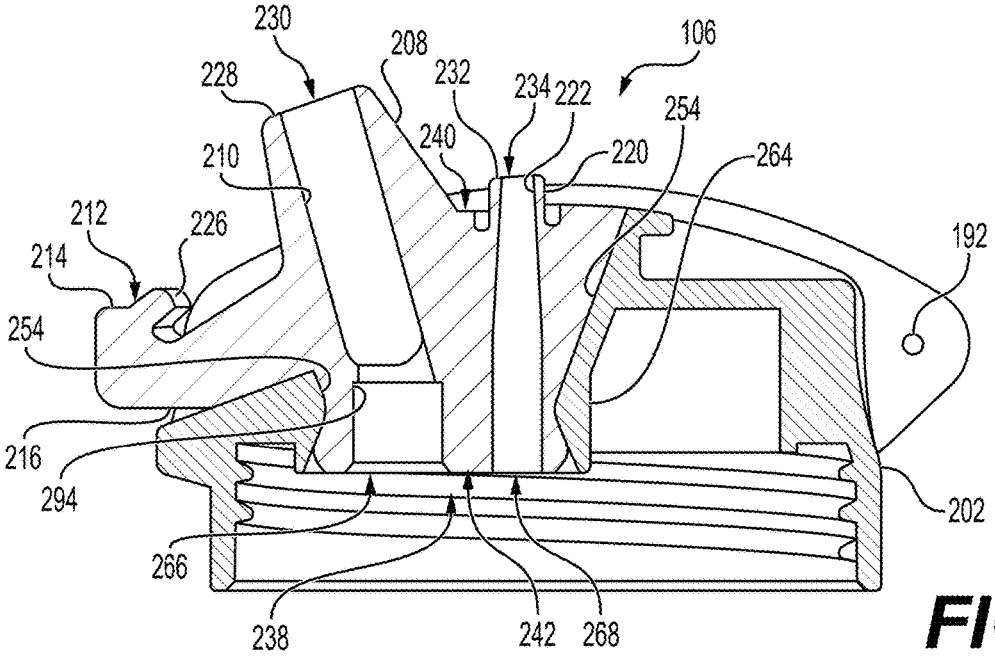

FIGS. 2A-2C are respective side, top, and sectional views of an integration unit 206. Integration unit 206 is included as part of a dispensing lid 200 shown in FIGS. 9A-9D. Dispensing lid 200 is designed for use with a container (not shown) that may contain liquids. Dispensing lid 200 may be selectively engageable with and disengageable from the container, such as by a threaded connection or other known type of connection. Alternatively, dispensing lid 200 may be permanently affixed to the container. As will be appreciated from the discussion herein, dispensing lid 200 increases the simplicity of function and assembly. Also, dispensing lid 200 provides a gasket in tension that increases the sealing ability. Further, dispensing lid 200 reduces the risk of a drink spout unintentionally disengaging from a body by top-mounting the drink spout.

Lid 200 includes a body 202, a cap 204 in rotatable engagement with body 202, and integration unit 206 selectively engageable with and disengageable from body 202. Integration unit 206 is formed of a continuous material in common amongst integration unit 206 components, which include a spout 208 and a fastener 212. Spout 208 has a spout conduit 210 passing through the continuous material in common and allowing dispensing through lid 200 via spout conduit 210.

Fastener 212 is formed of the continuous material in common and has a fastener button 214, a fastener lever 216, and a fastener spring. Fastener lever 216 connects fastener button 214 to integration unit 206 and the fastener spring applies a force to fastener lever 216 when pressing fastener button 214.

In the example shown for integration unit 206, the continuous material is resilient and the resilience of the continuous material that forms fastener lever 216 provides the fastener spring integrally. Accordingly, the fastener spring is not labeled with a reference numeral separately from fastener lever 216. In other examples, the fastener spring conceivably could be provided separately, but a benefit exists with providing the fastener spring integrally, as described above in the discussion of benefits associated with integration units.

Figure 9A:
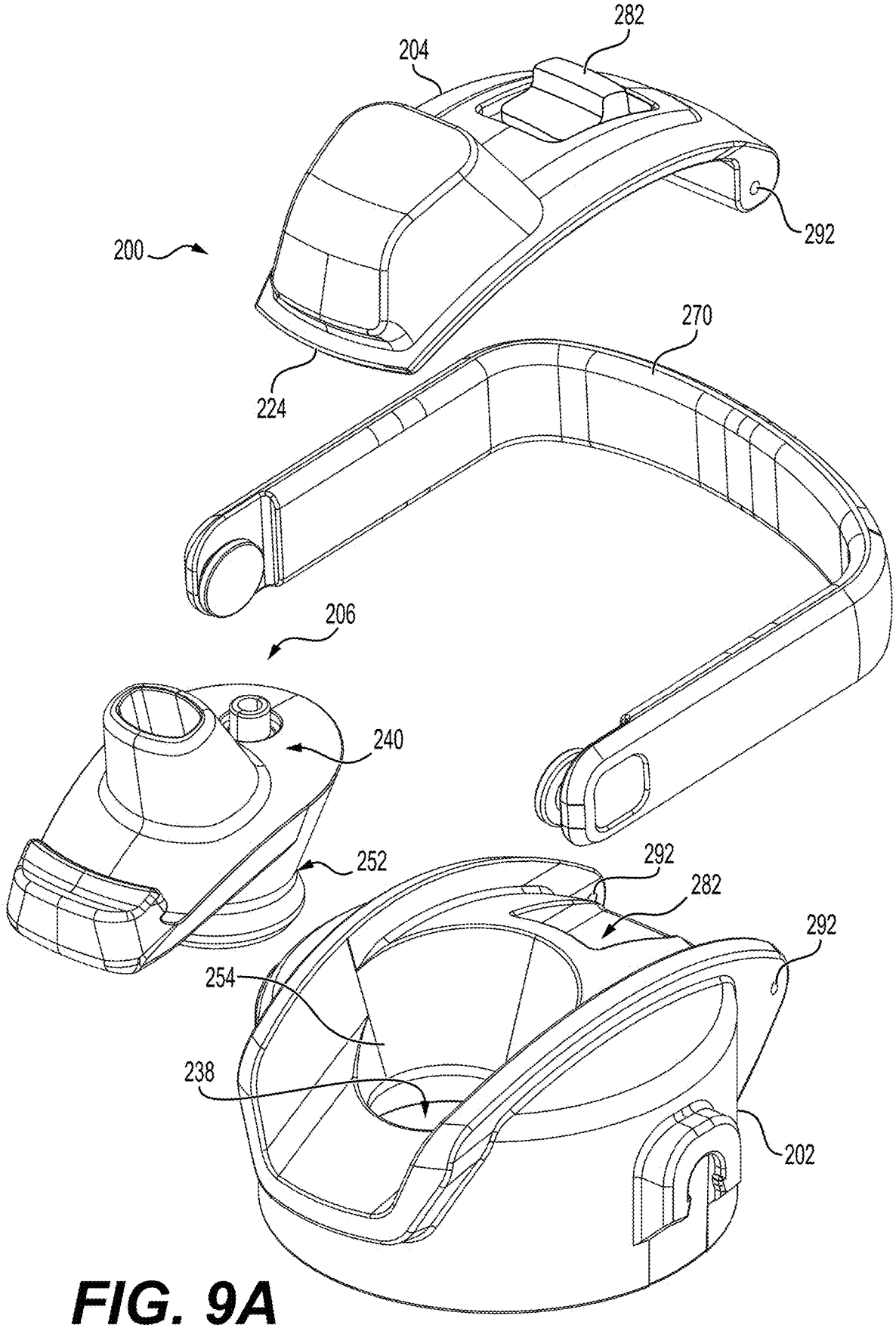
FIGS. 9A and 9B are exploded isometric views of the second example dispensing lid.
Figure 9B:
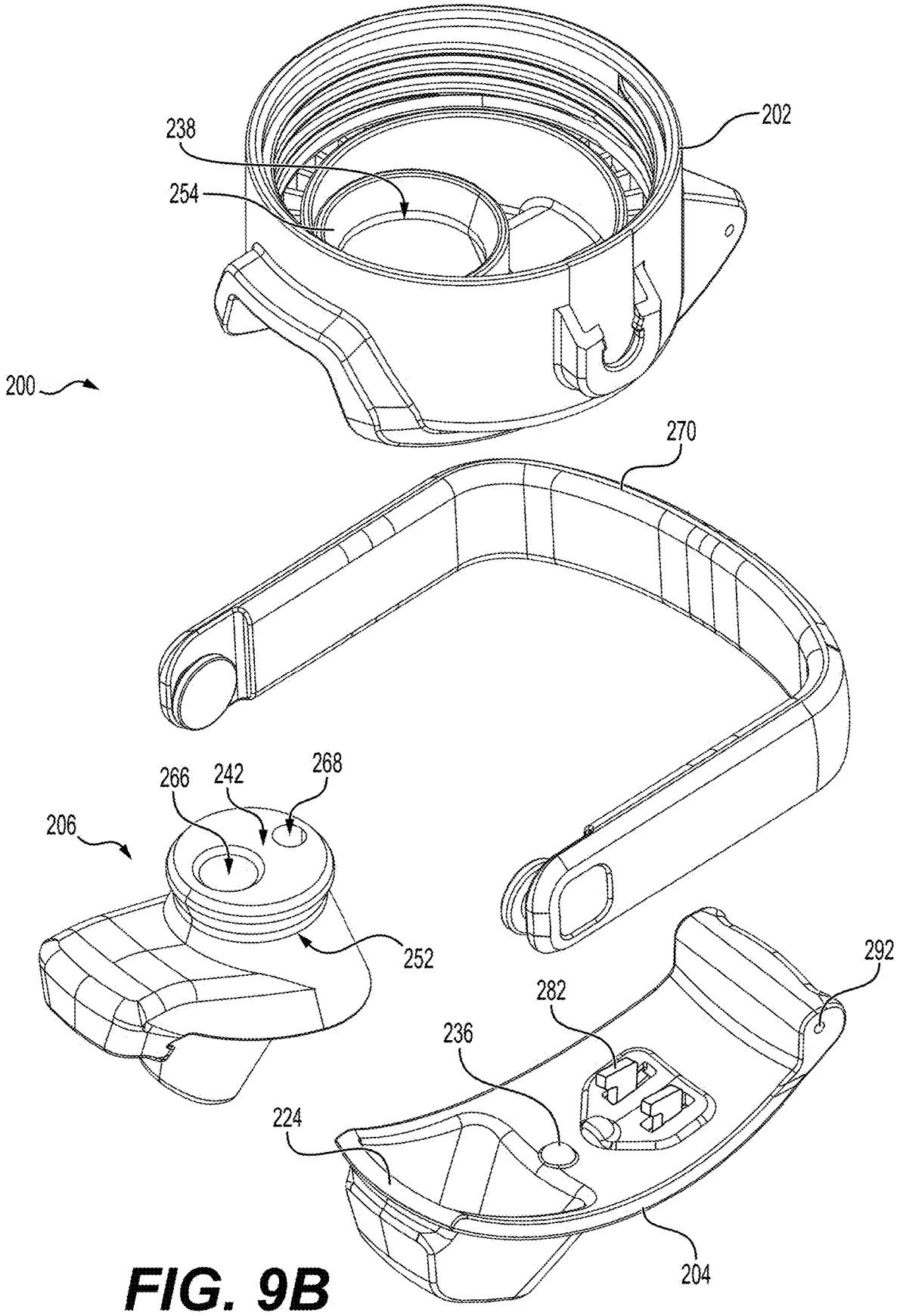
Figure 9C:
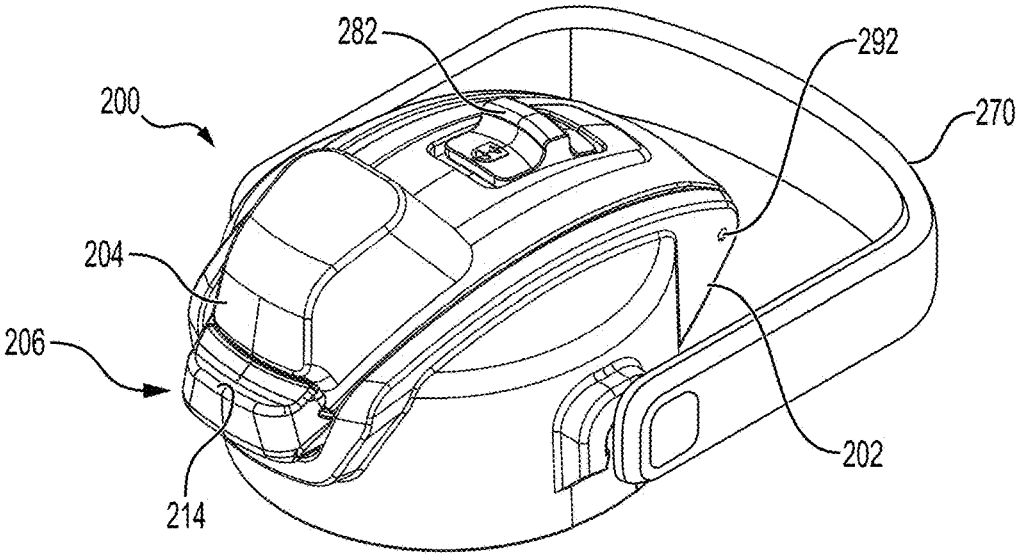
FIGS. 9C and 9D are isometric views of the second example dispensing lid with the cap in varied positions.
Figure 9D:
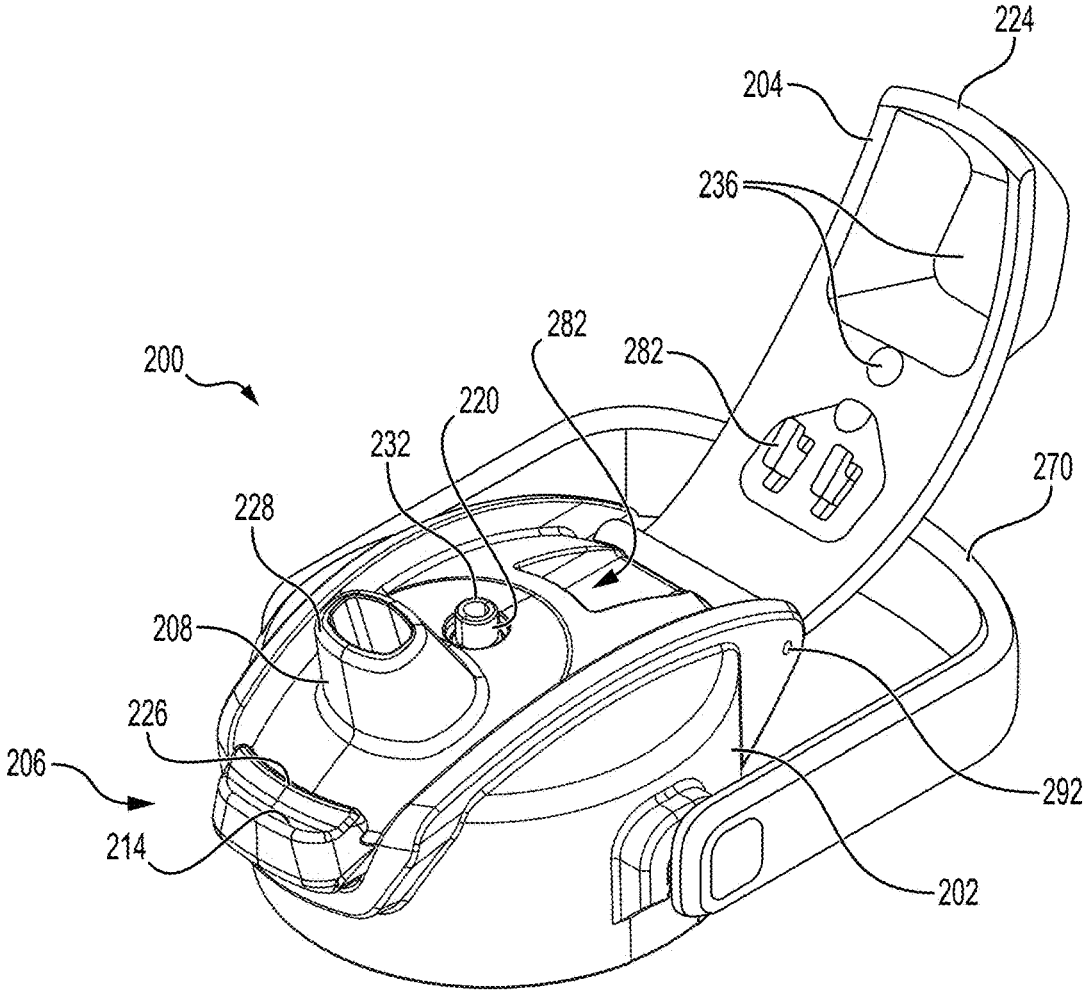

For lid 200, cap 204 closes spout 208 when retained in a closed position by fastener 212, as shown in FIG. 9C. Also, cap 204 opens spout 208 when pressing fastener button 214 overcomes the applied force of the fastener spring and moves fastener lever 216, releasing cap 204 from the closed position, such as shown in FIG. 9D.

Integration unit 206 further includes a vent 220 separate from spout 208 and including a vent duct 222 passing through the continuous material in common and allowing air exchange through lid 200 via vent duct 222. Cap 204 closes spout 208 and vent 220 when retained in the closed position by fastener 212. Also, cap 204 opens spout 208 and vent 220 when pressing fastener button 214 overcomes the applied force of the fastener spring and moves fastener lever 216, releasing cap 204 from the closed position.

Notably, respective portions of the continuous material that form spout 208 and fastener 212 lack material interfaces within the continuous material between spout 208, fastener 212, fastener button 214, fastener lever 216, and the fastener spring. As the term is used herein, in addition to the description given above, an integration unit is considered to be unitary, that is, not divided nor discontinuous. By way of example, integration unit 206 may be manufactured in a single molding process containing all of the continuous material in common sufficient to form the components included therewith. Other manufacturing processes are conceivable, such as subtractive manufacturing to remove portions from a block of the continuous material, etc. Silicone may be a suitable continuous material for many implementations with a hardness, such as a Shore A durometer value, sufficient to yield the physical and mechanical properties described herein. For example, the Shore A value may be from 40 to 60, but other values are conceivable.

In other implementations, integration unit 206 formed of a continuous material in common could conceivably have material interfaces between components. For example, if components are formed of the continuous material, though at different times, then material interfaces could exist. Also, in additive manufacturing, such as 3-D printing and other methods, some techniques may leave macroscopic interfaces between successively formed layers of a continuous material in common unless measures are taken to reduce or eliminate such interfaces. Likewise, if components containing the continuous material are welded together in some manner without adding different material, then material interfaces would likely exist. Components joined using a different interface material, such as adhesive, would not include a "continuous" material in common among components.

Integration unit 206 may be associated with an additional component (not shown) that is not formed of the continuous material in common amongst integration unit components. The additional component could impart additional mechanical properties to the integration unit. For example, integration unit 206 could be co-molded with an internal feature that stiffens the flexion of fastener button 214 at fastener tab 226 instead of using a stiffer continuous material. Despite the presence of the internal feature, integration unit 206 may nonetheless be formed of a continuous material in common amongst spout 208, fastener 212, fastener button 214, fastener lever 216, and the fastener spring.

In lid 200, the resilience of the continuous material that forms vent 220 provides a cap spring integrally. Accordingly, the cap spring is not labeled with a reference numeral separately from vent 220. In other examples, the cap spring conceivably could be provided separately, but a benefit exists with providing the cap spring integrally, as described above in the discussion of benefits associated with integration units. The cap spring applies a force to cap 204 when cap 204 is retained in the closed position of FIG. 9C. The cap spring rotates cap 204 when cap 204 is released from the closed position, opening spout 208 and vent 220.

To facilitate the ease of opening and closing cap 204, fastener 212 includes a tab 226 and cap 204 includes a lip 224. Fastener tab 226 engages cap lip 224 when cap 204 is in the closed position. Fastener tab 226 retains cap 204 in the closed position by the force of the fastener spring applied to fastener lever 216.

Lid 200 provides a hinge mechanism that is not completely described herein. A few of its various components appear in the FIGURES, but are not individually numbered and are instead noted generically as hinge mechanism components 292. The hinge mechanism may use a known configuration and provides for the opening and closing of cap 204.

Similarly, lid 200 provides a lock mechanism that is not completely described herein. A few of its various components appear in the FIGURES, but are not individually numbered and are instead noted generically as lock mechanism components 282. The lock mechanism may use a known configuration and provides for retaining cap 204 in the closed position in a manner that reduces the likelihood of opening cap 204 by unintentionally pressing fastener button 214.

Integration unit 206 further includes a spout rim 228 and a vent rim 232. Spout rim 228 circumscribes a top inlet 230 into spout conduit 210 and is formed of the continuous material in common. Vent rim 232 circumscribes a top inlet 234 into vent duct 222 and is also formed of the continuous material in common. Spout rim 228 and/or vent rim 232 could conceivably be formed of a material different from the continuous material.

Additionally, cap 204 includes an interior seal surface 236 that contacts spout rim 228 and vent rim 232 when cap 204 approaches the closed position. Interior seal surface 236 closes spout 208 and vent 220 when cap 204 is retained in the closed position by fastener 212. Interior seal surface 236 may simply press on spout rim 228 and vent rim 232 to accomplish sealing. Alternatively, when vent 220 is taller, interior seal surface 236 may bend vent 220 over such that vent rim 232 compresses and folds, with opposing sides of vent rim 232 touching and accomplishing the seal.

Body 202 includes a body conduit 238 passing through body 202, as shown in FIGS. 2C, 9A, and 9B. Spout conduit 210 aligns with body conduit 238 when integration unit 206 is engaged with body 202, allowing dispensing through lid 200 via both body conduit 238 and spout conduit 210. Also, vent duct 222 aligns with body conduit 238 when integration unit 206 is engaged with body 202, allowing air exchange through lid 200 via both body conduit 238 and vent duct 222.

With vent duct 222 and spout conduit 210 sharing body conduit 238, the continuous material of integration unit 206 forms an outside surface of the lid 240 and an opposing inside surface of the lid 242. Lid inside surface 242 faces inside the container when lid 200 is attached to the container. Lid inside surface 242 is other than a surface of vent duct 222 and other than a surface of spout conduit 210.

Vent duct 222 is placed through lid inside surface 242. Such placement permits entry of air into the container through integration unit 206 when withdrawing contents from the container through a straw (not shown) engaged with spout conduit 210. As an alternative, contents of the container may be withdrawn through spout conduit 210 by tilting the container to drink instead of reliance on a straw (see FIGS. 2D-2F and corresponding discussion herein).

Integration unit 206 further includes a gasket 252 with a concave profile 250. Gasket 252 is formed of the continuous material in common. Integration unit 206 may lack material interfaces within the continuous material between gasket 252 and other components. Body conduit 238 has a gasket seat 254 complementary to concave profile 250 of gasket 252 and circumscribing body conduit 238. Gasket 252 seals with gasket seat 254 when integration unit 206 is engaged with body 202, thus aligning spout conduit 210 and vent duct 222 with body conduit 238. Although integration unit 206 includes gasket 252 with a concave profile 250, other sealing associations are conceivable between integration unit 206 and body 202, such as known sealing associations.

Lid 200 includes an integration of spout 208 and fastener 212. The integration is shown in FIGS. 9A-9D combined with gasket 252 with concave profile 250. Even so, such integration is contemplated for use independently with other dispensing lids instead of that appearing in FIGS. 9A-9D. More specifically, the integration of a spout and a fastener may be used in combination with other dispensing lids herein, as well as other dispensing lids not disclosed herein.

In the example of lid 200, integration unit 206 extends through body conduit 238 when engaged with body 202. As stated, the continuous material of integration unit 206 forms lid inside surface 242. Consequently, lid inside surface 242 faces inside the container as exposed through body conduit 238 when lid 200 is attached to the container.

Lid 200 may include a handle 270 that is selectively rotatable. A handle fixed in position, such as in FIGS. 4C and 10A-10D, is also conceivable. Handle 270 or some other handle may attach to the container instead of to body 202, as in FIGS. 9A-9D.

Lid 200 includes gasket 252 with concave profile 250. The gasket is shown in FIGS. 2A-2C and 9A-9D combined with the integration of spout 208 and fastener 212. Even so, such gasket is contemplated for use independently with other dispensing lids instead of that appearing in FIGS. 2A-2C and 9A-9D. More specifically, a gasket with a concave profile may be used in combination with other dispensing lids herein, as well as other dispensing lids not disclosed herein.

In further discussion of gasket 252, concave profile 250 includes an upper sloped surface 272, a lower sloped surface 274, and a neck 276 joining upper sloped surface 272 and lower sloped surface 274. Upper 272 and lower 274 sloped surfaces decrease in diameter toward neck 276 and spout conduit 210 passes within neck 276. Body 202 includes body conduit 238 passing through body 202 and body conduit 238 has gasket seat 254 complementary to concave profile 250 of gasket 252 and circumscribing body conduit 238. Gasket 252 seals with gasket seat 254 when integration unit 206 is engaged with body 202, thus aligning spout conduit 210 with body conduit 238. A variety of structures are possible for gasket seat 254. In the example of dispensing lid 200, gasket seat 254 is formed on an extension wall 264 of body 202.

Spout conduit 210 and vent duct 222 are aligned with body conduit 238. Gasket 252 seals with gasket seat 254 circumscribing body conduit 238. It follows that spout conduit 210 and vent duct 222 pass within neck 276 of gasket 252. FIGS. 2A-2C show that gasket 252 laterally surrounds at least a portion of spout conduit 210 and vent duct 222. Integration unit 206 includes a bottom inlet 266 into spout conduit 210 and a bottom inlet 268 into vent duct 222. Gasket 252, as defined by the portion of integration unit 206 that seals with body 202, does not laterally surround spout bottom inlet 266 nor vent bottom inlet 268 since they are positioned below gasket 252.

Spout conduit 210 includes a shoulder 294 therein to function as a stop for insertion of a straw (not shown) to engage with spout conduit 210. A straw would extend a pathway for withdrawal of liquid from the container (not shown) toward a bottom of the container. Gasket 252 laterally surrounds shoulder 294.

In the example of dispensing lid 200, upper 272 and lower 274 sloped surfaces are conical, meaning resembling a cone or having the shape of a cone. A cone is a three-dimensional geometric shape that tapers smoothly from a flat base to a point called the apex. The flat base is frequently, though not necessarily, circular. When the flat base is circular, the shape is called a "circular cone." When the axis of the cone passes through the center of the base at right angles to its plane, the shape is called a "right cone." A "right, circular cone" includes both specifications.

In the example of dispensing lid 200, neck 276 is circular. A variety of shapes are conceivable for concave profile 250, including the general vee-shape formed on the conical surfaces of gasket 252 of integration unit 206. Concave profile 250 may instead have various cross-sectional shapes, such as a "U" shape, semicircular shape, etc.

Consequently, in the example of dispensing lid 200, upper sloped surface 272 corresponds to a portion of the shape of a first right, circular cone and lower sloped surface 274 corresponds to a portion of the shape of a second right, circular cone. The first cone and the second cone may have the same apex angle. That is, for concave profiles where the continuous decrease in diameter toward neck 276 is linear, upper 272 and lower 274 sloped surfaces of concave profile 250 have the same absolute value of slope (rise over run). Alternatively, the first cone and the second cone may have different apex angles.

In dispensing lid 200, neck 276 of gasket 252 is in tension when integration unit 206 is engaged with body 202, thus pulling upper 272 and lower 274 sloped surfaces into contact with gasket seat 254. The smallest diameter of upper 272 and lower 274 sloped surfaces occurs at neck 276. Neck 276 includes a fillet 278 between upper 272 and lower 274 sloped surfaces. A "fillet" is a concavely curved section at the angle formed by the junction of two surfaces, that is, a rounded inside corner. An alternative to fillet 278 could be a vertex (not shown) wherein concave profile 250 comes to a point, as in the point of a triangle. However, by avoiding sharp corners, fillet 278 and the complementary shape of gasket seat 252 create a sealing surface that more readily engages and seals in comparison to a vertex. Also, a vertex could be more susceptible to tearing stresses in comparison to a fillet when removing and replacing integration unit 206.

Upper 272 and lower 274 sloped surfaces continuously decrease in diameter toward neck 276 across any portion thereof that contacts gasket seat 254 when integration unit 206 is engaged with body 202. In the example shown, the continuous decrease in diameter toward neck 276 is linear. As an alternative, the continuous decrease in diameter could be non-linear, such as being curved in some fashion or even stepped or undulating.

Among the alternatives for concave profile 250, upper sloped surface 272 and lower sloped surface 274 may have the same height. Alternatively, upper sloped surface 272 may have a greater height than lower sloped surface 274. Such is shown for gasket 252. The smaller height of lower sloped surface 274 increases the ease of inserting gasket 252 into body conduit 238, while the greater height of upper sloped surface 272 increases the sealing surfacing area and resistance to leakage. Accordingly, the combination of the two different heights may permit easier insertion while still sealing adequately. This benefit results because the smaller height of lower sloped surface 274 corresponds to less difference between the diameter of neck 276 and the diameter of body conduit 238 where aligned with neck 276. Thus, less difference between the two diameters results in easier insertion.

Figure 2D:
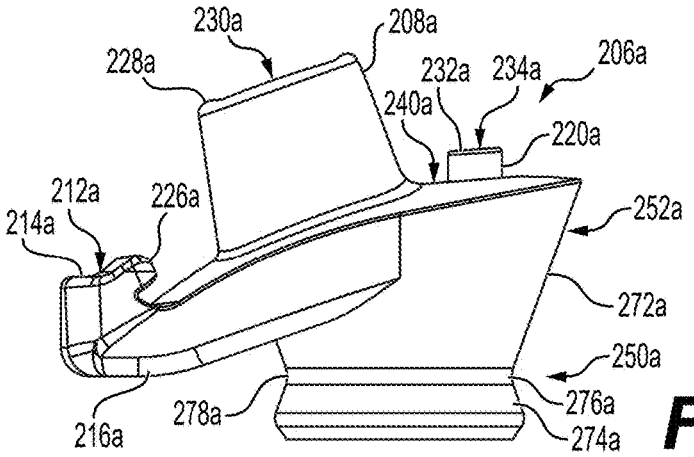
FIGS. 2D-2F are respective side, top, and sectional views of an integration unit alternative to the integration unit of FIGS. 2A-2C.
Figure 2E:
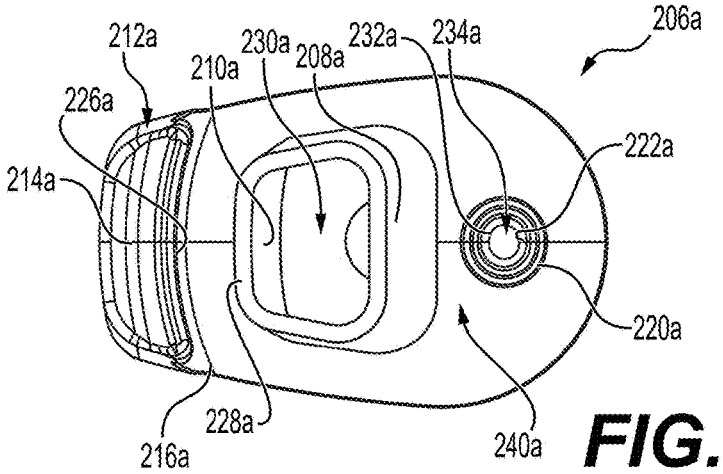
Figure 2F:
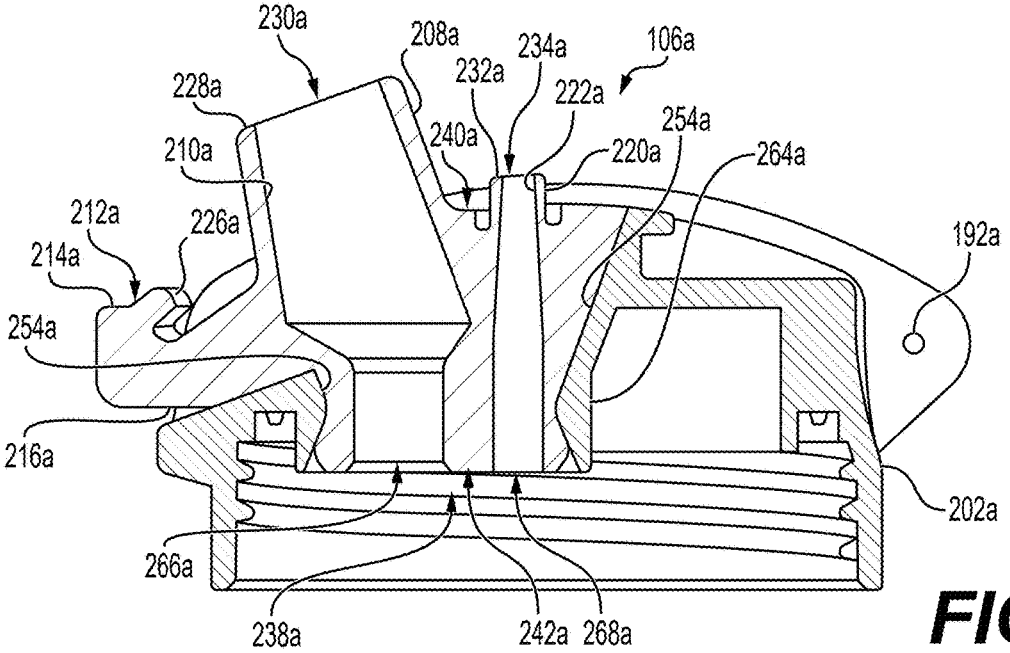

As another example shown in FIGS. 2D-2F, a different configuration of a spout and a spout conduit is shown adapted for pouring liquid. The reference numerals appearing in FIGS. 2D-2F align with the reference numerals appearing in FIGS. 2A-2C for corresponding structures in the two alternatives. However, reference numerals in FIGS. 2D-2F include an "a" suffix denoting the alternative example.

Comparing integration unit 206 in FIGS. 2A-2C with integration unit 206*a* in FIGS. 2D-2F it will be appreciated that the two integration units include the same components arranged in a very similar manner with respect to one another. However, while spout conduit 210 and spout top inlet 230 are somewhat narrow and include a shoulder 294 to engage a straw, spout conduit 210*a* and spout top inlet 230*a* are comparatively wider and do not provide a shoulder. Accordingly, integration unit 206*a* is configured with a "chug" spout as opposed to a "sip" spout in the case of integration unit 206. In general, any of the spouts configured herein as a sip spout may instead be configured as a chug spout noting the differences between integration units 206 and 206*a* that enable such a use.

Third Example Dispensing Lid

Figure 3A:
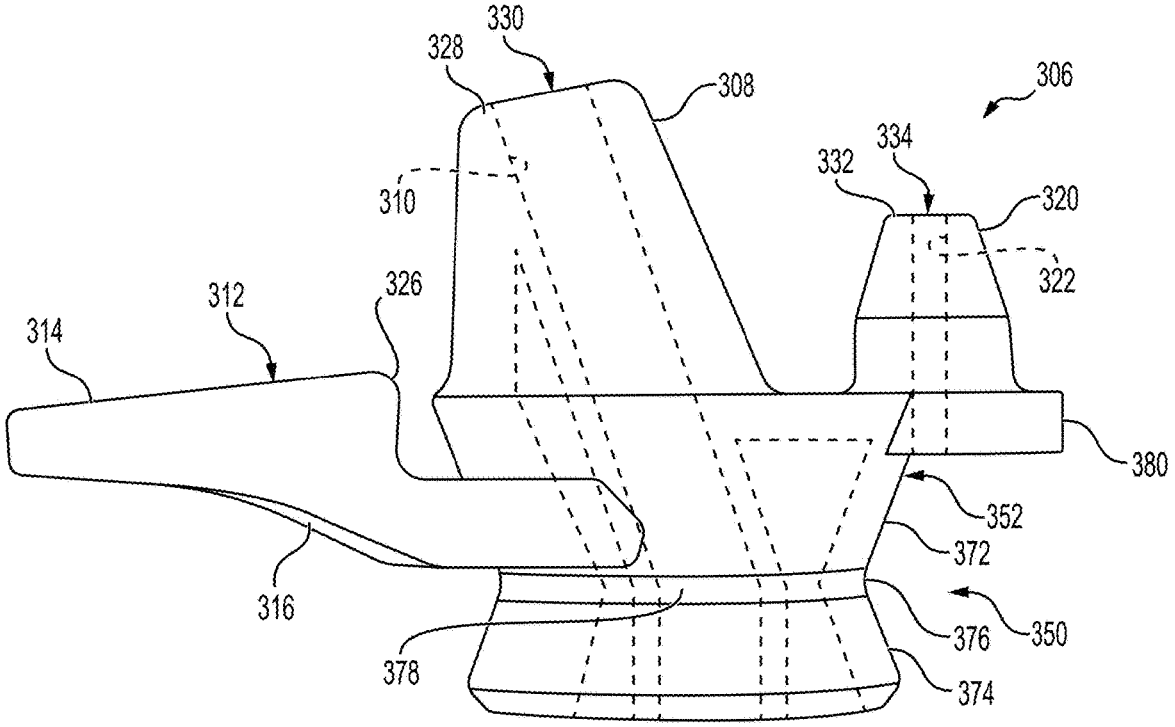
FIGS. 3A and 3B are respective side and top views of an integration unit for a third example dispensing lid described herein.
Figure 3B:
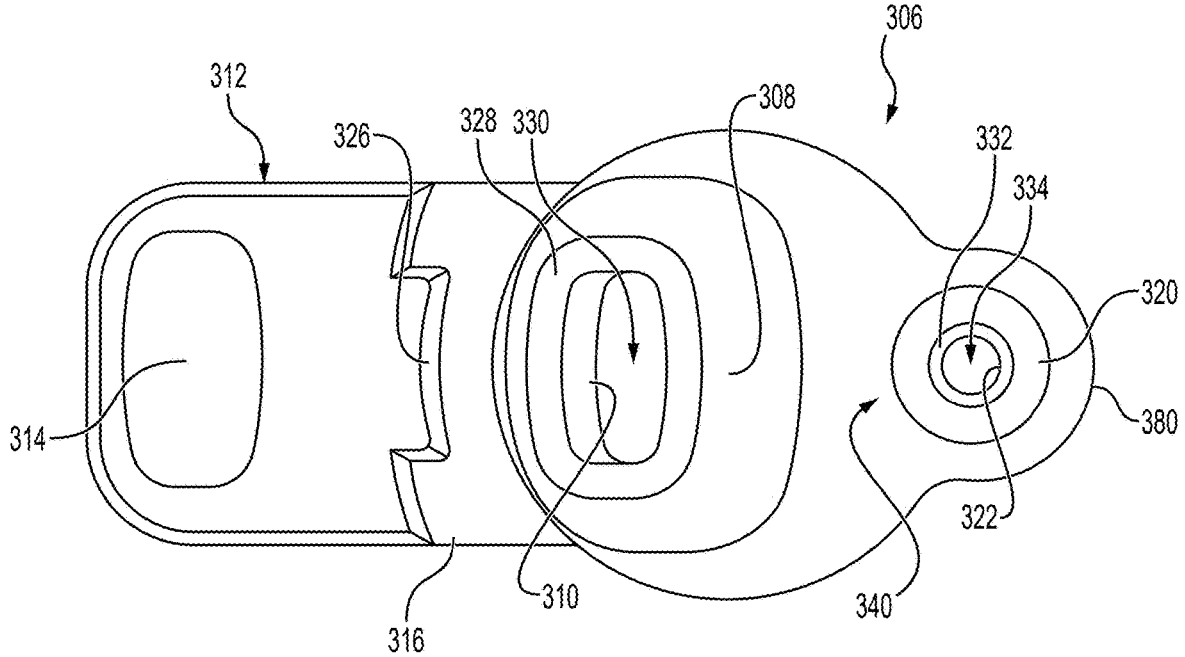

FIGS. 3A and 3B are respective side and top views of an integration unit 306. Integration unit 306 may be included as part of one or more of the dispensing lids described herein or other dispensing lids not disclosed herein. As will be appreciated from the discussion herein, integration unit 306 increases the simplicity of function and assembly. Also, integration unit 306 provides a gasket in tension that increases the sealing ability.

Integration unit 306 is selectively engageable with and disengageable from a body of a dispensing lid. Integration unit 306 is formed of a continuous material in common amongst integration unit 306 components, which include a spout 308 and a fastener 312. Spout 308 has a spout conduit 310 passing through the continuous material in common and allowing dispensing through the lid via spout conduit 310.

Fastener 312 is formed of the continuous material in common and has a fastener button 314, a fastener lever 316, and a fastener spring. Fastener lever 316 connects fastener button 314 to integration unit 306 and the fastener spring applies a force to fastener lever 316 when pressing fastener button 314.

In the example shown for integration unit 306, the continuous material is resilient and the resilience of the continuous material that forms fastener lever 316 provides the fastener spring integrally. Accordingly, the fastener spring is not labeled with a reference numeral separately from fastener lever 316. In other examples, the fastener spring conceivably could be provided separately, but a benefit exists with providing the fastener spring integrally, as described above in the discussion of benefits associated with integration units.

For a dispensing lid, a cap may close spout 308 when retained in a closed position by fastener 312. Also, the cap may open spout 308 when pressing fastener button 314 overcomes the applied force of the fastener spring and moves fastener lever 316, releasing the cap from the closed position.

As appreciated from FIGS. 3A and 3B, integration unit 306 is analogous to integration unit 106 in FIGS. 1A-1C in that both integration units include essentially the same components arranged in similar manner with respect to one another. However, integration unit 306 arranges a vent 320 differently, along with an included vent duct 322. Integration unit 306 is suitable for use as a replacement of integration unit 106 in dispensing lid 100. Body conduit 138 would be modified wherein a modified gasket seat would correspond to a gasket 352 of integration unit 306. In comparison, gasket 152 has a generally rectangular profile shown in FIG. 1B while gasket 352 has a generally circular profile shown in FIG. 3B.

With a generally circular body conduit configured to receive gasket 352 onto a complementary gasket seat, no space would be provided for vent duct 322 to pass through such a body conduit. Notably, a dispensing lid using integration unit 306 would arrange the venting similar in concept to integration unit 506, but different from integration units 106, 206, and 606. The body would include a first body conduit passing through the body and a different second body conduit passing through the body (see, for example, FIG. 10A). Spout conduit 310 would align with the first body conduit when integration unit 306 is engaged with the body, allowing dispensing through the lid via both the first body conduit and spout conduit 310. Vent duct 322 would align with the second body conduit when integration unit 306 is engaged with the body, allowing air exchange through the lid via both the second body conduit and vent duct 322.

Essentially, integration unit 306 includes a key profile and the body would further include a corresponding lock profile. The key profile is provided by a projection 380 through which vent duct 322 extends. The body would further include a recess in the body complementary to projection 380 sufficient to receive and seat projection 380 therein (see, for example, FIG. 10A). Consequently, projection 380 of the key profile further includes vent 320 of integration unit 306 and the recess of the lock profile further includes a vent conduit (second body conduit) through the body aligning with vent duct 322.

Integration unit 306 further includes a vent 320 separate from spout 308 and including a vent duct 322 passing through the continuous material in common and allowing air exchange through the lid via vent duct 322. A cap, such as cap 104, may close spout 308 and vent 320 when retained in the closed position by fastener 312. Also, a cap may open spout 308 and vent 320 when pressing fastener button 314 overcomes the applied force of the fastener spring and moves fastener lever 316, releasing the cap from the closed position.

Notably, respective portions of the continuous material that form spout 308 and fastener 312 lack material interfaces within the continuous material between spout 308, fastener 312, fastener button 314, fastener lever 316, and the fastener spring. As the term is used herein, in addition to the description given above, an integration unit is considered to be unitary, that is, not divided nor discontinuous. By way of example, integration unit 306 may be manufactured in a single molding process containing all of the continuous material in common sufficient to form the components included therewith. Other manufacturing processes are conceivable, such as subtractive manufacturing to remove portions from a block of the continuous material, etc. Silicone may be a suitable continuous material for many implementations with a hardness, such as a Shore A durometer value, sufficient to yield the physical and mechanical properties described herein. For example, the Shore A value may be from 40 to 60, but other values are conceivable.

In other implementations, integration unit 306 formed of a continuous material in common could conceivably have material interfaces between components. For example, if components are formed of the continuous material, though at different times, then material interfaces could exist. Also, in additive manufacturing, such as 3-D printing and other methods, some techniques may leave macroscopic interfaces between successively formed layers of a continuous material in common unless measures are taken to reduce or eliminate such interfaces. Likewise, if components containing the continuous material are welded together in some manner without adding different material, then material interfaces would likely exist. Components joined using a different interface material, such as adhesive, would not include a "continuous" material in common among components.

Integration unit 306 may be associated with an additional component (not shown) that is not formed of the continuous material in common amongst integration unit components. The additional component could impart additional mechanical properties to the integration unit. For example, integration unit 306 could be co-molded with an internal feature that stiffens the flexion of fastener button 314 at fastener tab 326 instead of using a stiffer continuous material. Despite the presence of the internal feature, integration unit 306 may nonetheless be formed of a continuous material in common amongst spout 308, fastener 312, fastener button 314, fastener lever 316, and the fastener spring.

For integration unit 306, the resilience of the continuous material that forms vent 320 provides a cap spring integrally. Accordingly, the cap spring is not labeled with a reference numeral separately from vent 320. In other examples, the cap spring conceivably could be provided separately, but a benefit exists with providing the cap spring integrally, as described above in the discussion of benefits associated with integration units. The cap spring may apply a force to a cap when the cap is retained in the closed position. The cap spring rotates the cap when the cap is released from the closed position, opening spout 308 and vent 320.

To facilitate the ease of opening and closing the cap, fastener 312. includes a tab 326 and the cap may include a slot, such as cap slot 124, or a lip, such as cap lip 224. Fastener tab 326 engages the cap slot or lip when the cap is in the closed position. Fastener tab 326 retains the cap in the closed position by the force of the fastener spring applied to fastener lever 316.

Integration unit 306 further includes a spout rim 328 and a vent rim 332. Spout rim 328 circumscribes a top inlet 330 into spout conduit 310 and is formed of the continuous material in common. Vent rim 332 circumscribes a top inlet 334 into vent duct 322 and is also formed of the continuous material in common. Spout rim 328 and/or vent rim 332 could conceivably be formed of a material different from the continuous material.

Additionally, a cap may include an interior seal surface, such as interior seal surface 136, that contacts spout rim 328 and vent rim 332 when the cap approaches the closed position. The interior seal surface may close spout 308 and vent 320 when retained in the closed position by fastener 312.

Integration unit 306 further includes a gasket 352 with a concave profile 350. Gasket 352 is formed of the continuous material in common. Integration unit 306 may lack material interfaces within the continuous material between gasket 352 and other components. A first body conduit may have a gasket seat complementary to concave profile 350 of gasket 352 and circumscribing the first body conduit. Gasket 352 seals with the gasket seat when integration unit 306 is engaged with the body, thus aligning spout conduit 310 with the first body conduit. Although integration unit 306 includes gasket 352 with a concave profile 350, other sealing associations are conceivable between integration unit 306 and the body, such as known sealing associations.

Integration unit 306 includes an integration of spout 308 and fastener 312. The integration is shown in FIGS. 3A and 3B combined with gasket 352 with concave profile 350. Even so, such integration is contemplated for use independently with dispensing lids not using all components of integration unit 306. More specifically, the integration of a spout and a fastener may be used in combination with other dispensing lids herein, as well as other dispensing lids not disclosed herein.

Integration unit 306 includes gasket 352 with concave profile 350. The gasket is shown in FIGS. 3A and 3B combined with the integration of spout 308 and fastener. Even so, such gasket is contemplated for use independently with dispensing lids not using all components of integration unit 306. More specifically, a gasket with a concave profile may be used in combination with other dispensing lids herein, as well as other dispensing lids not disclosed herein.

In further discussion of gasket 352, concave profile 350 includes an upper sloped surface 372, a lower sloped surface 374, and a neck 376 joining upper sloped surface 372 and lower sloped surface 374. Upper 372 and lower 374 sloped surfaces decrease in diameter toward neck 376 and spout conduit 310 passes within neck 376.

In the example of integration unit 306, upper 372 and lower 374 sloped surfaces are conical, meaning resembling a cone or having the shape of a cone. A cone is a three-dimensional geometric shape that tapers smoothly from a flat base to a point called the apex. The flat base is frequently, though not necessarily, circular. When the flat base is circular, the shape is called a "circular cone." When the axis of the cone passes through the center of the base at right angles to its plane, the shape is called a "right cone." A "right, circular cone" includes both specifications.

In the example of integration unit 306, neck 376 is circular. A variety of shapes are conceivable for concave profile 350, including the general vee-shape formed on the conical surfaces of gasket 352 of integration unit 306.

Concave profile 350 may instead have various cross-sectional shapes, such as a "U" shape, semicircular shape, etc.

Consequently, in the example of integration unit 306, upper sloped surface 372 corresponds to a portion of the shape of a first right, circular cone and lower sloped surface 374 corresponds to a portion of the shape of a second right, circular cone. The first cone and the second cone may have the same apex angle. That is, for concave profiles where the continuous decrease in diameter toward neck 376 is linear, upper 372 and lower 374 sloped surfaces of concave profile 350 have the same absolute value of slope (rise over run). Alternatively, the first cone and the second cone may have different apex angles.

In integration unit 306, neck 376 of gasket 352 is in tension when integration unit 306 is engaged with the body, thus pulling upper 372 and lower 374 sloped surfaces into contact with the gasket seat. The smallest diameter of upper 372 and lower 374 sloped surfaces occurs at neck 376. Neck 376 includes a fillet 378 between upper 372 and lower 374 sloped surfaces. A "fillet" is a concavely curved section at the angle formed by the junction of two surfaces, that is, a rounded inside corner. An alternative to fillet 378 could be a vertex (not shown) wherein concave profile 350 comes to a point, as in the point of a triangle. However, by avoiding sharp corners, fillet 378 and the complementary shape of gasket seat 352 create a sealing surface that more readily engages and seals in comparison to a vertex. Also, a vertex could be more susceptible to tearing stresses in comparison to a fillet when removing and replacing integration unit 306.

Upper 372 and lower 374 sloped surfaces continuously decrease in diameter toward neck 376 across any portion thereof that contacts the gasket seat when integration unit 306 is engaged with the body. In the example shown, the continuous decrease in diameter toward neck 376 is linear. As an alternative, the continuous decrease in diameter could be non-linear, such as being curved in some fashion or even stepped or undulating.

Among the alternatives for concave profile 350, upper sloped surface 372 and lower sloped surface 374 may have the same height. Alternatively, upper sloped surface 372 may have a greater height than lower sloped surface 374. Such is shown for gasket 352.

Fourth Example Dispensing Lid

Figure 4A:
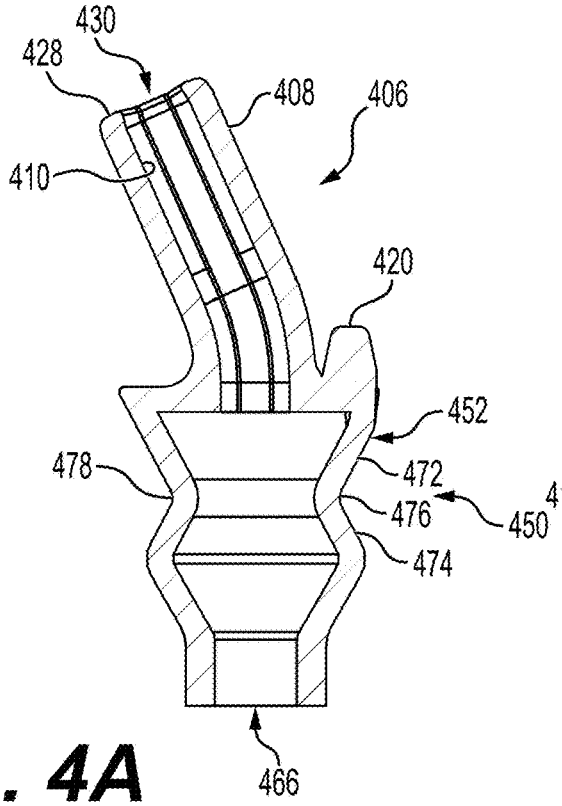
FIGS. 4A and 4B are respective sectional and top views of an integration unit for a fourth example dispensing lid shown in FIG. 4C and described herein.
Figure 4B:
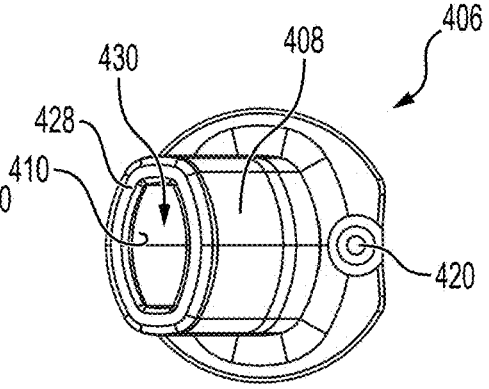

FIGS. 4A and 4B are respective sectional and top views of an integration unit 406. Integration unit 406 is included as part of a dispensing lid 400 shown in partial sectional view in FIG. 4C with a side view of integration unit 406. Dispensing lid 400 is designed for use with a container (not shown) that may contain liquids. Dispensing lid 400 may be selectively engageable with and disengageable from the container, such as by a threaded connection or other known type of connection. Alternatively, dispensing lid 400 may be permanently affixed to the container. As will be appreciated from the discussion herein, dispensing lid 400 provides a gasket in tension that increases the sealing ability.

Lid 400 includes a body 402, a cap 404 in rotatable engagement with body 402, and integration unit 406 selectively engageable with and disengageable from body 402. Integration unit 406 is formed of a continuous material in common amongst integration unit 406 components, which include a spout 408 and a gasket 452. Spout 408 has a spout conduit 410 passing through the continuous material in common and allowing dispensing through lid 400 via spout conduit 410.

Fastener 412 has a fastener button 414 and a fastener spring 416. Fastener spring 416 applies a force to fastener 412 when pressing fastener button 414.

Figure 4C:
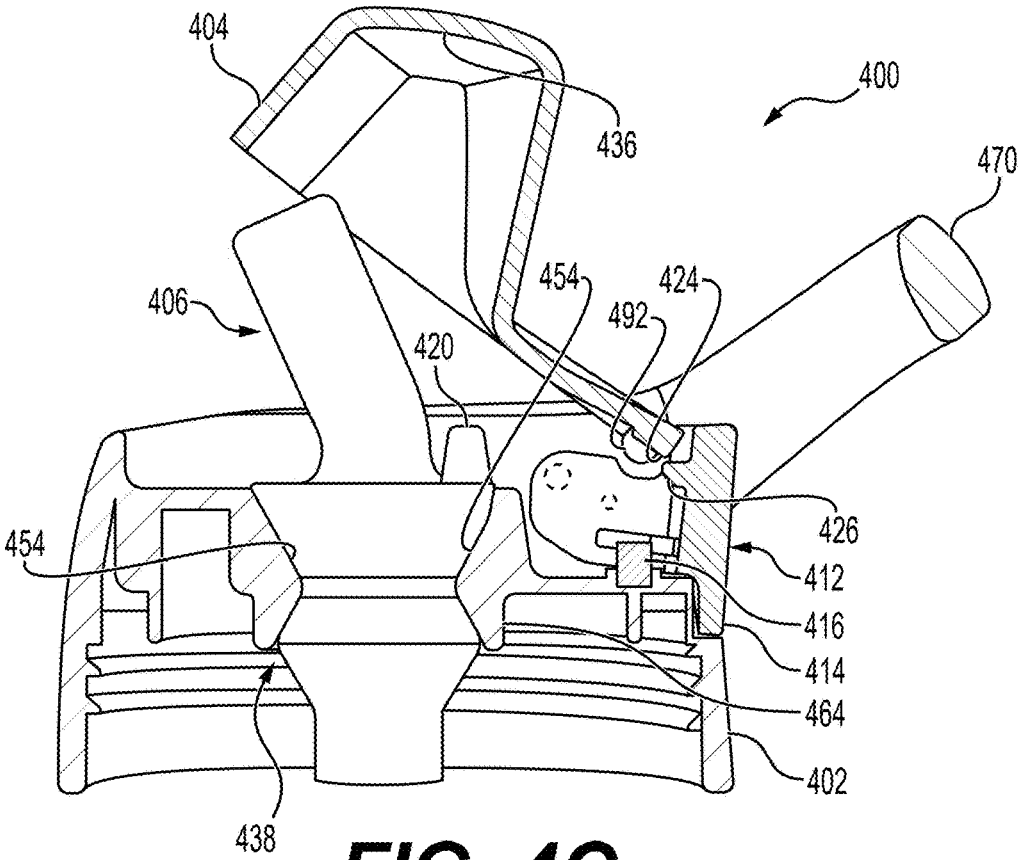
FIG. 4C is a partial sectional view of the fourth example dispensing lid and a side view of the integration unit in FIGS. 4A and 4B.

For lid 400, cap 404 closes spout 408 when retained in a closed position by fastener 412. Also, cap 404 opens spout 408 when pressing fastener button 414 overcomes the applied force of fastener spring 416 and moves fastener 412, releasing cap 404 from the closed position, such as shown in FIG. 4C.

Notably, respective portions of the continuous material that form spout 408 and gasket 452 lack material interfaces within the continuous material between spout 408 and gasket 452. As the term is used herein, in addition to the description given above, an integration unit is considered to be unitary, that is, not divided nor discontinuous. By way of example, integration unit 406 may be manufactured in a single molding process containing all of the continuous material in common sufficient to form the components included therewith. Other manufacturing processes are conceivable, such as subtractive manufacturing to remove portions from a block of the continuous material, etc. Silicone may be a suitable continuous material for many implementations with a hardness, such as a Shore A durometer value, sufficient to yield the physical and mechanical properties described herein. For example, the Shore A value may be from 40 to 60, but other values are conceivable.

In other implementations, integration unit 406 formed of a continuous material in common could conceivably have material interfaces between components. For example, if components are formed of the continuous material, though at different times, then material interfaces could exist. Also, in additive manufacturing, such as 3-D printing and other methods, some techniques may leave macroscopic interfaces between successively formed layers of a continuous material in common unless measures are taken to reduce or eliminate such interfaces. Likewise, if components containing the continuous material are welded together in some manner without adding different material, then material interfaces would likely exist. Components joined using a different interface material, such as adhesive, would not include a "continuous" material in common among components.

Integration unit 406 may be associated with an additional component (not shown) that is not formed of the continuous material in common amongst integration unit components. The additional component could impart additional mechanical properties to the integration unit. For example, integration unit 406 could be co-molded with an internal feature. Despite the presence of the internal feature, integration unit 406 may nonetheless be formed of a continuous material in common amongst spout 408 and gasket 452.

In lid 400, the resilience of the continuous material that forms fastener spring 420 provides a cap spring integrally. Accordingly, the cap spring is not labeled with a reference numeral separately from vent 420. In other examples, the cap spring conceivably could be provided separately, but a benefit exists with providing the cap spring integrally, as described above in the discussion of benefits associated with integration units. Cap spring 420 applies a force to cap 404 when cap 404 is retained in the closed position. Cap spring 420 rotates cap 404 when cap 404 is released from the closed position, opening spout 408.

To facilitate the ease of opening and closing cap 404, fastener 412 includes a tab 426 and cap 404 includes a lip 424. Fastener tab 426 engages cap lip 424 when cap 404 is in the closed position. Fastener tab 426 retains cap 404 in the closed position by the force of the fastener spring applied to fastener 412.

Lid 400 provides a hinge mechanism that is not completely described herein. A few of its various components appear in the FIGURES, but are not individually numbered and are instead noted generically as hinge mechanism components 492. The hinge mechanism may use a known configuration and provides for the opening and closing of cap 404.

Integration unit 406 further includes a spout rim 428. Spout rim 428 circumscribes a top inlet 430 into spout conduit 410 and is formed of the continuous material in common. Spout rim 428 could conceivably be formed of a material different from the continuous material.

Additionally, cap 404 includes an interior seal surface 436 that contacts spout rim 428 when cap 404 approaches the closed position. Interior seal surface 436 closes spout 408 when cap 404 is retained in the closed position by fastener 412. Interior seal surface 436 may simply press on spout rim 428 to accomplish sealing.

Body 402 includes a body conduit 438 passing through body 402, as shown in FIG. 4C. Spout conduit 410 aligns with body conduit 438 when integration unit 406 is engaged with body 402, allowing dispensing through lid 400 via both body conduit 438 and spout conduit 410.

Integration unit 406 further includes a gasket 452 with a concave profile 450. Gasket 452 is formed of the continuous material in common. Integration unit 406 may lack material interfaces within the continuous material between gasket 452 and other components. Body conduit 438 has a gasket seat 454 complementary to concave profile 450 of gasket 452 and circumscribing body conduit 438. Gasket 452 seals with gasket seat 454 when integration unit 406 is engaged with body 402, thus aligning spout conduit 410 with body conduit 438. Although integration unit 406 includes gasket 452 with a concave profile 450, other sealing associations are conceivable between integration unit 406 and body 402, such as known sealing associations.

Figure 10A:
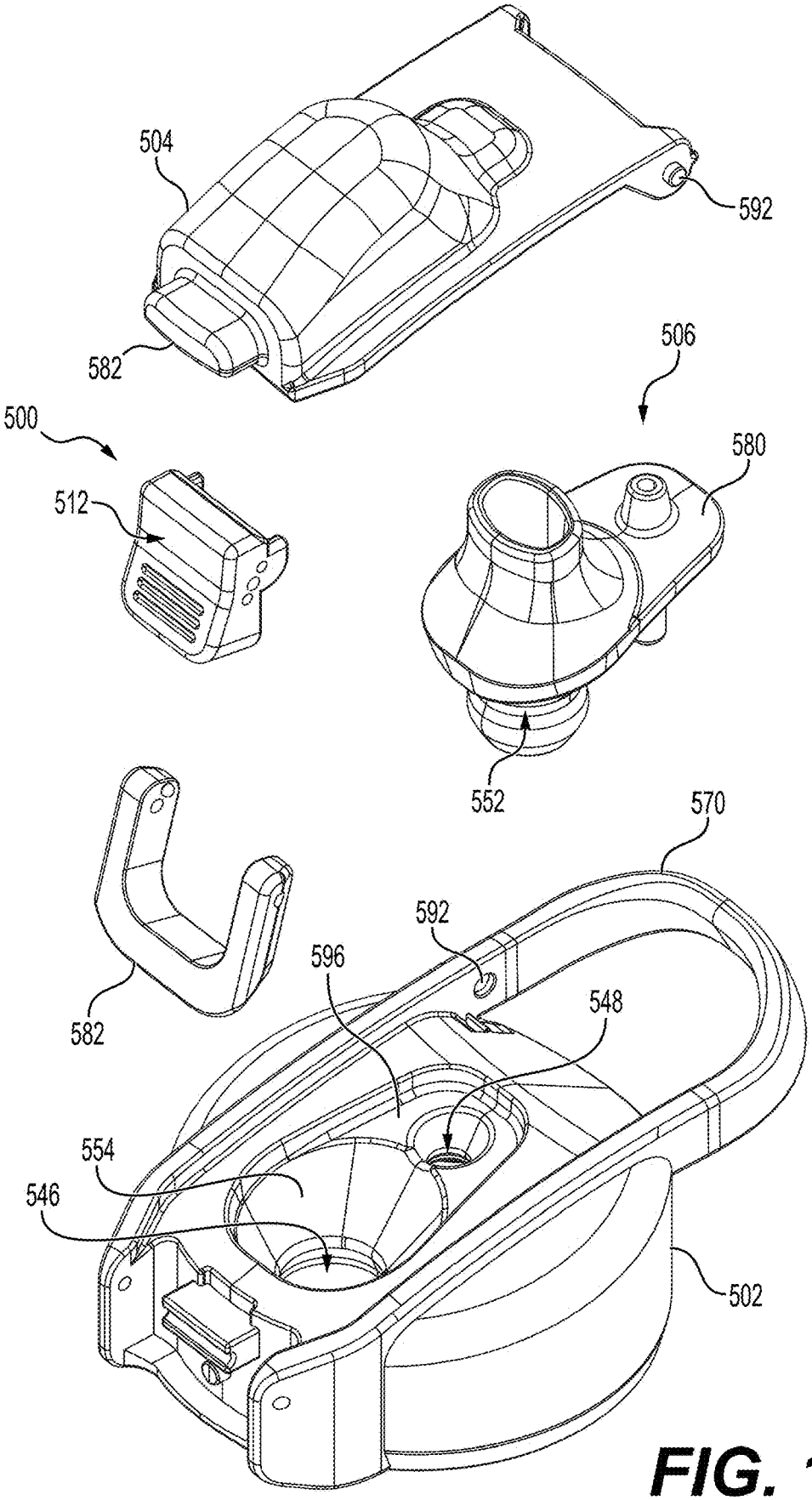
FIGS. 10A and 10B are exploded isometric views of the fifth example dispensing lid.
Figure 10B:
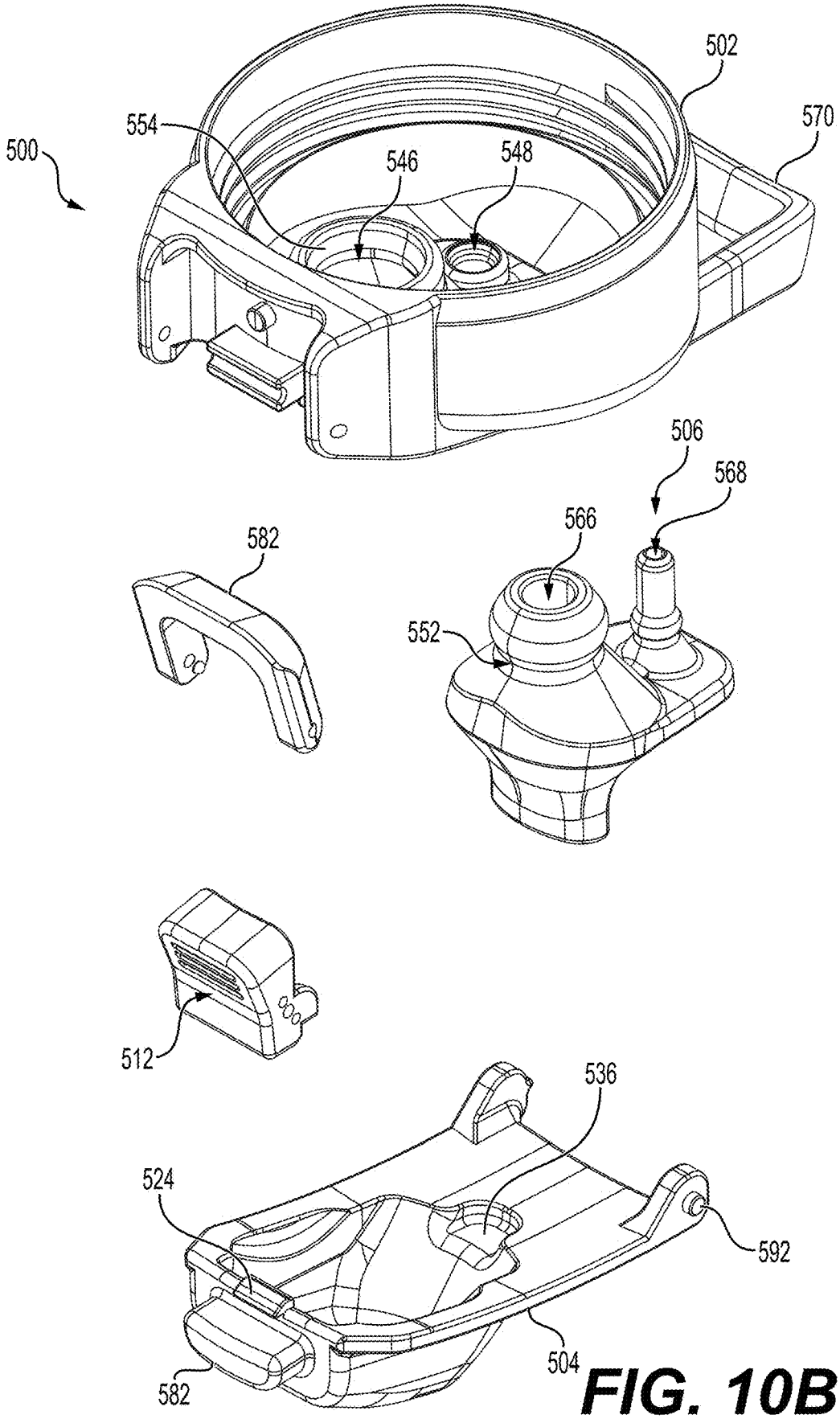

Lid 400 may include a handle 470 fixed in position and similar to handle 570 shown in FIG. 10A. A handle that is selectively rotatable, such as in FIGS. 8A-8D and 9A-9D, is also conceivable. Handle 470 or some other handle may attach to the container instead of to body 402, as in FIGS. 9A-9D.

In further discussion of gasket 452, concave profile 450 includes an upper sloped surface 472, a lower sloped surface 474, and a neck 476 joining upper sloped surface 472 and lower sloped surface 474. Upper 472 and lower 474 sloped surfaces decrease in diameter toward neck 476 and spout conduit 410 passes within neck 476. Body 402 includes body conduit 438 passing through body 402 and body conduit 438 has gasket seat 454 complementary to concave profile 450 of gasket 452 and circumscribing body conduit 438. Gasket 452 seals with gasket seat 454 when integration unit 406 is engaged with body 402, thus aligning spout conduit 410 with body conduit 438. A variety of structures are possible for gasket seat 454. In the example of dispensing lid 400, gasket seat 454 is formed on an extension wall 464 of body 402.

Spout conduit 410 is aligned with body conduit 438. Gasket 452 seals with gasket seat 454 circumscribing body conduit 438. It follows that spout conduit 410 passes within neck 476 of gasket 452. FIGS. 4A-4C show that gasket 452 laterally surrounds at least a portion of spout conduit 410. Integration unit 406 includes a bottom inlet 466 into spout conduit 410. Gasket 452, as defined by the portion of integration unit 406 that seals with body 402, does not laterally surround spout bottom inlet 466 since it is positioned below gasket 452.

In the example of dispensing lid 400, upper 472 and lower 474 sloped surfaces are conical, meaning resembling a cone or having the shape of a cone. A cone is a three-dimensional geometric shape that tapers smoothly from a flat base to a point called the apex. The flat base is frequently, though not necessarily, circular. When the flat base is circular, the shape is called a "circular cone." When the axis of the cone passes through the center of the base at right angles to its plane, the shape is called a "right cone." A "right, circular cone" includes both specifications.

In the example of dispensing lid 400, neck 476 is circular. A variety of shapes are conceivable for concave profile 450, including the general vee-shape formed on the conical surfaces of gasket 452 of integration unit 406. Concave profile 450 may instead have various cross-sectional shapes, such as a "U" shape, semicircular shape, etc.

Consequently, in the example of dispensing lid 400, upper sloped surface 472 corresponds to a portion of the shape of a first right, circular cone and lower sloped surface 474 corresponds to a portion of the shape of a second right, circular cone. The first cone and the second cone may have the same apex angle. That is, for concave profiles where the continuous decrease in diameter toward neck 476 is linear, upper 472 and lower 474 sloped surfaces of concave profile 450 have the same absolute value of slope (rise over run). Alternatively, the first cone and the second cone may have different apex angles.

In dispensing lid 400, neck 476 of gasket 452 is in tension when integration unit 406 is engaged with body 402, thus pulling upper 472 and lower 474 sloped surfaces into contact with gasket seat 454. The smallest diameter of upper 472 and lower 474 sloped surfaces occurs at neck 476. Neck 476 includes a fillet 478 between upper 472 and lower 474 sloped surfaces. A "fillet" is a concavely curved section at the angle formed by the junction of two surfaces, that is, a rounded inside corner. An alternative to fillet 478 could be a vertex (not shown) wherein concave profile 450 comes to a point, as in the point of a triangle. However, by avoiding sharp corners, fillet 478 and the complementary shape of gasket seat 452 create a sealing surface that more readily engages and seals in comparison to a vertex. Also, a vertex could be more susceptible to tearing stresses in comparison to a fillet when removing and replacing integration unit 406.

Upper 472 and lower 474 sloped surfaces continuously decrease in diameter toward neck 476 across any portion thereof that contacts gasket seat 454 when integration unit 406 is engaged with body 402. In the example shown, the continuous decrease in diameter toward neck 476 is linear. As an alternative, the continuous decrease in diameter could be non-linear, such as being curved in some fashion or even stepped or undulating.

Among the alternatives for concave profile 450, upper sloped surface 472 and lower sloped surface 474 may have the same height. Alternatively, upper sloped surface 472 may have a greater height than lower sloped surface 474. Such is shown for gasket 452. The smaller height of lower sloped surface 474 increases the ease of inserting gasket 452 into body conduit 438, while the greater height of upper sloped surface 472 increases the sealing surfacing area and resistance to leakage. Accordingly, the combination of the two different heights may permit easier insertion while still sealing adequately. This benefit results because the smaller height of lower sloped surface 474 corresponds to less difference between the diameter of neck 476 and the diameter of body conduit 438 where aligned with neck 476. Thus, less difference between the two diameters results in easier insertion.

Fifth Example Dispensing Lid

Figure 5A:
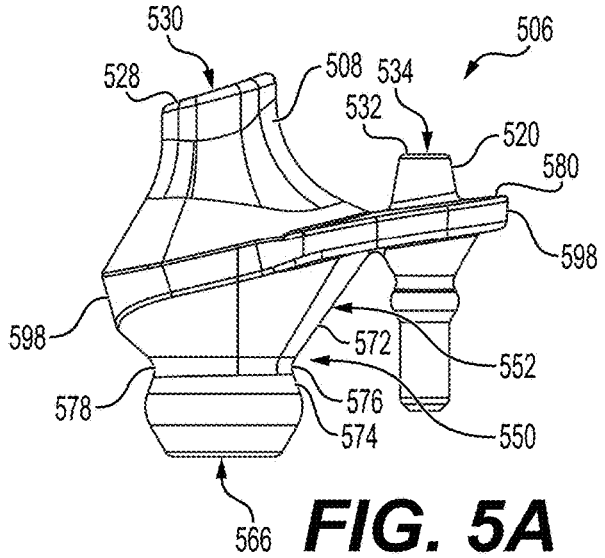
FIGS. 5A-5C are respective side, top, and sectional views of an integration unit for a fifth example dispensing lid shown in FIGS. 10A-10D and described herein.
Figure 5B:
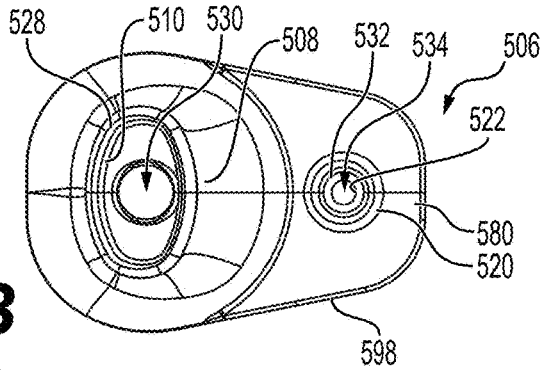
Figure 5C:
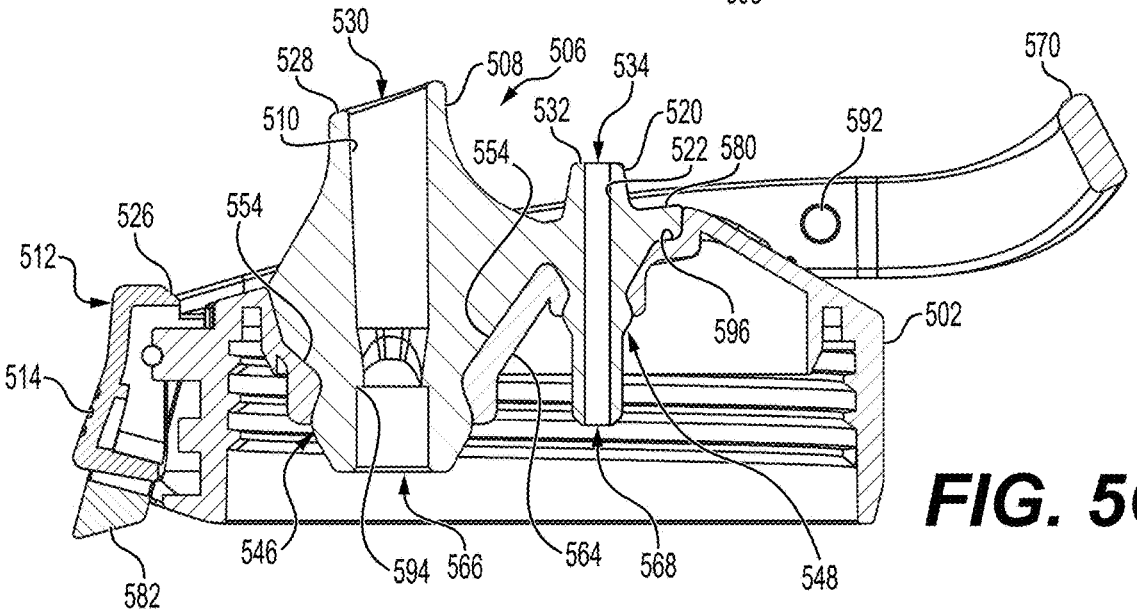

FIGS. 5A-5C are respective side, top, and sectional views of an integration unit 506. Integration unit 506 is included as part of a dispensing lid 500 shown in FIGS. 10A-10D. Dispensing lid 500 is designed for use with a container (not shown) that may contain liquids. Dispensing lid 500 may be selectively engageable with and disengageable from the container, such as by a threaded connection or other known type of connection. Alternatively, dispensing lid 500 may be permanently affixed to the container. As will be appreciated from the discussion herein, dispensing lid 500 provides a gasket in tension that increases the sealing ability. Also, dispensing lid 500 reduces the risk of a drink spout unintentionally disengaging from a body by top-mounting the drink spout.

Lid 500 includes a body 502, a cap 504 in rotatable engagement with body 502, and integration unit 506 selectively engageable with and disengageable from body 502. Integration unit 506 is formed of a continuous material in common amongst integration unit 506 components, which include a spout 508 and a gasket 552. Spout 508 has a spout conduit 510 passing through the continuous material in common and allowing dispensing through lid 500 via spout conduit 510.

Fastener 512 has a fastener button 514 and a fastener spring (not shown). The fastener spring applies a force to fastener 512 when pressing fastener button 514.

Figure 10C:
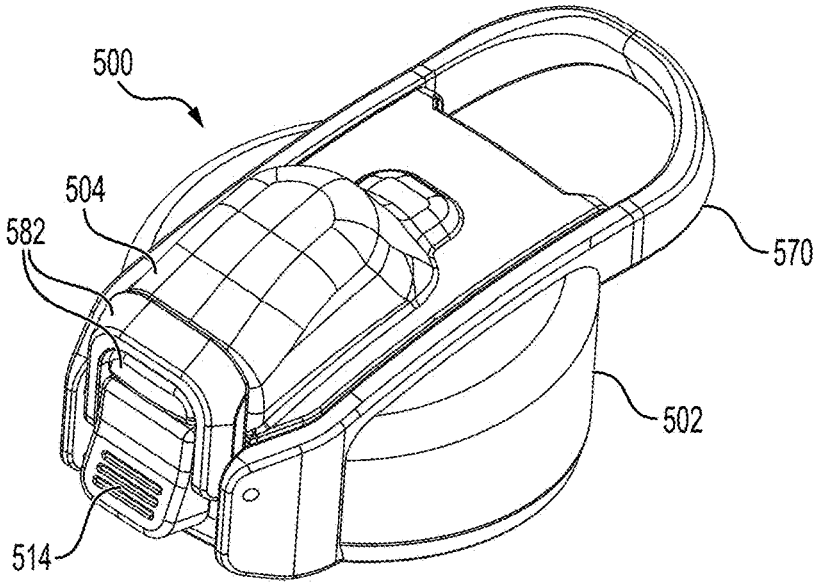
FIGS. 10C and 10D are isometric views of the fifth example dispensing lid with the cap in varied positions.
Figure 10D:
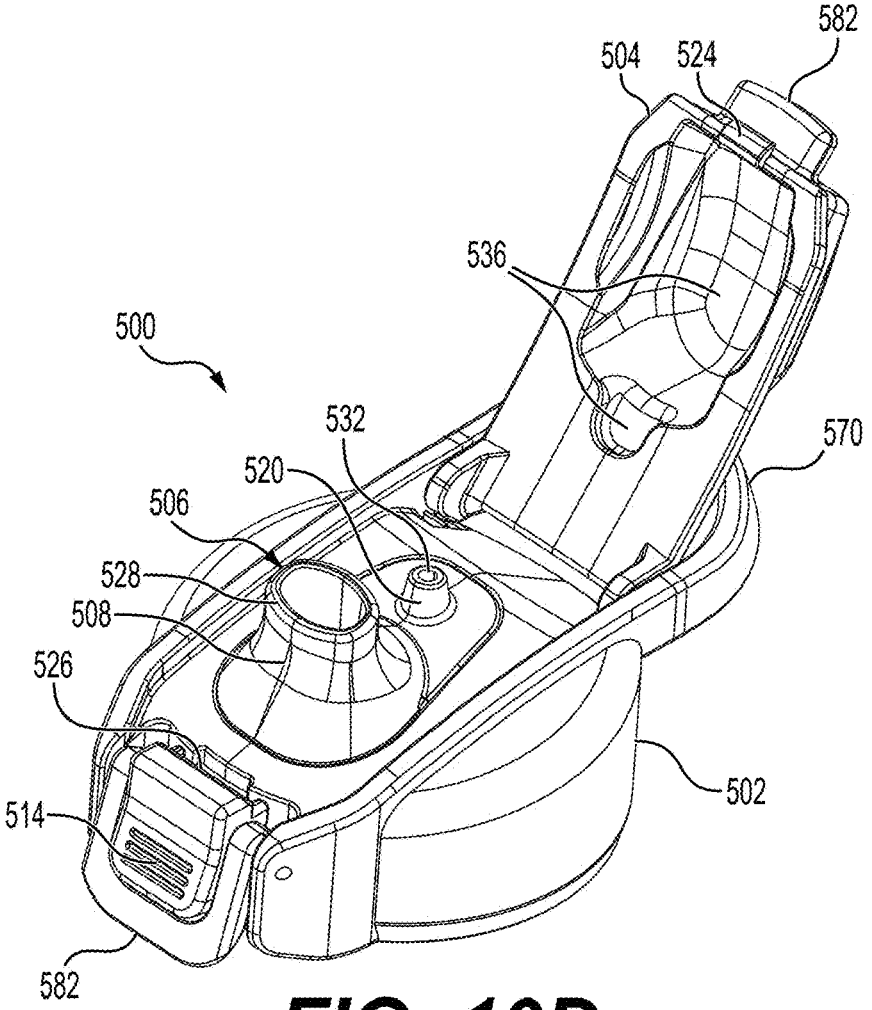

For lid 500, cap 504 closes spout 508 when retained in a closed position by fastener 512, as shown in FIG. 10C. Also, cap 504 opens spout 508 when pressing fastener button 514 overcomes the applied force of the fastener spring and moves fastener 512, releasing cap 504 from the closed position, such as shown in FIG. 10D.

Integration unit 506 further includes a vent 520 separate from spout 508 and including a vent duct 522 passing through the continuous material in common and allowing air exchange through lid 500 via vent duct 522. Cap 504 closes spout 508 and vent 520 when retained in the closed position by fastener 512. Also, cap 504 opens spout 508 and vent 520 when pressing fastener button 514 overcomes the applied force of the fastener spring, releasing cap 504 from the closed position.

Notably, respective portions of the continuous material that form spout 508 and gasket 552 lack material interfaces within the continuous material between spout 508 and gasket 552. As the term is used herein, in addition to the description given above, an integration unit is considered to be unitary, that is, not divided nor discontinuous. By way of example, integration unit 506 may be manufactured in a single molding process containing all of the continuous material in common sufficient to form the components included therewith. Other manufacturing processes are conceivable, such as subtractive manufacturing to remove portions from a block of the continuous material, etc. Silicone may be a suitable continuous material for many implementations with a hardness, such as a Shore A durometer value, sufficient to yield the physical and mechanical properties described herein. For example, the Shore A value may be from 40 to 60, but other values are conceivable.

In other implementations, integration unit 506 formed of a continuous material in common could conceivably have material interfaces between components. For example, if components are formed of the continuous material, though at different times, then material interfaces could exist. Also, in additive manufacturing, such as 3-D printing and other methods, some techniques may leave macroscopic interfaces between successively formed layers of a continuous material in common unless measures are taken to reduce or eliminate such interfaces. Likewise, if components containing the continuous material are welded together in some manner without adding different material, then material interfaces would likely exist. Components joined using a different interface material, such as adhesive, would not include a "continuous" material in common among components.

Integration unit 506 may be associated with an additional component (not shown) that is not formed of the continuous material in common amongst integration unit components. The additional component could impart additional mechanical properties to the integration unit. For example, integration unit 506 could be co-molded with an internal feature. Despite the presence of the internal feature, integration unit 506 may nonetheless be formed of a continuous material in common amongst spout 508 and gasket 552.

In lid 500, the resilience of the continuous material that forms vent 520 provides a cap spring integrally. Accordingly, the cap spring is not labeled with a reference numeral separately from vent 520. In other examples, the cap spring conceivably could be provided separately, but a benefit exists with providing the cap spring integrally, as described above in the discussion of benefits associated with integration units. The cap spring may apply a force to cap 504 when cap 504 is retained in the closed position. The cap spring rotates the cap when the cap is released from the closed position, opening spout 508 and vent 520.

To facilitate the ease of opening and closing cap 504, fastener 512 includes a tab 526 and cap 504 includes a lip 524. Fastener tab 526 engages cap lip 524 when cap 504 is in the closed position. Fastener tab 526 retains cap 504 in the closed position by the force of the fastener spring applied to fastener 512.

Lid 500 provides a hinge mechanism that is not completely described herein. A few of its various components appear in the FIGURES, but are not individually numbered and are instead noted generically as hinge mechanism components 592. The hinge mechanism may use a known configuration and provides for the opening and closing of cap 504.

Similarly, lid 500 provides a lock mechanism that is not completely described herein. A few of its various components appear in the FIGURES, but are not individually numbered and are instead noted generically as lock mechanism components 582. The lock mechanism may use a known configuration and provides for retaining cap 504 in the closed position, as shown in FIG. 10C, in a manner that reduces the likelihood of opening cap 504 by unintentionally pressing fastener button 514. FIG. 10D shows lock mechanism components in an unlocked position.

Integration unit 506 further includes a spout rim 528 and a vent rim 532. Spout rim 528 circumscribes a top inlet 530 into spout conduit 510 and is formed of the continuous material in common. Vent rim 532 circumscribes a top inlet 534 into vent duct 522 and is also formed of the continuous material in common. Spout rim 528 and/or vent rim 532 could conceivably be formed of a material different from the continuous material.

Additionally, cap 504 includes an interior seal surface 536 that contacts spout rim 528 and vent rim 532 when cap 504 approaches the closed position. Interior seal surface 536 closes spout 508 and vent 520 when cap 504 is retained in the closed position by fastener 512. Interior seal surface 536 may simply press on spout rim 528 and vent rim 532 to accomplish sealing. Alternatively, when vent 520 is taller, interior seal surface 536 may bend vent 520 over such that vent rim 532 compresses and folds, with opposing sides of vent rim 532 touching and accomplishing the seal.

Body 502 includes a first body conduit 546 passing through body 502, as shown in FIG. 5C. Spout conduit 510 aligns with first body conduit 546 when integration unit 506 is engaged with body 502, allowing dispensing through lid 500 via both first body conduit 546 and spout conduit 510.

Integration unit 506 further includes a gasket 552 with a concave profile 550. Gasket 552 is formed of the continuous material in common. Integration unit 506 may lack material interfaces within the continuous material between gasket 552 and other components. First body conduit 546 has a gasket seat 554 complementary to concave profile 550 of gasket 552 and circumscribing first body conduit 546. Gasket 552 seals with gasket seat 554 when integration unit 506 is engaged with body 502, thus aligning spout conduit 510 with first body conduit 546. Although integration unit 506 includes gasket 552 with a concave profile 550, other sealing associations are conceivable between integration unit 506 and body 502, such as known sealing associations.

Lid 500 includes a handle 570 fixed in position. A handle that is selectively rotatable, such as in FIGS. 8A-8D and 9A-9D, is also conceivable. Handle 570 or some other handle may attach to the container instead of to body 502, as in FIGS. 9A-9D.

In further discussion of gasket 552, concave profile 550 includes an upper sloped surface 572, a lower sloped surface 574, and a neck 576 joining upper sloped surface 572 and lower sloped surface 574. Upper 572 and lower 574 sloped surfaces decrease in diameter toward neck 576 and spout conduit 510 passes within neck 576. Body 502 includes first body conduit 546 passing through body 502 and first body conduit 546 has gasket seat 554 complementary to concave profile 550 of gasket 552 and circumscribing first body conduit 546. Gasket 552 seals with gasket seat 554 when integration unit 506 is engaged with body 502, thus aligning spout conduit 510 with first body conduit 546. A variety of structures are possible for gasket seat 554. In the example of dispensing lid 500, gasket seat 554 is formed on an extension wall 564 of body 502.

Spout conduit 510 is aligned with first body conduit 546. Vent duct 522 is aligned with a second body conduit 548. Gasket 552 seals with gasket seat 554 circumscribing first body conduit 546. It follows that spout conduit 510 passes within neck 576 of gasket 552. FIGS. 5A-5C show that gasket 552 laterally surrounds at least a portion of spout conduit 510. Integration unit 506 includes a bottom inlet 566 into spout conduit 510 and a bottom inlet 568 into vent duct 522. Gasket 552, as defined by the portion of integration unit 506 that seals with body 502, does not laterally surround spout bottom inlet 566 since it is positioned below gasket 552.

Spout conduit 510 includes a shoulder 594 therein to function as a stop for insertion of a straw (not shown) to engage with spout conduit 510. A straw would extend a pathway for withdrawal of liquid from the container (not shown) toward a bottom of the container. Gasket 552 laterally surrounds shoulder 594. As an alternative, contents of the container may be withdrawn through spout conduit 510 by tilting the container to drink instead of reliance on a straw (see FIGS. 2D-2F and corresponding discussion herein).

In the example of dispensing lid 500, upper 572 and lower 574 sloped surfaces are conical, meaning resembling a cone or having the shape of a cone. A cone is a three-dimensional geometric shape that tapers smoothly from a flat base to a point called the apex. The flat base is frequently, though not necessarily, circular. When the flat base is circular, the shape is called a "circular cone." When the axis of the cone passes through the center of the base at right angles to its plane, the shape is called a "right cone." A "right, circular cone" includes both specifications.

In the example of dispensing lid 500, neck 576 is circular. A variety of shapes are conceivable for concave profile 550, including the general vee-shape formed on the conical surfaces of gasket 552 of integration unit 506. Concave profile 550 may instead have various cross-sectional shapes, such as a "U" shape, semicircular shape, etc.

Consequently, in the example of dispensing lid 500, upper sloped surface 572 corresponds to a portion of the shape of a first right, circular cone and lower sloped surface 574 corresponds to a portion of the shape of a second right, circular cone. The first cone and the second cone may have the same apex angle. That is, for concave profiles where the continuous decrease in diameter toward neck 576 is linear, upper 572 and lower 574 sloped surfaces of concave profile 550 have the same absolute value of slope (rise over run). Alternatively, the first cone and the second cone may have different apex angles.

In dispensing lid 500, neck 576 of gasket 552 is in tension when integration unit 506 is engaged with body 502, thus pulling upper 572 and lower 574 sloped surfaces into contact with gasket seat 554. The smallest diameter of upper 572 and lower 574 sloped surfaces occurs at neck 576. Neck 576 includes a fillet 578 between upper 572 and lower 574 sloped surfaces. A "fillet" is a concavely curved section at the angle formed by the junction of two surfaces, that is, a rounded inside corner. An alternative to fillet 578 could be a vertex (not shown) wherein concave profile 550 comes to a point, as in the point of a triangle. However, by avoiding sharp corners, fillet 578 and the complementary shape of gasket seat 552 create a sealing surface that more readily engages and seals in comparison to a vertex. Also, a vertex could be more susceptible to tearing stresses in comparison to a fillet when removing and replacing integration unit 506.

Upper 572 and lower 574 sloped surfaces continuously decrease in diameter toward neck 576 across any portion thereof that contacts gasket seat 554 when integration unit 506 is engaged with body 502. In the example shown, the continuous decrease in diameter toward neck 576 is linear. As an alternative, the continuous decrease in diameter could be non-linear, such as being curved in some fashion or even stepped or undulating. FIGS. 5A and 5C show that integration unit 506 further includes a rim 598 that circumscribes integration unit 506 and seats within a recess 596 shown in FIG. 10A. However, rim 598 does not seal with gasket seat 552 and does not correspond to a portion of the shape of a first right, circular cone, as do upper 572 and lower 574 sloped surfaces.

Among the alternatives for concave profile 550, upper sloped surface 572 and lower sloped surface 574 may have the same height. Alternatively, upper sloped surface 572 may have a greater height than lower sloped surface 574. Such is shown for gasket 552. The smaller height of lower sloped surface 574 increases the ease of inserting gasket 552 into first body conduit 546, while the greater height of upper sloped surface 572 increases the sealing surfacing area and resistance to leakage. Accordingly, the combination of the two different heights may permit easier insertion while still sealing adequately. This benefit results because the smaller height of lower sloped surface 574 corresponds to less difference between the diameter of neck 576 and the diameter of first body conduit 546 where aligned with neck 576. Thus, less difference between the two diameters results in easier insertion.

Notably, dispensing lid 500 arranges the venting similar in concept to integration unit 306, but different from integration units 106, 206, and 606. Body 502 includes first body conduit 546 passing through body 502 and the different second body conduit 548 passing through body 502. Spout conduit 510 aligns with first body conduit 546 when integration unit 506 is engaged with body 502, allowing dispensing through lid 500 via both first body conduit 546 and spout conduit 510. Vent duct 522 aligns with second body conduit 548 when integration unit 506 is engaged with body 502, allowing air exchange through lid 500 via both second body conduit 548 and vent duct 520. As shown in FIGS. 5A-5C, 10A, and 10B, vent 520 includes a sealing association with body 502 that is the same in concept as gasket 552 and gasket seat 554 for spout 508. Other sealing associations are conceivable.

Integration unit 506 includes a key profile and body 502 includes a corresponding lock profile. The key profile in example dispensing lid 500 is provided by a projection 580 of integration unit 506. The lock profile is provided by recess 596 in body 502 complementary to projection 580. Projection 580 of the key profile further includes vent 520 of integration unit 506. Recess 596 of the lock profile further includes second body conduit 548 through body 502. Complementary key and lock profiles facilitate aligning and engaging integration unit 506 with body 502 and retaining integration unit 506 in its designated orientation.

Sixth Example Dispensing Lid

Figure 6A:
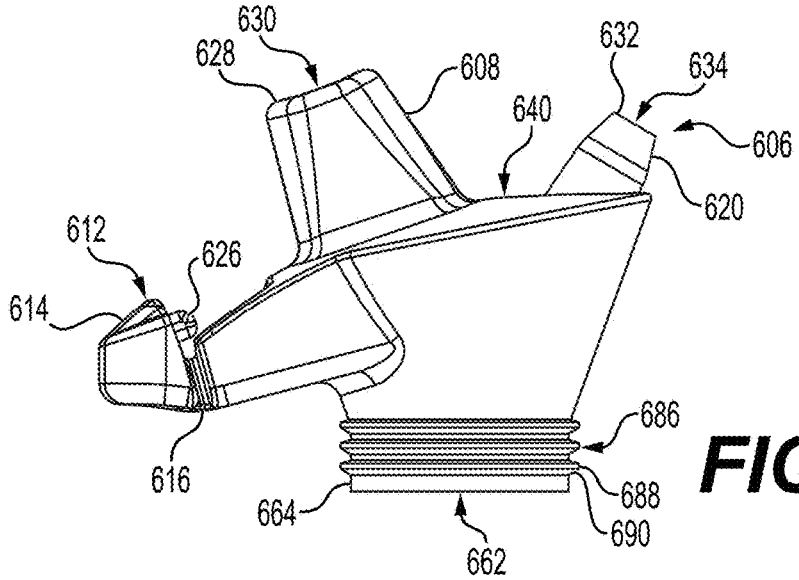
FIGS. 6A-6C are respective side, top, and sectional views of an integration unit for a sixth example dispensing lid shown in FIGS. 11A-11D and described herein.
Figure 6B:
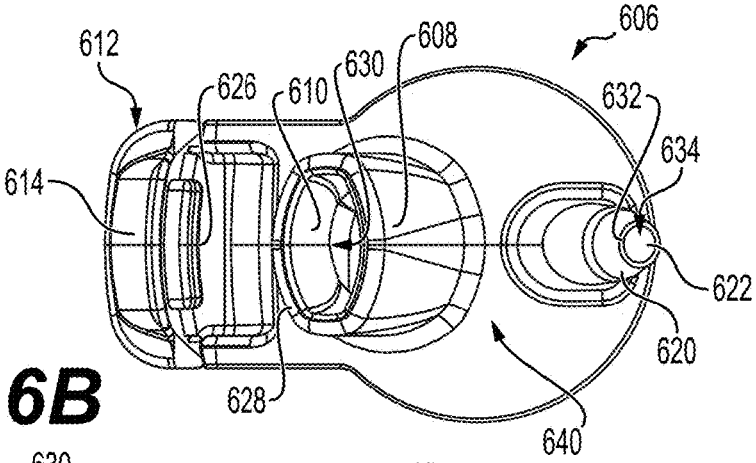
Figure 6C:
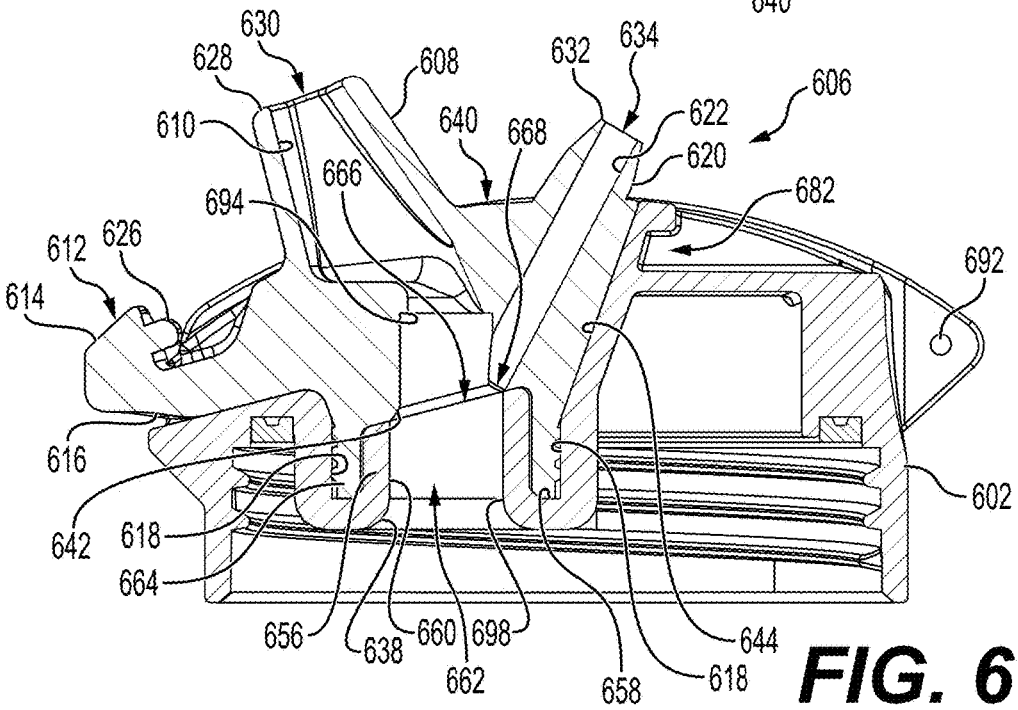

FIGS. 6A-6C are respective side, top, and sectional views of an integration unit 606. Integration unit 606 is included as part of a dispensing lid 600 shown in FIGS. 11A-11D. Dispensing lid 600 is designed for use with a container (not shown) that may contain liquids. Dispensing lid 600 may be selectively engageable with and disengageable from the container, such as by a threaded connection or other known type of connection. Alternatively, dispensing lid 600 may be permanently affixed to the container. As will be appreciated from the discussion herein, dispensing lid 600 increases the simplicity of function and assembly. Also, dispensing lid 600 reduces the risk of a drink spout unintentionally disengaging from a body by top-mounting the drink spout.

Lid 600 includes a body 602, a cap 604 in rotatable engagement with body 602, and integration unit 606 selectively engageable with and disengageable from body 602. Integration unit 606 is formed of a continuous material in common amongst integration unit 606 components, which include a spout 608 and a fastener 612. Spout 608 has a spout conduit 610 passing through the continuous material in common and allowing dispensing through lid 600 via spout conduit 610.

Fastener 612 is formed of the continuous material in common and has a fastener button 614, a fastener lever 616, and a fastener spring. Fastener lever 616 connects fastener button 614 to integration unit 606 and the fastener spring applies a force to fastener lever 616 when pressing fastener button 614.

In the example shown for integration unit 606, the continuous material is resilient and the resilience of the continuous material that forms fastener lever 616 provides the fastener spring integrally. Accordingly, the fastener spring is not labeled with a reference numeral separately from fastener lever 616. In other examples, the fastener spring conceivably could be provided separately, but a benefit exists with providing the fastener spring integrally, as described above in the discussion of benefits associated with integration units.

Figure 11A:
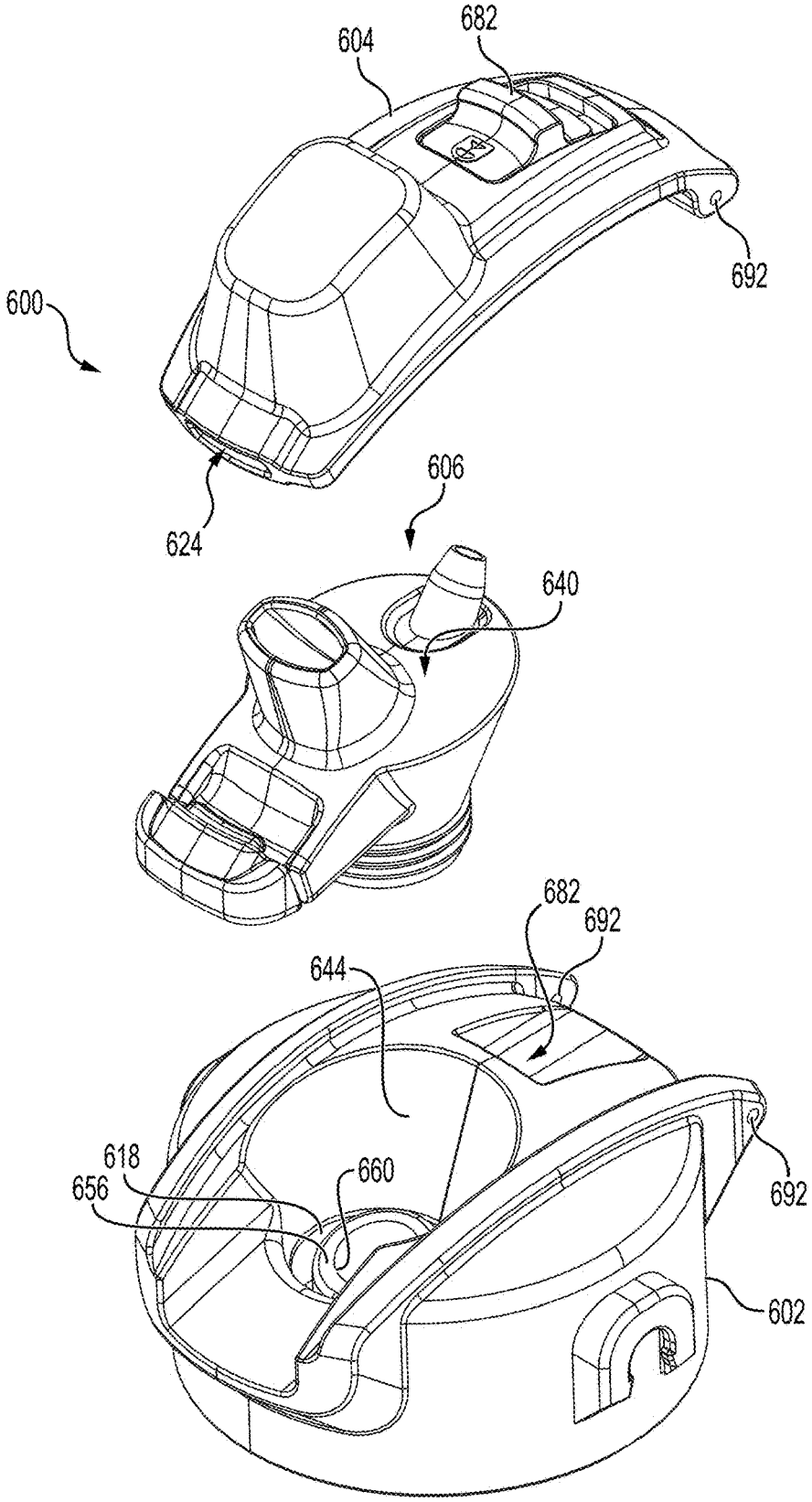
FIGS. 11A and 11B are exploded isometric views of the sixth example dispensing lid.
Figure 11B:
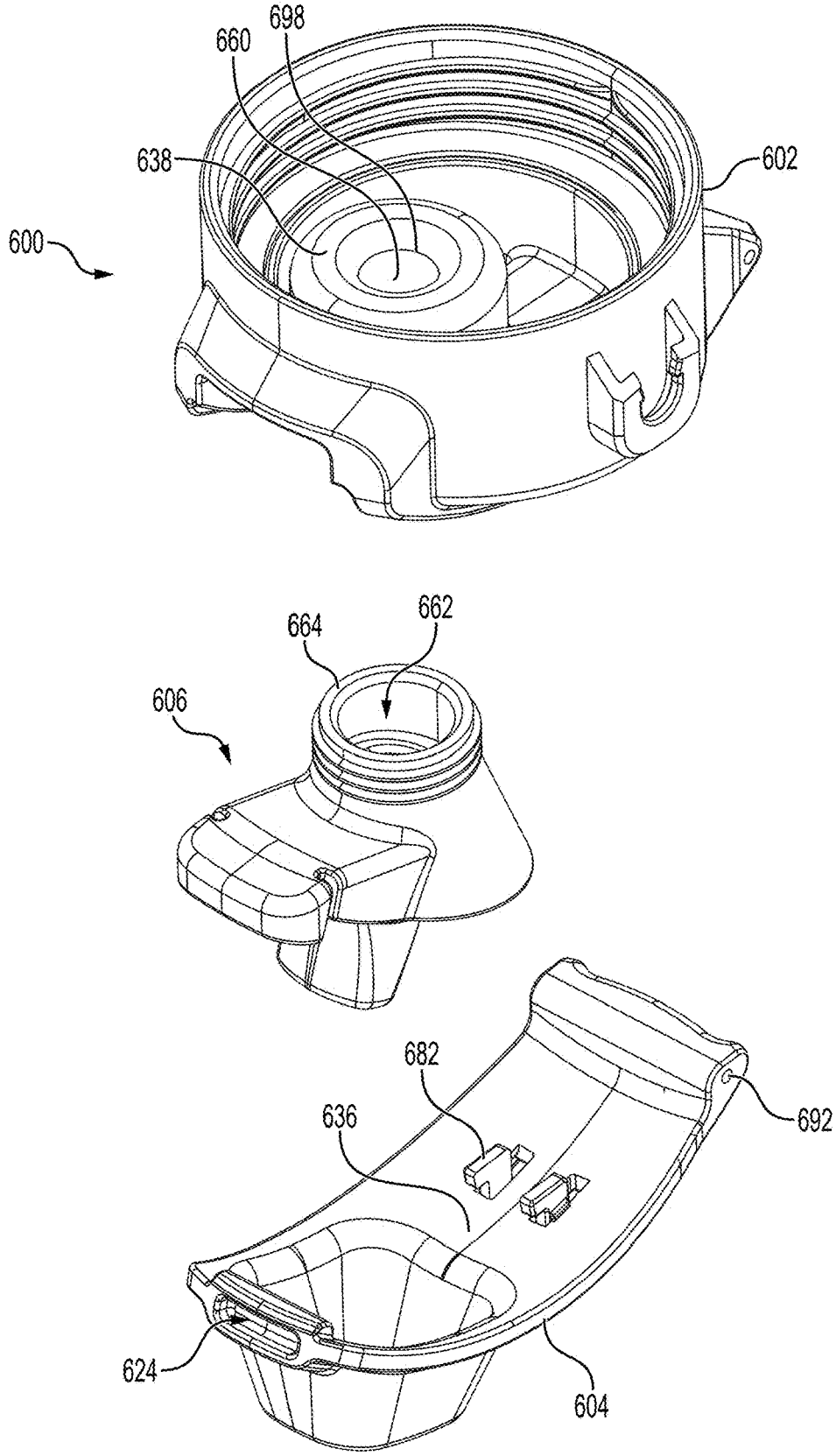
Figure 11C:
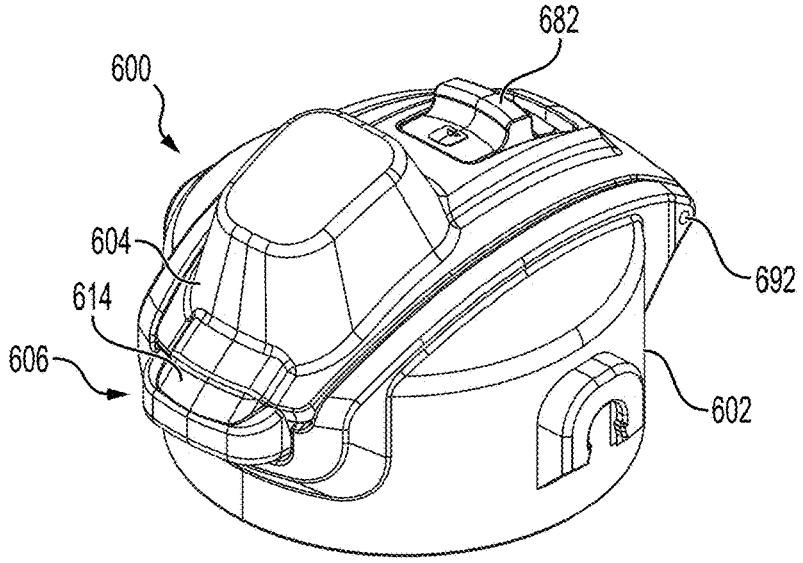
FIGS. 11C and 11D are isometric views of the sixth example dispensing lid with the cap in varied positions.
Figure 11D:
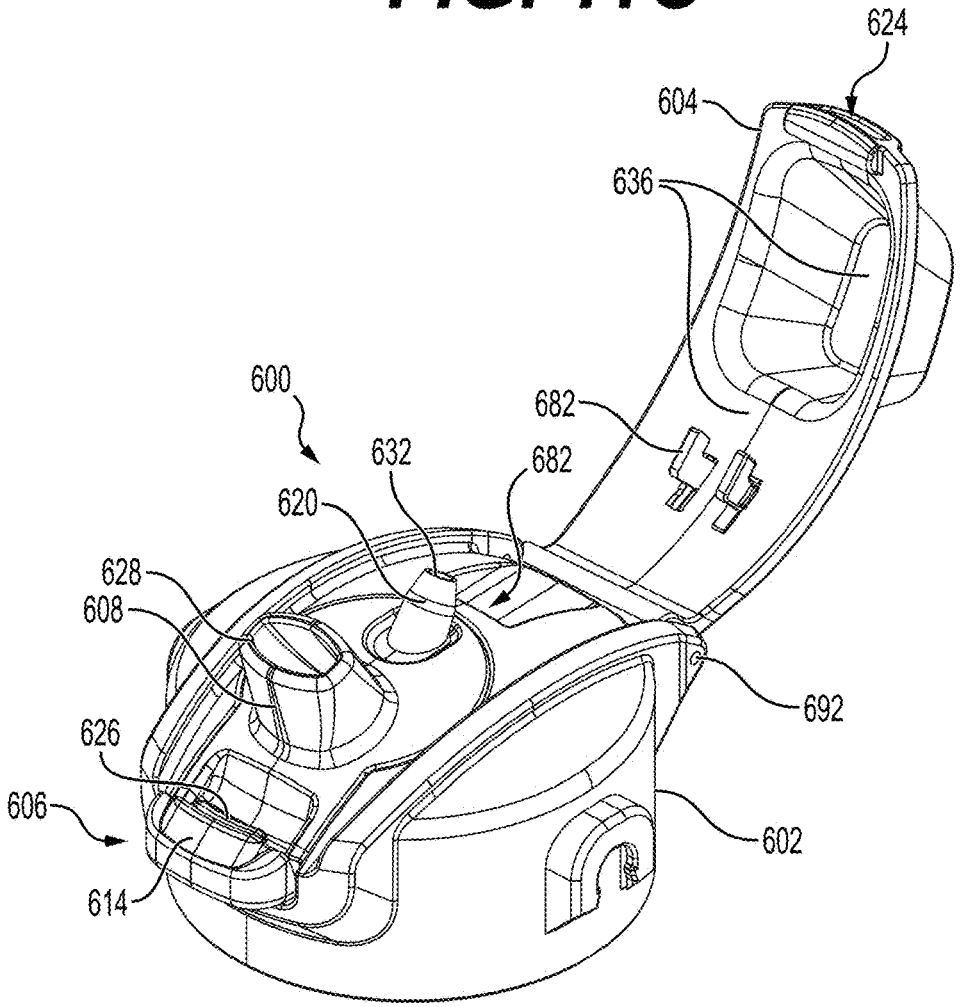

For lid 600, cap 604 closes spout 608 when retained in a closed position by fastener 612, as shown in FIG. 11C. Also, cap 604 opens spout 608 when pressing fastener button 614 overcomes the applied force of the fastener spring and moves fastener lever 616, releasing cap 604 from the closed position, such as shown in FIG. 11D.

Integration unit 606 further includes a vent 620 separate from spout 608 and including a vent duct 622 passing through the continuous material in common and allowing air exchange through lid 600 via vent duct 622. Cap 604 closes spout 608 and vent 620 when retained in the closed position by fastener 612. Also, cap 604 opens spout 608 and vent 620 when pressing fastener button 614 overcomes the applied force of the fastener spring and moves fastener lever 616, releasing cap 604 from the closed position.

Notably, respective portions of the continuous material that form spout 608 and fastener 612 lack material interfaces within the continuous material between spout 608, fastener 612, fastener button 614, fastener lever 616, and the fastener spring. As the term is used herein, in addition to the description given above, an integration unit is considered to be unitary, that is, not divided nor discontinuous. By way of example, integration unit 606 may be manufactured in a single molding process containing all of the continuous material in common sufficient to form the components included therewith. Other manufacturing processes are conceivable, such as subtractive manufacturing to remove portions from a block of the continuous material, etc. Silicone may be a suitable continuous material for many implementations with a hardness, such as a Shore A durometer value, sufficient to yield the physical and mechanical properties described herein. For example, the Shore A value may be from 40 to 60, but other values are conceivable.

In other implementations, integration unit 606 formed of a continuous material in common could conceivably have material interfaces between components. For example, if components are formed of the continuous material, though at different times, then material interfaces could exist. Also, in additive manufacturing, such as 3-D printing and other methods, some techniques may leave macroscopic interfaces between successively formed layers of a continuous material in common unless measures are taken to reduce or eliminate such interfaces. Likewise, if components containing the continuous material are welded together in some manner without adding different material, then material interfaces would likely exist. Components joined using a different interface material, such as adhesive, would not include a "continuous" material in common among components.

Integration unit 606 may be associated with an additional component (not shown) that is not formed of the continuous material in common amongst integration unit components. The additional component could impart additional mechanical properties to the integration unit. For example, integration unit 606 could be co-molded with an internal feature that stiffens the flexion of fastener button 614 at fastener tab 626 instead of using a stiffer continuous material. Despite the presence of the internal feature, integration unit 606 may nonetheless be formed of a continuous material in common amongst spout 608, fastener 612, fastener button 614, fastener lever 616, and the fastener spring.

In lid 600, the resilience of the continuous material that forms vent 620 provides a cap spring integrally. Accordingly, the cap spring is not labeled with a reference numeral separately from vent 620. In other examples, the cap spring conceivably could be provided separately, but a benefit exists with providing the cap spring integrally, as described above in the discussion of benefits associated with integration units. The cap spring applies a force to cap 604 when cap 604 is retained in the closed position of FIG. 11C. The cap spring rotates cap 604 when cap 604 is released from the closed position, opening spout 608 and vent 620.

To facilitate the ease of opening and closing cap 604, fastener 612 includes a tab 626 and cap 604 includes a slot 624. Fastener tab 626 engages cap slot 624 when cap 604 is in the closed position. Fastener tab 626 retains cap 604 in the closed position by the force of the fastener spring applied to fastener lever 616.

Lid 600 provides a hinge mechanism that is not completely described herein. A few of its various components appear in the FIGURES, but are not individually numbered and are instead noted generically as hinge mechanism components 692. The hinge mechanism may use a known configuration and provides for the opening and closing of cap 604.

Similarly, lid 600 provides a lock mechanism that is not completely described herein. A few of its various components appear in the FIGURES, but are not individually numbered and are instead noted generically as lock mechanism components 682. The lock mechanism may use a known configuration and provides for retaining cap 604 in the closed position in a manner that reduces the likelihood of opening cap 604 by unintentionally pressing fastener button 614.

Integration unit 606 further includes a spout rim 628 and a vent rim 632. Spout rim 628 circumscribes a top inlet 630 into spout conduit 610 and is formed of the continuous material in common. Vent rim 632 circumscribes a top inlet 634 into vent duct 622 and is also formed of the continuous material in common. Spout rim 628 and/or vent rim 632 could conceivably be formed of a material different from the continuous material.

Additionally, cap 604 includes an interior seal surface 636 that contacts spout rim 628 and vent rim 632 when cap 604 approaches the closed position. Interior seal surface 636 closes spout 608 and vent 620 when cap 604 is retained in the closed position by fastener 612. Interior seal surface 636 may simply press on spout rim 628 and vent rim 632 to accomplish sealing. Alternatively, when vent 620 is taller, interior seal surface 636 may bend vent 620 over such that vent rim 632 compresses and folds, with opposing sides of vent rim 632 touching and accomplishing the seal.

Body 602 includes a body conduit 638 passing through body 602, as shown in FIGS. 6C and 11B. Spout conduit 610 aligns with body conduit 638 when integration unit 606 is engaged with body 602, allowing dispensing through lid 600 via both body conduit 638 and spout conduit 610. Also, vent duct 622 aligns with body conduit 638 when integration unit 606 is engaged with body 602, allowing air exchange through lid 600 via both body conduit 638 and vent duct 622.

With vent duct 622 and spout conduit 610 aligned with body conduit 638, the continuous material of integration unit 606 forms an outside surface of the lid 640 and an opposing inside surface of the lid 642. Lid inside surface 642 faces inside the container when lid 600 is attached to the container. Lid inside surface 642 is other than a surface of vent duct 622 and other than a surface of spout conduit 610.

Vent duct 622 is placed through lid inside surface 642. Such placement permits entry of air into the container through integration unit 606 when withdrawing contents from the container through a straw (not shown) engaged with spout conduit 610. As an alternative, contents of the container may be withdrawn through spout conduit 610 by tilting the container to drink instead of reliance on a straw (see FIGS. 2D-2F and corresponding discussion herein).

Lid 600 includes a top-mounted drink spout. Body 602 includes a well 618 recessed into and defining part of an outside surface 644 of body 602 that does not face inside the container when lid 600 is attached to the container. Body 602 also includes a tube 656 projecting outward from a bottom 658 of well 618 and a tube conduit 660 passing through tube 656. Body conduit 638 passes through body 602 at bottom 658 of well 618 and is aligned with tube conduit 660. Body conduit 638 and tube conduit 660 do not overlap.

Integration unit 606 is selectively engageable with and disengageable from body 602 and is formed of the continuous material in common amongst integration unit 606 components. Such components include spout 608 and a socket 662. Spout 608 has spout conduit 610 passing through the continuous material in common and allowing dispensing through lid 600 via spout conduit 610. Socket 662 is formed of the continuous material in common. Spout conduit 610 opens into socket 662. Integration unit 606 may lack material interfaces within the continuous material between socket 662 and other components. Tube 656 seats inside integration unit socket 662 when integration unit 606 is engaged with body 602 into well 618, thus aligning spout conduit 610 with tube conduit 660 and body conduit 638.

Lid 600 includes an integration of spout 608 and fastener 612. The integration is shown in FIGS. 6C and 11A-11D combined with the top-mounted drink spout. Even so, such integration is contemplated for use independently with other dispensing lids instead of that appearing in FIGS. 6C and 11A-11D. More specifically, the integration of a spout and a fastener may be used in combination with other dispensing lids herein, as well as other dispensing lids not disclosed herein.

In the example of lid 600, integration unit 606 does not extend through body conduit 638 when engaged with body 602. However, as stated, the continuous material of integration unit 606 is considered to provide lid inside surface 642. Even when a straw (not shown) is engaged with spout conduit 610, lid inside surface 642 faces inside the container as exposed through body conduit 638 via a gap between a perimeter of the straw and a perimeter of body conduit 638.

Lid 600 may include a handle that is selectively rotatable, such as handle 270 in FIGS. 9A-9D. A handle fixed in position, such as in FIGS. 4C and 10A-10D, is also conceivable. Handle 270 or some other handle may attach to the container instead of to body 602, as in FIGS. 9A-9D.

Lid 600 provides the top-mounted drink spout. The spout is shown in FIGS. 6C and 11A-11D combined with the integration of spout 608 and fastener 612. Even so, such drink spout is contemplated for use independently with other dispensing lids instead of that appearing in FIGS. 6C and 11A-11D. More specifically, a top-mounted drink spout may be used in combination with other dispensing lids herein, as well as other dispensing lids not disclosed herein.

Integration unit 606 further includes vent 620 separate from spout 608. Vent 620 includes vent duct 622 passing through the continuous material in common and allows air exchange through lid 600 via vent duct 622. Spout conduit 610 and vent duct 622 both open into socket 662. Tube 656 seats inside integration unit socket 662 when integration unit 606 is engaged with body 602 into well 618, thus aligning spout conduit 610 and vent duct 622 with tube conduit 660 and body conduit 638.

Integration unit 606 includes an extension wall 664 formed of the continuous material in common and laterally surrounding both a bottom inlet 666 into spout conduit 610 and a bottom inlet 668 into vent duct 622. Extension wall 664 defines integration unit socket 662. Integration unit 606 does not extend into body conduit 638 when engaged with body 602 into well 618. An inside diameter of tube conduit 660 is the same as an inside diameter of body conduit 638 at a junction 698 where tube conduit 660 meets body conduit 638.

Integration unit 606 further includes at least one ring seal 686 formed of the continuous material in common. Ring seal 686 restricts liquid leakage from tube conduit 660 via an interface between body 602 and integration unit 606 when integration unit 606 is engaged with body 602 into well 618. That is, ring seal 686 is similar in function to an O-ring between two mating surfaces. But, in lid 600, ring seal 686 is integral with integration unit 606.

FIG. 6A shows three ring seals 686 each of which has a tapered wiper profile narrowing from a wide base 690 toward a tip 688 that contacts body 602 when integration unit 606 is engaged with body 602 into well 618. The function of a resilient wiper permits ring seal tip 688 to deform and flex, maintaining contact with body 602. But, ring seal base 690 is wider and firmer, even though resilient, to adhere ring seal tip 688 to extension wall 664. The at least one ring seal 686 is positioned outside socket 662 and contacts a surface of well 618. In other implementations, a ring seal might be positioned inside the socket and contact a surface of the tube.

In the example of lid 600, socket 662 is circular and tube 656 is annular, wherein annular means relating to a ring or forming a ring. However, socket 662 can be square, oval, rectangular, etc. The socket and tube are sized and shaped complementary to one another.

Even though integration unit 606 does not extend into body conduit 638, the continuous material of integration unit 606 forms outside surface 640 of lid 600 and inside surface 642 of lid 600. Lid inside surface 642 faces inside the container as exposed through body conduit 638 when lid 600 is attached to the container, including when a straw is engaged.

Spout conduit 610 includes a shoulder 694 therein to function as a stop for insertion of a straw (not shown) to engage with spout conduit 610. A straw would extend a pathway for withdrawal of liquid from the container (not shown) toward a bottom of the container.

Spout conduit 610 extends from an outside surface of integration unit 606 to an inside surface of integration unit 606. Thus, the integration unit outside surface forms a part of outside surface 640 of lid 600 and the integration unit inside surface forms a part of inside surface 642 of lid 600. Accordingly, spout conduit 610 may be considered to extend from lid outside surface 640 to lid inside surface 642 when integration unit 606 is engaged with body 602.

Seventh Example Dispensing Lid

Figure 7A:
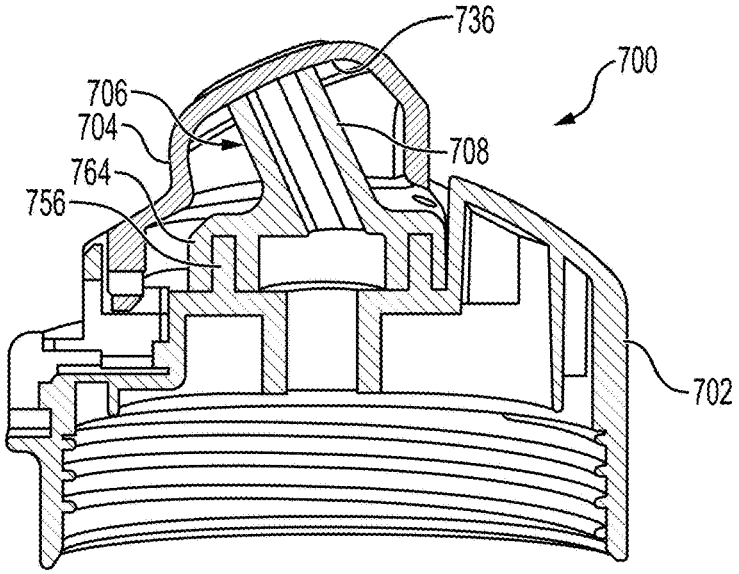
FIG. 7A is a sectional view of a seventh example dispensing lid and FIG. 7B is an exploded view of part of the dispensing lid.
Figure 7B:
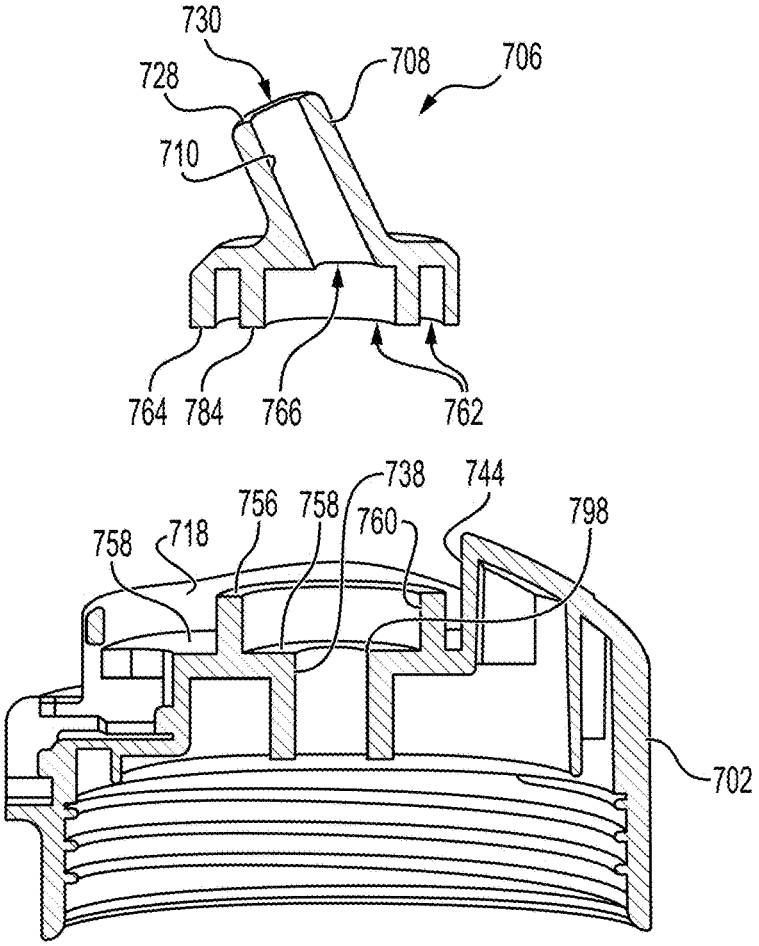

FIG. 7A is a sectional view of a dispensing lid 700. FIG. 7B is an exploded sectional view of an integration unit 706 and a body 702 included as parts of dispensing lid 700. Dispensing lid 700 is designed for use with a container (not shown) that may contain liquids. Dispensing lid 700 may be selectively engageable with and disengageable from the container, such as by a threaded connection or other known type of connection. Alternatively, dispensing lid 700 may be permanently affixed to the container. As will be appreciated from the discussion herein, dispensing lid 700 reduces the risk of a drink spout unintentionally disengaging from a body by top-mounting the drink spout.

Lid 700 includes body 702 and a cap 704 in rotatable engagement with body 702. Cap 704 closes a spout 708 when retained in a closed position, as in FIG. 7A, by a fastener (fastener not shown). Also, cap 704 opens spout 708 when released from the closed position. A vent (not shown) may be provided separately from integration unit 706.

Integration unit 706 further includes a spout rim 728. Spout rim 728 circumscribes a top inlet 730 into spout conduit 710 and is formed of the continuous material in common. Spout rim 728 could conceivably be formed of a material different from the continuous material. Additionally, cap 704 includes an interior seal surface 736 that contacts spout rim 728 when cap 704 approaches the closed position. Interior seal surface 736 closes spout 708 when cap 704 is retained in the closed position by the fastener. Interior seal surface 736 may simply press on spout rim 728 to accomplish sealing.

A vent (not shown) may permit entry of air into the container when withdrawing contents from the container through a straw (not shown) engaged with body conduit 738. As an alternative, contents of the container may be withdrawn through spout conduit 710 by tilting the container to drink instead of reliance on a straw (see FIGS. 2D-2F and corresponding discussion herein).

Lid 700 includes a top-mounted drink spout. Body 702 includes a well 718 recessed into and defining part of an outside surface 744 of body 702 that does not face inside the container when lid 700 is attached to the container. Body 702 also includes a tube 756 projecting outward from a bottom 758 of well 718 and a tube conduit 760 passing through tube 756. A body conduit 738 passes through body 702 at bottom 758 of well 718 and is aligned with tube conduit 760. Body conduit 738 and tube conduit 760 do not overlap.

Integration unit 706 is selectively engageable with and disengageable from body 702 and is formed of a continuous material in common amongst integration unit 706 components. Such components include a spout 708 and a socket 762. Spout 708 has spout conduit 710 passing through the continuous material in common and allowing dispensing through lid 700 via spout conduit 710. Socket 762 is formed of the continuous material in common. Spout conduit 710 opens into socket 762. Integration unit 706 may lack material interfaces within the continuous material between socket 762 and other components. Tube 756 seats inside integration unit socket 762 when integration unit 706 is engaged with body 702 into well 718, thus aligning spout conduit 710 with tube conduit 760 and body conduit 738.

As the term is used herein, in addition to the description given above, an integration unit is considered to be unitary, that is, not divided nor discontinuous. By way of example, integration unit 706 may be manufactured in a single molding process containing all of the continuous material in common sufficient to form the components included therewith. Other manufacturing processes are conceivable, such as subtractive manufacturing to remove portions from a block of the continuous material, etc. Silicone may be a suitable continuous material for many implementations with a hardness, such as a Shore A durometer value, sufficient to yield the physical and mechanical properties described herein. For example, the Shore A value may be from 40 to 60, but other values are conceivable.

In other implementations, integration unit 706 formed of a continuous material in common could conceivably have material interfaces between components. For example, if components are formed of the continuous material, though at different times, then material interfaces could exist. Also, in additive manufacturing, such as 3-D printing and other methods, some techniques may leave macroscopic interfaces between successively formed layers of a continuous material in common unless measures are taken to reduce or eliminate such interfaces. Likewise, if components containing the continuous material are welded together in some manner without adding different material, then material interfaces would likely exist. Components joined using a different interface material, such as adhesive, would not include a "continuous" material in common among components.

Integration unit 106 may be associated with an additional component (not shown) that is not formed of the continuous material in common amongst integration unit components. The additional component could impart additional mechanical properties to the integration unit. For example, integration unit 706 could be co-molded with an internal feature. Despite the presence of the internal feature, integration unit 706 may nonetheless be formed of a continuous material in common amongst spout 708 and socket 762.

Lid 700 may include a handle that is selectively rotatable, such as handle 270 in FIGS. 9A-9D. A handle fixed in position, such as in FIGS. 4C and 10A-10D, is also conceivable. Handle 270 or some other handle may attach to the container instead of to body 702, as in FIGS. 9A-9D.

Integration unit 706 includes an extension wall 764 formed of the continuous material in common and laterally surrounding a bottom inlet 766 into spout conduit 710. Extension wall 764 defines integration unit socket 762. Integration unit 706 may include an additional wall 784 of smaller diameter than extension wall 764. Even though two walls are provided, extension wall 764 contacting the outside of tube 756 defines socket 762 since spout conduit 710 opens into socket 762 when defined by extension wall 764 and tube 756 also seats inside socket 762 when defined by extension wall 764. Integration unit 706 does not extend into body conduit 738 when engaged with body 702 into well 718. As appreciated from FIG. 7B, an inside diameter of tube conduit 760 is greater than an inside diameter of body conduit 738 at a junction 798 where tube conduit 760 meets body conduit 738.

Integration unit 706 is not shown to include, but may further include, at least one ring seal formed of the continuous material in common. A ring seal restricts liquid leakage from tube conduit 760 via an interface between body 702 and integration unit 706 when integration unit 706 is engaged with body 702 into well 718. That is, a ring seal is similar in function to an O-ring between two mating surfaces. But, in lid 700, a ring seal would be integral with integration unit 706. The same structure as shown in FIG. 6A for three ring seals 686 may be used. The at least one ring seal may be positioned inside the socket and contact an outer surface or inner surface of tube 756 given the presences of extension wall 764 and additional wall 784. Essentially, the ring seal may be positioned either on extension wall 764 to contact an outer surface of tube 756 or on additional wall 784 to contact an inner surface of tube 756 or both.

In the example of lid 700, socket 762 is circular and tube 756 is annular, wherein annular means relating to a ring or forming a ring. However, socket 762 can be square, oval, rectangular, etc. The socket and tube are sized and shaped complementary to one another.

Devices and Methods

The discoveries described herein identify a number of solutions that may be implemented in devices and methods also described herein. Multiple solutions may be combined for implementation, enabling still further devices and methods. The inventor expressly contemplates that the various options described herein for individual devices and methods are not intended to be so limited except where incompatible with other devices and methods. The features and benefits of individual devices herein may also be used in combination with methods and other devices described herein even though not specifically indicated elsewhere. Similarly, the features and benefits of individual methods herein may also be used in combination with devices and other methods described herein even though not specifically indicated elsewhere.

According to one device, a dispensing lid for use with a container includes a body, a cap in rotatable engagement with the body, and an integration unit selectively engageable with and disengageable from the body. The integration unit is formed of a continuous material in common amongst integration unit components, which include a spout, a vent, and a fastener. The spout has a spout conduit passing through the continuous material in common and allowing dispensing through the lid via the spout conduit. The vent is separate from the spout and includes a vent duct passing through the continuous material in common and allowing air exchange through the lid via the vent duct. The fastener is formed of the continuous material in common and has a button, a lever, and a spring. The fastener lever connects the fastener button to the integration unit and the fastener spring applies a force to the fastener lever when pressing the fastener button.

The cap closes the spout and the vent when retained in a closed position by the fastener. The cap opens the spout and the vent when pressing the fastener button overcomes the applied force of the fastener spring and moves the fastener lever, releasing the cap from the closed position. Respective portions of the continuous material that form the spout, vent, and fastener lack material interfaces within the continuous material between the spout, vent, fastener, fastener button, fastener lever, and fastener spring. The continuous material is resilient. The resilience of the continuous material that forms the fastener lever provides the fastener spring integrally. The resilience of the continuous material that forms the vent provides a cap spring integrally. The cap spring applies a force to the cap when the cap is retained in the closed position and the cap spring rotates the cap when the cap is released from the closed position, opening the spout and the vent.

Additional features may be implemented in the described device. By way of example, one or more of the features of the First Example Dispensing Lid described above may be implemented. The features of the described device may also be implemented in other devices and methods herein.

According to another device, a dispensing lid for use with a container includes a body, a cap in rotatable engagement with the body, a spout selectively engageable with and disengageable from the body, and a selectively extendable and retractable carrying mechanism. The spout allows dispensing through the lid.

The carrying mechanism includes a handle having two parallel arms, a bridge connecting the two arms near a first end of each arm, and two posts, each projecting from an outward facing surface of a respective one of the two arms near a second end of its respective arm. The carrying mechanism also includes two arm tracks formed into the body and through which the two arms respectively slide when extending and retracting the handle. The carrying mechanism further includes two post channels inside the two arm tracks and through which the two posts respectively slide when extending and retracting the handle.

The two post channels are each formed in an inward facing surface of a respective one of the two arm tracks. The inward facing surface of each arm track opposes the outward facing surface of one of the two arms with the handle retracted. The cap closes the spout when retained in a closed position. The cap opens the spout when released from the closed position. With the cap in the closed position and the handle retracted, each of two opposing side walls of the cap define part of a respective one of the two arm tracks and each of the two arms is between a respective one of the two side walls of the cap and a respective one of the two post channels.

Additional features may be implemented in the described device. By way of example, one or more of the features of the First Example Dispensing Lid described above may be implemented. The features of the described device may also be implemented in other devices and methods herein.

According to yet another device, a dispensing lid for use with a container includes a body and an integration unit selectively engageable with and disengageable from the body. The integration unit is formed of a continuous material in common amongst integration unit components, which include a spout and a gasket. The spout has a spout conduit passing through the continuous material in common and allowing dispensing through the lid via the spout conduit. The gasket has a concave profile including an upper sloped surface, a lower sloped surface, and a neck joining the upper and lower sloped surfaces such that the upper and lower sloped surfaces decrease in diameter toward the neck and the spout conduit passes within the neck.

The body includes a body conduit passing through the body, the body conduit having a gasket seat complementary to the concave profile of the gasket and circumscribing the body conduit. The neck of the gasket is in tension when the integration unit is engaged with the body, thus pulling the upper and lower sloped surfaces into contact with the gasket seat. The upper and lower sloped surfaces continuously decrease in diameter linearly toward the neck across any portions thereof that contact the gasket seat when the integration unit is engaged with the body. The gasket seals with the gasket seat when the integration unit is engaged with the body, thus aligning the spout conduit with the body conduit.

Additional features may be implemented in the described device. By way of example, one or more of the features of the First, Second, Third, Fourth, or Fifth Example Dispensing Lids described above may be implemented. The features of the described device may also be implemented in other devices and methods herein.

According to a further device, a dispensing lid for use with a container includes a body and an integration unit selectively engageable with and disengageable from the body. The body includes a well recessed into and defining part of an outside surface of the body that does not face inside the container when the dispensing lid is attached to the container. The body also includes a tube projecting outward from a bottom of the well, a tube conduit passing through the tube, and a body conduit passing through the body at the bottom of the well and aligned with the tube conduit.

The integration unit is formed of a continuous material in common amongst integration unit components, which include a spout, a socket, an extension wall, and at least one ring seal. The spout has a spout conduit passing through the continuous material in common and allowing dispensing through the lid via the spout conduit. The socket is formed of the continuous material in common, the spout conduit opening into the socket. The extension wall is formed of the continuous material in common and laterally surrounds a bottom inlet into the spout conduit, the extension wall defining the integration unit socket. The at least one ring seal is formed of the continuous material in common and restricts liquid leakage from the tube conduit through an interface between the body and the integration unit when the integration unit is engaged with the body into the well.

The tube seats inside the integration unit socket when the integration unit is engaged with the body into the well, thus aligning the spout conduit with the tube conduit and the body conduit. The integration unit does not extend into the body conduit when engaged with the body into the well.

Additional features may be implemented in the described device. By way of example, one or more of the features of the Sixth or Seventh Example Dispensing Lid described above may be implemented. The features of the described device may also be implemented in other devices and methods herein.

According to a still further device, a dispensing lid for use with a container includes a body and an integration unit selectively engageable with and disengageable from the body. The body includes a well recessed into and defining part of an outside surface of the body that does not face inside the container when the dispensing lid is attached to the container. The body also includes a tube projecting outward from a bottom of the well, a tube conduit passing through the tube, and a body conduit passing through the body at the bottom of the well and aligned with the tube conduit.

The integration unit is formed of a continuous material in common amongst integration unit components, which include a spout, a socket, and a fastener. The spout has a spout conduit passing through the continuous material in common and allowing dispensing through the lid via the spout conduit. The socket is formed of the continuous material in common, the spout conduit opening into the socket. The fastener is formed of the continuous material in common and has a button, a lever, and a spring. The fastener lever connects the fastener button to the integration unit and the fastener spring applies a force to the fastener lever when pressing the fastener button. The tube seats inside the integration unit socket when the integration unit is engaged with the body into the well, thus aligning the spout conduit with the tube conduit and the body conduit.

Additional features may be implemented in the described device. By way of example, one or more of the features of the First, Second, Third, or Sixth Example Dispensing Lids described above may be implemented. The features of the described device may also be implemented in other devices and methods herein.

Although minima and maxima are listed for the above described ranges and other ranges designated herein, it should be understood that more narrow included ranges may also be desirable and may be distinguishable from prior art. Also, processing principles discussed herein may provide an additional basis for the lesser included ranges.

In compliance with the statute, the embodiments have been described in language more or less specific as to structural and methodical features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

TABLE OF REFERENCE NUMERALS FOR FIGURES

| | |
|---|---|
| 100 | dispensing lid |
| 102 | body |
| 104 | cap |
| 106 | integration unit |
| 108 | spout |
| 110 | spout conduit |
| 112 | fastener |
| 114 | fastener button |
| 116 | fastener lever |
| 120 | vent |
| 122 | vent duct |
| 124 | cap slot |
| 126 | fastener tab |
| 128 | spout rim |
| 130 | spout top inlet |
| 132 | vent rim |
| 134 | vent top inlet |
| 136 | interior seal surface |
| 138 | body conduit |
| 140 | lid outside surface |
| 142 | lid inside surface |
| 150 | concave profile |
| 152 | gasket |
| 154 | gasket seat |
| 164 | extension wall |
| 166 | spout bottom inlet |
| 168 | vent bottom inlet |
| 170 | handle |
| 172 | upper sloped surface |
| 174 | lower sloped surface |
| 176 | neck |
| 178 | fillet |
| 182 | lock mechanism components |
| 192 | hinge mechanism components |
| 194 | shoulder |
| 200 | dispensing lid |
| 202 | body |
| 204 | cap |
| 206 | integration unit |
| 208 | spout |
| 210 | spout conduit |
| 212 | fastener |
| 214 | fastener button |
| 216 | fastener lever |
| 220 | vent |
| 222 | vent duct |
| 224 | cap lip |
| 226 | fastener tab |
| 228 | spout rim |
| 230 | spout top inlet |
| 232 | vent rim |
| 234 | vent top inlet |
| 236 | interior seal surface |
| 238 | body conduit |
| 240 | lid outside surface |
| 242 | lid inside surface |
| 250 | concave profile |
| 252 | gasket |
| 254 | gasket seat |
| 264 | extension wall |
| 266 | spout bottom inlet |
| 268 | vent bottom inlet |
| 270 | handle |
| 272 | upper sloped surface |
| 274 | lower sloped surface |
| 276 | neck |
| 278 | fillet |
| 282 | lock mechanism components |
| 292 | hinge mechanism components |
| 294 | shoulder |
| 306 | integration unit |
| 308 | spout |
| 310 | spout conduit |
| 312 | fastener |
| 314 | fastener button |
| 316 | fastener lever |
| 320 | vent |
| 322 | vent duct |
| 326 | fastener tab |

-continued

TABLE OF REFERENCE NUMERALS FOR FIGURES

| | |
|---|---|
| 328 | spout rim |
| 330 | spout top inlet |
| 332 | vent rim |
| 334 | vent top inlet |
| 350 | concave profile |
| 352 | gasket |
| 372 | upper sloped surface |
| 374 | lower sloped surface |
| 376 | neck |
| 378 | fillet |
| 380 | projection |
| 400 | dispensing lid |
| 402 | body |
| 404 | cap |
| 406 | integration unit |
| 408 | spout |
| 410 | spout conduit |
| 412 | fastener |
| 414 | fastener button |
| 416 | fastener spring |
| 420 | cap spring |
| 424 | cap lip |
| 426 | fastener tab |
| 428 | spout rim |
| 430 | spout top inlet |
| 436 | interior seal surface |
| 438 | body conduit |
| 450 | concave profile |
| 452 | gasket |
| 454 | gasket seat |
| 464 | extension wall |
| 466 | spout bottom inlet |
| 470 | handle |
| 472 | upper sloped surface |
| 474 | lower sloped surface |
| 476 | neck |
| 478 | fillet |
| 492 | hinge mechanism components |
| 500 | dispensing lid |
| 502 | body |
| 504 | cap |
| 506 | integration unit |
| 508 | spout |
| 510 | spout conduit |
| 512 | fastener |
| 514 | fastener button |
| 520 | vent |
| 522 | vent duct |
| 524 | cap lip |
| 526 | fastener tab |
| 528 | spout rim |
| 530 | spout top inlet |
| 532 | vent rim |
| 534 | vent top inlet |
| 536 | interior seal surface |
| 546 | first body conduit |
| 548 | second body conduit |
| 550 | concave profile |
| 552 | gasket |
| 554 | gasket seat |
| 564 | extension wall |
| 566 | spout bottom inlet |
| 568 | vent bottom inlet |
| 570 | handle |
| 572 | upper sloped surface |
| 574 | lower sloped surface |
| 576 | neck |
| 578 | fillet |
| 580 | projection |
| 582 | lock mechanism components |
| 592 | hinge mechanism components |
| 594 | shoulder |
| 596 | recess |
| 598 | integration unit rim |
| 600 | dispensing lid |
| 602 | body |
| 604 | cap |

-continued

| TABLE OF REFERENCE NUMERALS FOR FIGURES | |
|---|---|
| 606 | integration unit |
| 608 | spout |
| 610 | spout conduit |
| 612 | fastener |
| 614 | fastener button |
| 616 | fastener lever |
| 618 | well |
| 620 | vent |
| 622 | vent duct |
| 624 | cap slot |
| 626 | fastener tab |
| 628 | spout rim |
| 630 | spout top inlet |
| 632 | vent rim |
| 634 | vent top inlet |
| 636 | interior seal surface |
| 638 | body conduit |
| 640 | lid outside surface |
| 642 | lid inside surface |
| 644 | body outside surface |
| 656 | tube |
| 658 | well bottom |
| 660 | tube conduit |
| 662 | socket |
| 664 | extension wall |
| 666 | spout bottom inlet |
| 668 | vent bottom inlet |
| 682 | lock mechanism components |
| 686 | ring seal |
| 688 | ring seal tip |
| 690 | ring seal base |
| 692 | hinge mechanism components |
| 694 | shoulder |
| 698 | junction |
| 700 | dispensing lid |
| 702 | body |
| 704 | cap |
| 706 | integration unit |
| 708 | spout |
| 710 | spout conduit |
| 718 | well |
| 728 | spout rim |
| 730 | spout top inlet |
| 736 | interior seal surface |
| 738 | body conduit |
| 744 | body outside surface |
| 756 | tube |
| 758 | well bottom |
| 760 | tube conduit |
| 762 | socket |
| 764 | extension wall |
| 766 | spout bottom inlet |
| 784 | additional wall |
| 798 | junction |
| 802 | arm |
| 804 | bridge |
| 806 | post |
| 808 | arm track |
| 810 | post channel |
| 812 | outward facing surface |
| 814 | inward facing surface |
| 816 | channel end |
| 818 | arm tip |
| 820 | tip recess |
| 822 | cap top |
| 824 | cap side wall |

What is claimed is:

1. A dispensing lid for use with a container, the dispensing lid comprising:

a body including:

a well recessed into and defining part of an outside surface of the body that does not face inside the container when the dispensing lid is attached to the container;

a tube projecting outward from a bottom of the well;

a tube-passageway passing through the tube; and a body-passageway passing through the body at the bottom of the well and aligned with the tube-passageway; and an integration unit selectively engageable with and disengageable from the body, the integration unit being formed of a continuous material in common amongst integration unit components, which include:

a spout having a spout conduit passing through the continuous material in common and allowing dispensing through the dispensing lid via the spout conduit; and a socket formed of the continuous material in common, the spout conduit opening into the socket;

the tube seating inside the integration unit socket when the integration unit is engaged with the body into the well, thus aligning the spout conduit with the tube-passageway conduit and the body-passageway conduit.

2. The dispensing lid of claim 1:

wherein the integration unit further comprises:

a vent separate from the spout and including a vent duct passing through the continuous material in common and allowing air exchange through the dispensing lid via the vent duct;

the spout conduit and the vent duct both opening into the integration unit socket; and the tube seating inside the integration unit socket when the integration unit is engaged with the body into the well, thus aligning the spout conduit and the vent duct with the tube conduit and the body conduit.

3. The dispensing lid of claim 2, wherein the integration unit further comprises an extension wall formed of the continuous material in common and laterally surrounding both a bottom inlet into the spout conduit and a bottom inlet into the vent duct, the extension wall defining the integration unit socket.

4. The dispensing lid of claim 1, wherein the integration unit further comprises an extension wall formed of the continuous material in common and laterally surrounding a bottom inlet into the spout conduit, the extension wall defining the integration unit socket.

5. The dispensing lid of claim 1, wherein the integration unit does not extend into the body-passageway when engaged with the body into the well.

6. The dispensing lid of claim 1, wherein an inside diameter of the tube-passageway is the same as an inside diameter of the body-passageway at a junction where the tube conduit meets the body-passageway.

7. The dispensing lid of claim 1, wherein an inside diameter of the tube-passageway is greater than an inside diameter of the body-passageway at a junction where the tube-passageway meets the body-passageway.

8. The dispensing lid of claim 1, wherein the integration unit further comprises at least one ring seal formed of the continuous material in common and restricting liquid leakage from the tube-passageway via an interface between the body and the integration unit when the integration unit is engaged with the body into the well.

9. The dispensing lid of claim 8, wherein the at least one ring seal has a tapered, wiper profile narrowing from a wide base toward a tip that contacts the body when the integration unit is engaged with the body into the well.

10. The dispensing lid of claim 8, wherein the at least one ring seal is positioned outside the integration unit socket and contacts a surface of the well.

11. The dispensing lid of claim 8, wherein the at least one ring seal is positioned inside the integration unit socket and contacts an outer surface or inner surface of the tube.

12. The dispensing lid of claim 1, wherein the integration unit socket is circular and the tube is annular.

13. A dispensing lid for use with a container, the dispensing lid comprising:

a body including:

a well recessed into and defining part of an outside surface of the body that does not face inside the container when the dispensing lid is attached to the container;

a tube projecting outward from a bottom of the well;

a tube-passageway passing through the tube; and a body-passageway passing through the body at the bottom of the well and aligned with the tube-passageway; and an integration unit selectively engageable with and disengageable from the body, the integration unit being formed of a continuous material in common amongst integration unit components, which include:

a spout having a spout conduit passing through the continuous material in common and allowing dispensing through the dispensing lid via the spout conduit;

a socket formed of the continuous material in common, the spout conduit opening into the socket;

an extension wall formed of the continuous material in common and laterally surrounding a bottom inlet into the spout conduit, the extension wall defining the integration unit socket; and at least one ring seal formed of the continuous material in common and restricting liquid leakage from the tube-passageway through an interface between the body and the integration unit when the integration unit is engaged with the body into the well;

the tube seating inside the integration unit socket when the integration unit is engaged with the body into the well, thus aligning the spout conduit with the tube-passageway and the body-passageway; and the integration unit not extending into the body conduit when engaged with the body into the well.

14. The dispensing lid of claim 13:

wherein the integration unit further comprises:

a vent separate from the spout and including a vent duct passing through the continuous material in common and allowing air exchange through the dispensing lid via the vent duct;

the spout conduit and the vent duct both opening into the integration unit socket; and the tube seating inside the integration unit socket when the integration unit is engaged with the body into the well, thus aligning the spout conduit and the vent duct with the tube-passageway and the body-passageway.

15. The dispensing lid of claim 13, wherein the at least one ring seal has a tapered, wiper profile narrowing from a wide base toward a tip that contacts the body when the integration unit is engaged with the body into the well.

16. A dispensing lid for use with a container, the dispensing lid comprising:

a body including:

a well recessed into and defining part of an outside surface of the body that does not face inside the container when the dispensing lid is attached to the container;

a tube projecting outward from a bottom of the well;

a tube-passageway passing through the tube; and a body-passageway passing through the body at the bottom of the well and aligned with the tube-passageway; and an integration unit selectively engageable with and disengageable from the body, the integration unit being formed of a continuous material in common amongst integration unit components, which include:

a spout having a spout conduit passing through the continuous material in common and allowing dispensing through the dispensing lid via the spout conduit;

a socket formed of the continuous material in common, the spout conduit opening into the socket; and a fastener formed of the continuous material in common and having a fastener button, a fastener lever, and a fastener spring, the fastener lever connecting the fastener button to the integration unit and the fastener spring applying a force to the fastener lever when pressing the fastener button;

the tube seating inside the integration unit socket when the integration unit is engaged with the body into the well, thus aligning the spout conduit with the tube-passageway and the body-passageway.

17. The dispensing lid of claim 16, further comprising:

a cap in rotatable engagement with the body;

the cap closing the spout when retained in a closed position by the fastener; and the cap opening the spout when pressing the fastener button overcomes the applied force of the fastener spring and moves the fastener lever, releasing the cap from the closed position.

18. The dispensing lid of claim 16:

wherein the integration unit further comprises:

a vent separate from the spout and including a vent duct passing through the continuous material in common and allowing air exchange through the dispensing lid via the vent duct;

the spout conduit and the vent duct both opening into the integration unit socket; and the tube seating inside the integration unit socket when the integration unit is engaged with the body into the well, thus aligning the spout conduit and the vent duct with the tube-passageway and the body-passageway.

19. The dispensing lid of claim 18, wherein the integration unit further comprises an extension wall formed of the continuous material in common and laterally surrounding both a bottom inlet into the spout conduit and a bottom inlet into the vent duct, the extension wall defining the integration unit socket.

20. The dispensing lid of claim 16, wherein the integration unit does not extend into the body-passageway when engaged with the body into the well.

21. The dispensing lid of claim 16, wherein the integration unit further comprises at least one ring seal formed of the continuous material in common and restricting liquid leakage from the tube-passageway through an interface between the body and the integration unit when the integration unit is engaged with the body into the well.

* * * * *